US011198289B2

(12) United States Patent
Ito et al.

(10) Patent No.: US 11,198,289 B2
(45) **Date of Patent: *Dec. 14, 2021**

(54) LIQUID DISCHARGE HEAD CONTROL CIRCUIT, LIQUID DISCHARGE HEAD, AND LIQUID DISCHARGE APPARATUS

(71) Applicant: SEIKO EPSON CORPORATION, Tokyo (JP)

(72) Inventors: Sukehiro Ito, Matsumoto (JP); Hideaki Nishimura, Nagano (JP)

(73) Assignee: SEIKO EPSON CORPORATION, Tokyo (JP)

( * ) Notice: Subject to any disclaimer, the term of this patent is extended or adjusted under 35 U.S.C. 154(b) by 53 days.

This patent is subject to a terminal disclaimer.

(21) Appl. No.: 16/727,600

(22) Filed: Dec. 26, 2019

(65) Prior Publication Data

US 2020/0198334 A1 Jun. 25, 2020

(30) Foreign Application Priority Data

Dec. 25, 2018 (JP) ..... JP2018-241701
Feb. 28, 2019 (JP) ..... JP2019-036740

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
None
See application file for complete search history.

(56) References Cited

U.S. PATENT DOCUMENTS

2018/0272700 A1* 9/2018 Ito ..... B41J 2/1433
2019/0009531 A1* 1/2019 Furukawa ..... B41J 2/04596

FOREIGN PATENT DOCUMENTS

JP 2017-114020 A 6/2017

* cited by examiner

*Primary Examiner* — Erica S Lin
(74) *Attorney, Agent, or Firm* — Oliff PLC

(57) ABSTRACT

A liquid discharge head control circuit that includes a conversion circuit that converts a base diagnosis signal being a base of a first diagnosis signal into a pair of first differential signals, a first wiring, a second wiring for propagating a second reference voltage signal to be supplied to a restoration circuit, a third wiring for propagating the second reference voltage signal to be supplied to the restoration circuit, a fourth wiring for propagating one signal of a pair of first differential signals, and a fifth wiring for propagating the other signal of a pair of first differential signals. The fourth wiring and the second wiring are located to be adjacent to each other, the fifth wiring and the third wiring are located to be adjacent to each other, and the fourth wiring and the fifth wiring are located between the second wiring and the third wiring.

12 Claims, 25 Drawing Sheets

| [SIH, SIL] | | [1, 1] LARGE DOT | [1, 0] MEDIUM DOT | [0, 1] SMALL DOT | [0, 0] NON-RECORDING |
|---|---|---|---|---|---|
| S1 | T1 | H | H | L | L |
| | T2 | H | L | L | L |
| S2 | T3 | L | L | L | H |
| | T4 | L | H | H | L |

FIG. 17

| CABLE 19a | | | CONTACT PORTION | CONNECTOR 350a | SIGNAL |
|---|---|---|---|---|---|
| TERMINAL NUMBER | WIRING NUMBER | TERMINAL NUMBER | | TERMINAL NUMBER | |
| 195a-1 | 197a-1 | 196a-1 | 180a-1 | 353a-1 | VHV |
| 195a-2 | 197a-2 | 196a-2 | 180a-2 | 353a-2 | GND1 |
| 195a-3 | 197a-3 | 196a-3 | 180a-3 | 353a-3 | XHOT |
| 195a-4 | 197a-4 | 196a-4 | 180a-4 | 353a-4 | GND1 |
| 195a-5 | 197a-5 | 196a-5 | 180a-5 | 353a-5 | GND1 |
| 195a-6 | 197a-6 | 196a-6 | 180a-6 | 353a-6 | GND1 |
| 195a-7 | 197a-7 | 196a-7 | 180a-7 | 353a-7 | GND1 |
| 195a-8 | 197a-8 | 196a-8 | 180a-8 | 353a-8 | GND1 |
| 195a-9 | 197a-9 | 196a-9 | 180a-9 | 353a-9 | GND1 |
| 195a-10 | 197a-10 | 196a-10 | 180a-10 | 353a-10 | GND1 |
| 195a-11 | 197a-11 | 196a-11 | 180a-11 | 353a-11 | GND1 |
| 195a-12 | 197a-12 | 196a-12 | 180a-12 | 353a-12 | GND1 |
| 195a-13 | 197a-13 | 196a-13 | 180a-13 | 353a-13 | GND1 |
| 195a-14 | 197a-14 | 196a-14 | 180a-14 | 353a-14 | GND1 |
| 195a-15 | 197a-15 | 196a-15 | 180a-15 | 353a-15 | GND1 |
| 195a-16 | 197a-16 | 196a-16 | 180a-16 | 353a-16 | GND1 |
| 195a-17 | 197a-17 | 196a-17 | 180a-17 | 353a-17 | GND1 |
| 195a-18 | 197a-18 | 196a-18 | 180a-18 | 353a-18 | GND1 |
| 195a-19 | 197a-19 | 196a-19 | 180a-19 | 353a-19 | GND1 |
| 195a-20 | 197a-20 | 196a-20 | 180a-20 | 353a-20 | VDD |
| 195a-21 | 197a-21 | 196a-21 | 180a-21 | 353a-21 | VDD |
| 195a-22 | 197a-22 | 196a-22 | 180a-22 | 353a-22 | VDD |
| 195a-23 | 197a-23 | 196a-23 | 180a-23 | 353a-23 | VDD |
| 195a-24 | 197a-24 | 196a-24 | 180a-24 | 353a-24 | TH |

FIG. 18

| CABLE 19b | | | CONTACT PORTION | CONNECTOR 350b | SIGNAL |
|---|---|---|---|---|---|
| TERMINAL NUMBER | WIRING NUMBER | TERMINAL NUMBER | | TERMINAL NUMBER | |
| 195b-1 | 197b-1 | 196b-1 | 180b-1 | 353b-1 | NVTS |
| 195b-2 | 197b-2 | 196b-2 | 180b-2 | 353b-2 | TSIG |
| 195b-3 | 197b-3 | 196b-3 | 180b-3 | 353b-3 | GND2 |
| 195b-4 | 197b-4 | 196b-4 | 180b-4 | 353b-4 | dDIG1+, dSCK+ |
| 195b-5 | 197b-5 | 196b-5 | 180b-5 | 353b-5 | dDIG1-, dSCK- |
| 195b-6 | 197b-6 | 196b-6 | 180b-6 | 353b-6 | GND2 |
| 195b-7 | 197b-7 | 196b-7 | 180b-7 | 353b-7 | dDIG2+, dSI1+ |
| 195b-8 | 197b-8 | 196b-8 | 180b-8 | 353b-8 | dDIG2-, dSI1- |
| 195b-9 | 197b-9 | 196b-9 | 180b-9 | 353b-9 | dSI2+ |
| 195b-10 | 197b-10 | 196b-10 | 180b-10 | 353b-10 | dSI2- |
| 195b-11 | 197b-11 | 196b-11 | 180b-11 | 353b-11 | dSI3+ |
| 195b-12 | 197b-12 | 196b-12 | 180b-12 | 353b-12 | dSI3- |
| 195b-13 | 197b-13 | 196b-13 | 180b-13 | 353b-13 | dSI4+ |
| 195b-14 | 197b-14 | 196b-14 | 180b-14 | 353b-14 | dSI4- |
| 195b-15 | 197b-15 | 196b-15 | 180b-15 | 353b-15 | dSI5+ |
| 195b-16 | 197b-16 | 196b-16 | 180b-16 | 353b-16 | dSI5- |
| 195b-17 | 197b-17 | 196b-17 | 180b-17 | 353b-17 | dSI6+ |
| 195b-18 | 197b-18 | 196b-18 | 180b-18 | 353b-18 | dSI6- |
| 195b-19 | 197b-19 | 196b-19 | 180b-19 | 353b-19 | GND1 |
| 195b-20 | 197b-20 | 196b-20 | 180b-20 | 353b-20 | oDIG3, oLAT |
| 195b-21 | 197b-21 | 196b-21 | 180b-21 | 353b-21 | GND1 |
| 195b-22 | 197b-22 | 196b-22 | 180b-22 | 353b-22 | oDIG4, oCHa |
| 195b-23 | 197b-23 | 196b-23 | 180b-23 | 353b-23 | oCHb |
| 195b-24 | 197b-24 | 196b-24 | 180b-24 | 353b-24 | NCHG |

FIG. 19

| CABLE 19c | | | CONTACT PORTION | CONNECTOR 350c | SIGNAL |
|---|---|---|---|---|---|
| TERMINAL NUMBER | WIRING NUMBER | TERMINAL NUMBER | | TERMINAL NUMBER | |
| 195c-1 | 197c-1 | 196c-1 | 180c-1 | 353c-1 | VBS7 |
| 195c-2 | 197c-2 | 196c-2 | 180c-2 | 353c-2 | COMB7 |
| 195c-3 | 197c-3 | 196c-3 | 180c-3 | 353c-3 | VBS7 |
| 195c-4 | 197c-4 | 196c-4 | 180c-4 | 353c-4 | COMB7 |
| 195c-5 | 197c-5 | 196c-5 | 180c-5 | 353c-5 | VBS8 |
| 195c-6 | 197c-6 | 196c-6 | 180c-6 | 353c-6 | COMA8 |
| 195c-7 | 197c-7 | 196c-7 | 180c-7 | 353c-7 | VBS8 |
| 195c-8 | 197c-8 | 196c-8 | 180c-8 | 353c-8 | COMA8 |
| 195c-9 | 197c-9 | 196c-9 | 180c-9 | 353c-9 | VBS9 |
| 195c-10 | 197c-10 | 196c-10 | 180c-10 | 353c-10 | COMB9 |
| 195c-11 | 197c-11 | 196c-11 | 180c-11 | 353c-11 | VBS9 |
| 195c-12 | 197c-12 | 196c-12 | 180c-12 | 353c-12 | COMB9 |
| 195c-13 | 197c-13 | 196c-13 | 180c-13 | 353c-13 | VBS10 |
| 195c-14 | 197c-14 | 196c-14 | 180c-14 | 353c-14 | COMA10 |
| 195c-15 | 197c-15 | 196c-15 | 180c-15 | 353c-15 | VBS10 |
| 195c-16 | 197c-16 | 196c-16 | 180c-16 | 353c-16 | COMA10 |
| 195c-17 | 197c-17 | 196c-17 | 180c-17 | 353c-17 | VBS11 |
| 195c-18 | 197c-18 | 196c-18 | 180c-18 | 353c-18 | COMB11 |
| 195c-19 | 197c-19 | 196c-19 | 180c-19 | 353c-19 | VBS11 |
| 195c-20 | 197c-20 | 196c-20 | 180c-20 | 353c-20 | COMB11 |
| 195c-21 | 197c-21 | 196c-21 | 180c-21 | 353c-21 | VBS12 |
| 195c-22 | 197c-22 | 196c-22 | 180c-22 | 353c-22 | COMA12 |
| 195c-23 | 197c-23 | 196c-23 | 180c-23 | 353c-23 | VBS12 |
| 195c-24 | 197c-24 | 196c-24 | 180c-24 | 353c-24 | COMA12 |

FIG. 20

| CABLE 19d | | | CONTACT PORTION | CONNECTOR 350d | SIGNAL |
|---|---|---|---|---|---|
| TERMINAL NUMBER | WIRING NUMBER | TERMINAL NUMBER | | TERMINAL NUMBER | |
| 195d-1 | 197d-1 | 196d-1 | 180d-1 | 353d-1 | VBS12 |
| 195d-2 | 197d-2 | 196d-2 | 180d-2 | 353d-2 | COMB12 |
| 195d-3 | 197d-3 | 196d-3 | 180d-3 | 353d-3 | VBS12 |
| 195d-4 | 197d-4 | 196d-4 | 180d-4 | 353d-4 | COMB12 |
| 195d-5 | 197d-5 | 196d-5 | 180d-5 | 353d-5 | VBS11 |
| 195d-6 | 197d-6 | 196d-6 | 180d-6 | 353d-6 | COMA11 |
| 195d-7 | 197d-7 | 196d-7 | 180d-7 | 353d-7 | VBS11 |
| 195d-8 | 197d-8 | 196d-8 | 180d-8 | 353d-8 | COMA11 |
| 195d-9 | 197d-9 | 196d-9 | 180d-9 | 353d-9 | VBS10 |
| 195d-10 | 197d-10 | 196d-10 | 180d-10 | 353d-10 | COMB10 |
| 195d-11 | 197d-11 | 196d-11 | 180d-11 | 353d-11 | VBS10 |
| 195d-12 | 197d-12 | 196d-12 | 180d-12 | 353d-12 | COMB10 |
| 195d-13 | 197d-13 | 196d-13 | 180d-13 | 353d-13 | VBS9 |
| 195d-14 | 197d-14 | 196d-14 | 180d-14 | 353d-14 | COMA9 |
| 195d-15 | 197d-15 | 196d-15 | 180d-15 | 353d-15 | VBS9 |
| 195d-16 | 197d-16 | 196d-16 | 180d-16 | 353d-16 | COMA9 |
| 195d-17 | 197d-17 | 196d-17 | 180d-17 | 353d-17 | VBS8 |
| 195d-18 | 197d-18 | 196d-18 | 180d-18 | 353d-18 | COMB8 |
| 195d-19 | 197d-19 | 196d-19 | 180d-19 | 353d-19 | VBS8 |
| 195d-20 | 197d-20 | 196d-20 | 180d-20 | 353d-20 | COMB8 |
| 195d-21 | 197d-21 | 196d-21 | 180d-21 | 353d-21 | VBS7 |
| 195d-22 | 197d-22 | 196d-22 | 180d-22 | 353d-22 | COMA7 |
| 195d-23 | 197d-23 | 196d-23 | 180d-23 | 353d-23 | VBS7 |
| 195d-24 | 197d-24 | 196d-24 | 180d-24 | 353d-24 | COMA7 |

FIG. 21

| CABLE 19e | | | CONTACT PORTION | CONNECTOR 350e | SIGNAL |
|---|---|---|---|---|---|
| TERMINAL NUMBER | WIRING NUMBER | TERMINAL NUMBER | | TERMINAL NUMBER | |
| 195e-1 | 197e-1 | 196e-1 | 196e-1 | 353e-1 | VHV |
| 195e-2 | 197e-2 | 196e-2 | 196e-2 | 353e-2 | GND1 |
| 195e-3 | 197e-3 | 196e-3 | 196e-3 | 353e-3 | XHOT |
| 195e-4 | 197e-4 | 196e-4 | 196e-4 | 353e-4 | GND1 |
| 195e-5 | 197e-5 | 196e-5 | 196e-5 | 353e-5 | GND1 |
| 195e-6 | 197e-6 | 196e-6 | 196e-6 | 353e-6 | GND1 |
| 195e-7 | 197e-7 | 196e-7 | 196e-7 | 353e-7 | GND1 |
| 195e-8 | 197e-8 | 196e-8 | 196e-8 | 353e-8 | GND1 |
| 195e-9 | 197e-9 | 196e-9 | 196e-9 | 353e-9 | GND1 |
| 195e-10 | 197e-10 | 196e-10 | 196e-10 | 353e-10 | GND1 |
| 195e-11 | 197e-11 | 196e-11 | 196e-11 | 353e-11 | GND1 |
| 195e-12 | 197e-12 | 196e-12 | 196e-12 | 353e-12 | GND1 |
| 195e-13 | 197e-13 | 196e-13 | 196e-13 | 353e-13 | GND1 |
| 195e-14 | 197e-14 | 196e-14 | 196e-14 | 353e-14 | GND1 |
| 195e-15 | 197e-15 | 196e-15 | 196e-15 | 353e-15 | GND1 |
| 195e-16 | 197e-16 | 196e-16 | 196e-16 | 353e-16 | GND1 |
| 195e-17 | 197e-17 | 196e-17 | 196e-17 | 353e-17 | GND1 |
| 195e-18 | 197e-18 | 196e-18 | 196e-18 | 353e-18 | GND1 |
| 195e-19 | 197e-19 | 196e-19 | 196e-19 | 353e-19 | GND1 |
| 195e-20 | 197e-20 | 196e-20 | 196e-20 | 353e-20 | VDD |
| 195e-21 | 197e-21 | 196e-21 | 196e-21 | 353e-21 | VDD |
| 195e-22 | 197e-22 | 196e-22 | 196e-22 | 353e-22 | VDD |
| 195e-23 | 197e-23 | 196e-23 | 196e-23 | 353e-23 | VDD |
| 195e-24 | 197e-24 | 196e-24 | 196e-24 | 353e-24 | TH |

FIG. 22

| CABLE 19f | | | CONTACT PORTION | CONNECTOR 350f | SIGNAL |
|---|---|---|---|---|---|
| TERMINAL NUMBER | WIRING NUMBER | TERMINAL NUMBER | | TERMINAL NUMBER | |
| 195f-1 | 197f-1 | 196f-1 | 180f-1 | 353f-1 | NVTS |
| 195f-2 | 197f-2 | 196f-2 | 180f-2 | 353f-2 | TSIG |
| 195f-3 | 197f-3 | 196f-3 | 180f-3 | 353f-3 | GND2 |
| 195f-4 | 197f-4 | 196f-4 | 180f-4 | 353f-4 | dSCK+ |
| 195f-5 | 197f-5 | 196f-5 | 180f-5 | 353f-5 | dSCK- |
| 195f-6 | 197f-6 | 196f-6 | 180f-6 | 353f-6 | GND2 |
| 195f-7 | 197f-7 | 196f-7 | 180f-7 | 353f-7 | dSI7+ |
| 195f-8 | 197f-8 | 196f-8 | 180f-8 | 353f-8 | dSI7- |
| 195f-9 | 197f-9 | 196f-9 | 180f-9 | 353f-9 | dSI8+ |
| 195f-10 | 197f-10 | 196f-10 | 180f-10 | 353f-10 | dSI8- |
| 195f-11 | 197f-11 | 196f-11 | 180f-11 | 353f-11 | dSI9+ |
| 195f-12 | 197f-12 | 196f-12 | 180f-12 | 353f-12 | dSI9- |
| 195f-13 | 197f-13 | 196f-13 | 180f-13 | 353f-13 | dSI10+ |
| 195f-14 | 197f-14 | 196f-14 | 180f-14 | 353f-14 | dSI10- |
| 195f-15 | 197f-15 | 196f-15 | 180f-15 | 353f-15 | dSI11+ |
| 195f-16 | 197f-16 | 196f-16 | 180f-16 | 353f-16 | dSI11- |
| 195f-17 | 197f-17 | 196f-17 | 180f-17 | 353f-17 | dSI12+ |
| 195f-18 | 197f-18 | 196f-18 | 180f-18 | 353f-18 | dSI12- |
| 195f-19 | 197f-19 | 196f-19 | 180f-19 | 353f-19 | GND1 |
| 195f-20 | 197f-20 | 196f-20 | 180f-20 | 353f-20 | oLAT |
| 195f-21 | 197f-21 | 196f-21 | 180f-21 | 353f-21 | GND1 |
| 195f-22 | 197f-22 | 196f-22 | 180f-22 | 353f-22 | oCHa |
| 195f-23 | 197f-23 | 196f-23 | 180f-23 | 353f-23 | oCHb |
| 195f-24 | 197f-24 | 196f-24 | 180f-24 | 353f-24 | NCHG |

FIG. 23

| CABLE 19g | | | CONTACT PORTION | CONNECTOR 350g | SIGNAL |
|---|---|---|---|---|---|
| TERMINAL NUMBER | WIRING NUMBER | TERMINAL NUMBER | | TERMINAL NUMBER | |
| 195g-1 | 197g-1 | 196g-1 | 180g-1 | 353g-1 | VBS1 |
| 195g-2 | 197g-2 | 196g-2 | 180g-2 | 353g-2 | COMB1 |
| 195g-3 | 197g-3 | 196g-3 | 180g-3 | 353g-3 | VBS1 |
| 195g-4 | 197g-4 | 196g-4 | 180g-4 | 353g-4 | COMB1 |
| 195g-5 | 197g-5 | 196g-5 | 180g-5 | 353g-5 | VBS2 |
| 195g-6 | 197g-6 | 196g-6 | 180g-6 | 353g-6 | COMA2 |
| 195g-7 | 197g-7 | 196g-7 | 180g-7 | 353g-7 | VBS2 |
| 195g-8 | 197g-8 | 196g-8 | 180g-8 | 353g-8 | COMA2 |
| 195g-9 | 197g-9 | 196g-9 | 180g-9 | 353g-9 | VBS3 |
| 195g-10 | 197g-10 | 196g-10 | 180g-10 | 353g-10 | COMB3 |
| 195g-11 | 197g-11 | 196g-11 | 180g-11 | 353g-11 | VBS3 |
| 195g-12 | 197g-12 | 196g-12 | 180g-12 | 353g-12 | COMB3 |
| 195g-13 | 197g-13 | 196g-13 | 180g-13 | 353g-13 | VBS4 |
| 195g-14 | 197g-14 | 196g-14 | 180g-14 | 353g-14 | COMA4 |
| 195g-15 | 197g-15 | 196g-15 | 180g-15 | 353g-15 | VBS4 |
| 195g-16 | 197g-16 | 196g-16 | 180g-16 | 353g-16 | COMA4 |
| 195g-17 | 197g-17 | 196g-17 | 180g-17 | 353g-17 | VBS5 |
| 195g-18 | 197g-18 | 196g-18 | 180g-18 | 353g-18 | COMB5 |
| 195g-19 | 197g-19 | 196g-19 | 180g-19 | 353g-19 | VBS5 |
| 195g-20 | 197g-20 | 196g-20 | 180g-20 | 353g-20 | COMB5 |
| 195g-21 | 197g-21 | 196g-21 | 180g-21 | 353g-21 | VBS6 |
| 195g-22 | 197g-22 | 196g-22 | 180g-22 | 353g-22 | COMA6 |
| 195g-23 | 197g-23 | 196g-23 | 180g-23 | 353g-23 | VBS6 |
| 195g-24 | 197g-24 | 196g-24 | 180g-24 | 353g-24 | COMA6 |

FIG. 24

| CABLE 19h | | | CONTACT PORTION | CONNECTOR 350h | SIGNAL |
|---|---|---|---|---|---|
| TERMINAL NUMBER | WIRING NUMBER | TERMINAL NUMBER | | TERMINAL NUMBER | |
| 195h-1 | 197h-1 | 196h-1 | 180h-1 | 353h-1 | VBS6 |
| 195h-2 | 197h-2 | 196h-2 | 180h-2 | 353h-2 | COMB6 |
| 195h-3 | 197h-3 | 196h-3 | 180h-3 | 353h-3 | VBS6 |
| 195h-4 | 197h-4 | 196h-4 | 180h-4 | 353h-4 | COMB6 |
| 195h-5 | 197h-5 | 196h-5 | 180h-5 | 353h-5 | VBS5 |
| 195h-6 | 197h-6 | 196h-6 | 180h-6 | 353h-6 | COMA5 |
| 195h-7 | 197h-7 | 196h-7 | 180h-7 | 353h-7 | VBS5 |
| 195h-8 | 197h-8 | 196h-8 | 180h-8 | 353h-8 | COMA5 |
| 195h-9 | 197h-9 | 196h-9 | 180h-9 | 353h-9 | VBS4 |
| 195h-10 | 197h-10 | 196h-10 | 180h-10 | 353h-10 | COMB4 |
| 195h-11 | 197h-11 | 196h-11 | 180h-11 | 353h-11 | VBS4 |
| 195h-12 | 197h-12 | 196h-12 | 180h-12 | 353h-12 | COMB4 |
| 195h-13 | 197h-13 | 196h-13 | 180h-13 | 353h-13 | VBS3 |
| 195h-14 | 197h-14 | 196h-14 | 180h-14 | 353h-14 | COMA3 |
| 195h-15 | 197h-15 | 196h-15 | 180h-15 | 353h-15 | VBS3 |
| 195h-16 | 197h-16 | 196h-16 | 180h-16 | 353h-16 | COMA3 |
| 195h-17 | 197h-17 | 196h-17 | 180h-17 | 353h-17 | VBS2 |
| 195h-18 | 197h-18 | 196h-18 | 180h-18 | 353h-18 | COMB2 |
| 195h-19 | 197h-19 | 196h-19 | 180h-19 | 353h-19 | VBS2 |
| 195h-20 | 197h-20 | 196h-20 | 180h-20 | 353h-20 | COMB2 |
| 195h-21 | 197h-21 | 196h-21 | 180h-21 | 353h-21 | VBS1 |
| 195h-22 | 197h-22 | 196h-22 | 180h-22 | 353h-22 | COMA1 |
| 195h-23 | 197h-23 | 196h-23 | 180h-23 | 353h-23 | VBS1 |
| 195h-24 | 197h-24 | 196h-24 | 180h-24 | 353h-24 | COMA1 |

FIG. 25

| CABLE 19b | | | CONTACT PORTION | CONNECTOR 350b | SIGNAL |
|---|---|---|---|---|---|
| TERMINAL NUMBER | WIRING NUMBER | TERMINAL NUMBER | | TERMINAL NUMBER | |
| 195b-1 | 197b-1 | 196b-1 | 180b-1 | 353b-1 | NVTS |
| 195b-2 | 197b-2 | 196b-2 | 180b-2 | 353b-2 | TSIG |
| 195b-3 | 197b-3 | 196b-3 | 180b-3 | 353b-3 | GND2 |
| 195b-4 | 197b-4 | 196b-4 | 180b-4 | 353b-4 | dDIG1+, dSI1+ |
| 195b-5 | 197b-5 | 196b-5 | 180b-5 | 353b-5 | dDIG1-, dSI1- |
| 195b-6 | 197b-6 | 196b-6 | 180b-6 | 353b-6 | GND2 |
| 195b-7 | 197b-7 | 196b-7 | 180b-7 | 353b-7 | dDIG2+, dSCK+ |
| 195b-8 | 197b-8 | 196b-8 | 180b-8 | 353b-8 | dDIG2-, dSCK- |
| 195b-9 | 197b-9 | 196b-9 | 180b-9 | 353b-9 | dSI2+ |
| 195b-10 | 197b-10 | 196b-10 | 180b-10 | 353b-10 | dSI2- |
| 195b-11 | 197b-11 | 196b-11 | 180b-11 | 353b-11 | dSI3+ |
| 195b-12 | 197b-12 | 196b-12 | 180b-12 | 353b-12 | dSI3- |
| 195b-13 | 197b-13 | 196b-13 | 180b-13 | 353b-13 | dSI4+ |
| 195b-14 | 197b-14 | 196b-14 | 180b-14 | 353b-14 | dSI4- |
| 195b-15 | 197b-15 | 196b-15 | 180b-15 | 353b-15 | dSI5+ |
| 195b-16 | 197b-16 | 196b-16 | 180b-16 | 353b-16 | dSI5- |
| 195b-17 | 197b-17 | 196b-17 | 180b-17 | 353b-17 | dSI6+ |
| 195b-18 | 197b-18 | 196b-18 | 180b-18 | 353b-18 | dSI6- |
| 195b-19 | 197b-19 | 196b-19 | 180b-19 | 353b-19 | GND1 |
| 195b-20 | 197b-20 | 196b-20 | 180b-20 | 353b-20 | oDIG3, oLAT |
| 195b-21 | 197b-21 | 196b-21 | 180b-21 | 353b-21 | GND1 |
| 195b-22 | 197b-22 | 196b-22 | 180b-22 | 353b-22 | oDIG4, oCHa |
| 195b-23 | 197b-23 | 196b-23 | 180b-23 | 353b-23 | oCHb |
| 195b-24 | 197b-24 | 196b-24 | 180b-24 | 353b-24 | NCHG |

FIG. 26

| CABLE 19a | | | CONTACT PORTION | CONNECTOR 350a | SIGNAL |
|---|---|---|---|---|---|
| TERMINAL NUMBER | WIRING NUMBER | TERMINAL NUMBER | | TERMINAL NUMBER | |
| 195a-1 | 197a-1 | 196a-1 | 180a-1 | 353a-1 | VHV |
| 195a-2 | 197a-2 | 196a-2 | 180a-2 | 353a-2 | GND1 |
| 195a-3 | 197a-3 | 196a-3 | 180a-3 | 353a-3 | XHOT |
| 195a-4 | 197a-4 | 196a-4 | 180a-4 | 353a-4 | GND1 |
| 195a-5 | 197a-5 | 196a-5 | 180a-5 | 353a-5 | GND1 |
| 195a-6 | 197a-6 | 196a-6 | 180a-6 | 353a-6 | GND1 |
| 195a-7 | 197a-7 | 196a-7 | 180a-7 | 353a-7 | GND1 |
| 195a-8 | 197a-8 | 196a-8 | 180a-8 | 353a-8 | GND1 |
| 195a-9 | 197a-9 | 196a-9 | 180a-9 | 353a-9 | GND1 |
| 195a-10 | 197a-10 | 196a-10 | 180a-10 | 353a-10 | GND1 |
| 195a-11 | 197a-11 | 196a-11 | 180a-11 | 353a-11 | GND1 |
| 195a-12 | 197a-12 | 196a-12 | 180a-12 | 353a-12 | GND1 |
| 195a-13 | 197a-13 | 196a-13 | 180a-13 | 353a-13 | GND1 |
| 195a-14 | 197a-14 | 196a-14 | 180a-14 | 353a-14 | GND1 |
| 195a-15 | 197a-15 | 196a-15 | 180a-15 | 353a-15 | GND1 |
| 195a-16 | 197a-16 | 196a-16 | 180a-16 | 353a-16 | GND1 |
| 195a-17 | 197a-17 | 196a-17 | 180a-17 | 353a-17 | GND1 |
| 195a-18 | 197a-18 | 196a-18 | 180a-18 | 353a-18 | GND1 |
| 195a-19 | 197a-19 | 196a-19 | 180a-19 | 353a-19 | GND1 |
| 195a-20 | 197a-20 | 196a-20 | 180a-20 | 353a-20 | GND2 |
| 195a-21 | 197a-21 | 196a-21 | 180a-21 | 353a-21 | GND2 |
| 195a-22 | 197a-22 | 196a-22 | 180a-22 | 353a-22 | VDD |
| 195a-23 | 197a-23 | 196a-23 | 180a-23 | 353a-23 | VDD |
| 195a-24 | 197a-24 | 196a-24 | 180a-24 | 353a-24 | TH |

FIG. 27

| CABLE 19b | | | CONTACT PORTION | CONNECTOR 350b | SIGNAL |
|---|---|---|---|---|---|
| TERMINAL NUMBER | WIRING NUMBER | TERMINAL NUMBER | | TERMINAL NUMBER | |
| 195b-1 | 197b-1 | 196b-1 | 180b-1 | 353b-1 | NVTS |
| 195b-2 | 197b-2 | 196b-2 | 180b-2 | 353b-2 | TSIG |
| 195b-3 | 197b-3 | 196b-3 | 180b-3 | 353b-3 | GND2 |
| 195b-4 | 197b-4 | 196b-4 | 180b-4 | 353b-4 | dDIG1+, dSCK+ |
| 195b-5 | 197b-5 | 196b-5 | 180b-5 | 353b-5 | dDIG1-, dSCK- |
| 195b-6 | 197b-6 | 196b-6 | 180b-6 | 353b-6 | GND2 |
| 195b-7 | 197b-7 | 196b-7 | 180b-7 | 353b-7 | dDIG2+, dSI1+ |
| 195b-8 | 197b-8 | 196b-8 | 180b-8 | 353b-8 | dDIG2-, dSI1- |
| 195b-9 | 197b-9 | 196b-9 | 180b-9 | 353b-9 | dSI2+ |
| 195b-10 | 197b-10 | 196b-10 | 180b-10 | 353b-10 | dSI2- |
| 195b-11 | 197b-11 | 196b-11 | 180b-11 | 353b-11 | dSI3+ |
| 195b-12 | 197b-12 | 196b-12 | 180b-12 | 353b-12 | dSI3- |
| 195b-13 | 197b-13 | 196b-13 | 180b-13 | 353b-13 | dSI4+ |
| 195b-14 | 197b-14 | 196b-14 | 180b-14 | 353b-14 | dSI4- |
| 195b-15 | 197b-15 | 196b-15 | 180b-15 | 353b-15 | dSI5+ |
| 195b-16 | 197b-16 | 196b-16 | 180b-16 | 353b-16 | dSI5- |
| 195b-17 | 197b-17 | 196b-17 | 180b-17 | 353b-17 | dSI6+ |
| 195b-18 | 197b-18 | 196b-18 | 180b-18 | 353b-18 | dSI6- |
| 195b-19 | 197b-19 | 196b-19 | 180b-19 | 353b-19 | GND1 |
| 195b-20 | 197b-20 | 196b-20 | 180b-20 | 353b-20 | oDIG3, oLAT |
| 195b-21 | 197b-21 | 196b-21 | 180b-21 | 353b-21 | GND1 |
| 195b-22 | 197b-22 | 196b-22 | 180b-22 | 353b-22 | oDIG4, oCHa |
| 195b-23 | 197b-23 | 196b-23 | 180b-23 | 353b-23 | oCHb |
| 195b-24 | 197b-24 | 196b-24 | 180b-24 | 353b-24 | NCHG |

LIQUID DISCHARGE HEAD CONTROL CIRCUIT, LIQUID DISCHARGE HEAD, AND LIQUID DISCHARGE APPARATUS

The present application is based on, and claims priority from JP Application Serial Number 2018-241701, filed Dec. 25, 2018 and JP Application Serial Number 2019-036740, filed Feb. 28, 2019, the disclosures of which are hereby incorporated by reference herein in their entirety.

BACKGROUND

1. Technical Field

The present disclosure relates to a liquid discharge head control circuit, a liquid discharge head, and a liquid discharge apparatus.

2. Related Art

A liquid discharge apparatus such as an ink jet printer forms characters or an image on a recording medium in a manner that the liquid discharge apparatus drives a piezoelectric element provided in a print head by a driving signal and thus discharges a liquid such as an ink with which a cavity is filled, from a nozzle. In such a liquid discharge apparatus, when a problem occurs in the print head, discharge abnormality in which it is not possible to normally discharge the liquid from the nozzle may occur. When such discharge abnormality occurs, discharge accuracy of the ink discharged from the nozzle may be decreased, and quality of an image formed on the recording medium may be decreased.

JP-A-2017-114020 discloses a print head having a self-diagnosis function of determining whether or not a dot satisfying normal print quality can be formed, in accordance with a plurality of signals input to a print head (liquid discharge head) by the print head itself.

However, in the print head disclosed in JP-A-2017-114020, the self-diagnosis function may not be normally performed when a signal waveform is distorted by superimposing noise on a plurality of signal waveforms for performing the self-diagnosis function.

SUMMARY

According to an aspect of the present disclosure, a liquid discharge head control circuit controls an operation of a liquid discharge head that discharges a liquid from a nozzle. The liquid discharge head includes a driving element that drives based on a driving signal to discharge the liquid from the nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit. The liquid discharge head control circuit includes a conversion circuit that converts a base diagnosis signal being a base of the first diagnosis signal into the pair of first differential signals, a first wiring which is electrically coupled to the first terminal and is used for propagating a first reference voltage signal to be supplied to the driving signal selection circuit, a second wiring which is electrically coupled to the second terminal and is used for propagating a second reference voltage signal to be supplied to the restoration circuit, a third wiring which is electrically coupled to the third terminal and is used for propagating the second reference voltage signal to be supplied to the restoration circuit, a fourth wiring which is electrically coupled to the fourth terminal and is used for propagating one signal of the pair of first differential signals, a fifth wiring which is electrically coupled to the fifth terminal and is used for propagating the other signal of the pair of first differential signals, and a driving signal output circuit that outputs the driving signal. The fourth wiring and the fifth wiring are arranged side by side. In a direction in which the fourth wiring and the fifth wiring are arranged, the fourth wiring and the second wiring are located to be adjacent to each other, the fifth wiring and the third wiring are located to be adjacent to each other, and the fourth wiring and the fifth wiring are located between the second wiring and the third wiring.

According to another aspect of the present disclosure, a liquid discharge head control circuit controls an operation of a liquid discharge head that discharges a liquid from a nozzle. The liquid discharge head includes a driving element that drives based on a driving signal to discharge the liquid from the nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit. The liquid discharge head control circuit includes a conversion circuit that converts a base diagnosis signal being a base of the first diagnosis signal into the pair of first differential signals, a first wiring which is electrically coupled to the first terminal and is used for propagating a first reference voltage signal to be supplied to the driving signal selection circuit, a second wiring which is electrically coupled to the second terminal and is used for propagating a second reference voltage signal to be supplied to the restoration circuit, a third wiring which is electrically coupled to the third terminal and is used for propagating the second reference voltage signal to be supplied to the restoration circuit, a fourth wiring which is electrically coupled to the fourth terminal and is used for propagating one signal of the pair of first differential signals, a fifth wiring which is electrically coupled to the fifth terminal and is used for propagating the other signal of the pair of first differential signals, and a driving signal output circuit that outputs the driving signal. The fourth wiring and the fifth wiring are arranged side by side. In a direction intersecting with a direction in which the fourth wiring and the fifth wiring are arranged, the second wiring is located to overlap the fourth wiring, and the third wiring is located to overlap the fifth wiring.

In the liquid discharge head control circuit, the conversion circuit may convert a base clock signal being a base of a clock signal into a pair of second differential signals, the fourth wiring may be also used as a wiring for propagating one signal of the pair of second differential signals, and the fifth wiring may be also used as a wiring for propagating the other signal of the pair of second differential signals.

In the liquid discharge head control circuit, the conversion circuit may convert a base print data signal being a base of a print data signal for defining a waveform selection of the driving signal into a pair of third differential signals, the fourth wiring may be also used as a wiring for propagating one signal of the pair of third differential signals, and the fifth wiring may be also used as a wiring for propagating the other signal of the pair of third differential signals.

In the liquid discharge head control circuit, the diagnostic circuit may perform the self-diagnosis based on a third diagnosis signal and a fourth diagnosis signal in addition to the first diagnosis signal and the second diagnosis signal.

In the liquid discharge head control circuit, the liquid discharge head may further include a sixth terminal electrically coupled to the driving signal selection circuit, and a seventh terminal electrically coupled to the restoration circuit. The liquid discharge head control circuit may further include a sixth wiring which is electrically coupled to the sixth terminal and is used for propagating the first reference voltage signal to be supplied to the driving signal selection circuit, and a seventh wiring which is electrically coupled to the seventh terminal and is used for propagating the third diagnosis signal. In a direction in which the fourth wiring and the fifth wiring are arranged, the seventh wiring may be located to be adjacent to the first wiring and the sixth wiring.

According to still another aspect of the present disclosure, a liquid discharge head includes a driving element that drives based on a driving signal to discharge a liquid from a nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit. A first reference voltage signal to be supplied to the driving signal selection circuit is input to the first terminal. A second reference voltage signal to be supplied to the restoration circuit is input to the second terminal. The second reference voltage signal to be supplied to the restoration circuit is input to the third terminal. One signal of the pair of first differential signals to be supplied to the restoration circuit is input to the fourth terminal. The other signal of the pair of first differential signals to be supplied to the restoration circuit is input to the fifth terminal. The fourth terminal and the fifth terminal are arranged side by side. In a direction in which the fourth terminal and the fifth terminal are arranged, the fourth terminal and the second terminal are located to be adjacent to each other, the fifth terminal and the third terminal are located to be adjacent to each other, and the fourth terminal and the fifth terminal are located between the second terminal and the third terminal.

According to still another aspect of the present disclosure, a liquid discharge head includes a driving element that drives based on a driving signal to discharge a liquid from a nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit. A first reference voltage signal to be supplied to the driving signal selection circuit is input to the first terminal. A second reference voltage signal to be supplied to the restoration circuit is input to the second terminal. The second reference voltage signal to be supplied to the restoration circuit is input to the third terminal. One signal of the pair of first differential signals to be supplied to the restoration circuit is input to the fourth terminal. The other signal of the pair of first differential signals to be supplied to the restoration circuit is input to the fifth terminal. The fourth terminal and the fifth terminal are arranged side by side. In a direction intersecting with a direction in which the fourth terminal and the fifth terminal are arranged, the second terminal is located to overlap the fourth terminal, and the third terminal is located to overlap the fifth terminal.

In the liquid discharge head, the restoration circuit may restore a pair of second differential signals to a clock signal. The fourth terminal may be also used as a terminal to which one signal of the pair of second differential signals is supplied. The fifth terminal may be also used as a terminal to which the other signal of the pair of second differential signals is supplied.

In the liquid discharge head, the restoration circuit may restore a pair of third differential signals to a print data signal for defining a waveform selection of the driving signal. The fourth terminal may be also used as a terminal to which one signal of the pair of third differential signals is supplied. The fifth terminal may be also used as a terminal to which the other signal of the pair of third differential signals is supplied.

In the liquid discharge head, the diagnostic circuit may perform the self-diagnosis based on a third diagnosis signal and a fourth diagnosis signal in addition to the first diagnosis signal and the second diagnosis signal.

The liquid discharge head in the aspect may further include a sixth terminal electrically coupled to the driving signal selection circuit, and a seventh terminal electrically coupled to the restoration circuit. The first reference voltage signal to be supplied to the driving signal selection circuit may be input to the sixth terminal. The third diagnosis signal may be input to the seventh terminal. In a direction in which the fourth terminal and the fifth terminal are arranged, the seventh terminal may be located to be adjacent to the first terminal and the sixth terminal.

According to still another aspect of the present disclosure, a liquid discharge apparatus includes a liquid discharge head that discharges a liquid from a nozzle, and a liquid discharge head control circuit that controls an operation of the liquid discharge head. The liquid discharge head includes a driving element that drives based on a driving signal to discharge the liquid from the nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit. The liquid discharge head control circuit includes a conversion circuit that converts a base diagnosis signal being a base of the first diagnosis signal into the pair of first differential signals, a first wiring which is electrically coupled to the first terminal and is used for propagating a first reference voltage signal to be supplied to the driving signal selection circuit, a second wiring which is electrically coupled to the second terminal and is used for propagating a second reference voltage signal to be supplied to the restoration circuit, a third wiring which is electrically coupled to the third terminal and is used for propagating the second reference voltage signal to be supplied to the restoration circuit, a fourth wiring for propagating one signal of the pair of first differential signals, a fifth wiring for propagating the other signal of the pair of first differential signals, and a driving signal output circuit that outputs the driving signal. The first wiring and the first terminal are electrically in contact with each other at a first contact portion. The second wiring and the second terminal are electrically in contact with each other at a second contact portion. The third wiring and the third terminal are electrically in contact with each other at a third contact portion. The fourth wiring and the fourth terminal are electrically in contact with each other at a fourth contact portion. The fifth wiring and the fifth terminal are electrically in contact with each other at a fifth contact portion. The fourth contact portion and the fifth contact portion are disposed to be arranged. In a direction in which the fourth contact portion and the fifth contact portion are arranged, the second contact portion is located to be adjacent to the fourth contact portion, the third contact portion is located to be adjacent to the fifth contact portion, and the fourth contact portion and the fifth contact portion are located between the second contact portion and the third contact portion.

According to still another aspect of the present disclosure, a liquid discharge apparatus includes a liquid discharge head that discharges a liquid from a nozzle, and a liquid discharge head control circuit that controls an operation of the liquid discharge head. The liquid discharge head includes a driving element that drives based on a driving signal to discharge the liquid from the nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit. The liquid discharge head control circuit includes a conversion circuit that converts a base diagnosis signal being a base of the first diagnosis signal into the pair of first differential signals, a first wiring which is electrically coupled to the first terminal and is used for propagating a first reference voltage signal to be supplied to the driving signal selection circuit, a second wiring which is electrically coupled to the second terminal and is used for propagating a second reference voltage signal to be supplied to the restoration circuit, a third wiring which is electrically coupled to the third terminal and is used for propagating the second reference voltage signal to be supplied to the restoration circuit, a fourth wiring for propagating one signal of the pair of first differential signals, a fifth wiring for propagating the other signal of the pair of first differential signals, and a driving signal output circuit that outputs the driving signal. The first wiring and the first terminal are electrically in contact with each other at a first contact portion. The second wiring and the second terminal are electrically in contact with each other at a second contact portion. The third wiring and the third terminal are electrically in contact with each other at a third contact portion. The fourth wiring and the fourth terminal are electrically in contact with each other at a fourth contact portion. The fifth wiring and the fifth terminal are electrically in contact with each other at a fifth contact portion. The fourth contact portion and the fifth contact portion are disposed to be arranged. In a direction intersecting with a direction in which the fourth contact portion and the fifth contact portion are arranged, the second contact portion is located to overlap the fourth contact portion, and the third contact portion is located to overlap the fifth contact portion.

In the liquid discharge apparatus, the conversion circuit may convert a base clock signal being a base of a clock signal into a pair of second differential signals, the fourth wiring may be also used as a wiring for propagating one signal of the pair of second differential signals, and the fifth wiring may be also used as a wiring for propagating the other signal of the pair of second differential signals.

In the liquid discharge apparatus, the conversion circuit may convert a base print data signal being a base of a print data signal for defining a waveform selection of the driving signal into a pair of third differential signals, the fourth wiring may be also used as a wiring for propagating one signal of the pair of third differential signals, and the fifth wiring may be also used as a wiring for propagating the other signal of the pair of third differential signals.

In the liquid discharge apparatus, the diagnostic circuit may perform the self-diagnosis based on a third diagnosis signal and a fourth diagnosis signal in addition to the first diagnosis signal and the second diagnosis signal.

In the liquid discharge apparatus, the liquid discharge head may further include a sixth terminal electrically coupled to the driving signal selection circuit, and a seventh terminal electrically coupled to the restoration circuit. The liquid discharge head control circuit may further include a sixth wiring which is electrically coupled to the sixth terminal and is used for propagating the first reference voltage signal to be supplied to the driving signal selection circuit, and a seventh wiring which is electrically coupled to the seventh terminal and is used for propagating the third diagnosis signal. The sixth wiring and the sixth terminal may be electrically in contact with each other at a sixth contact portion. The seventh wiring and the seventh terminal may be electrically in contact with each other at a seventh contact portion. In a direction in which the fourth contact portion and the fifth contact portion are arranged, the seventh contact portion may be located to be adjacent to the first contact portion and the sixth contact portion.

BRIEF DESCRIPTION OF THE DRAWINGS

FIG. 17 is a diagram illustrating details of a signal which is propagated in a cable 19*a* and is input to a liquid discharge head through a connector 350*a*.

FIG. 18 is a diagram illustrating details of a signal which is propagated in a cable 19*b* and is input to the liquid discharge head through a connector 350*b*.

FIG. 19 is a diagram illustrating details of a signal which is propagated in a cable 19*c* and is input to the liquid discharge head through a connector 350*c*.

FIG. 20 is a diagram illustrating details of a signal which is propagated in a cable 19*d* and is input to the liquid discharge head through a connector 350*d*.

FIG. 21 is a diagram illustrating details of a signal which is propagated in a cable 19*e* and is input to the liquid discharge head through a connector 350*e*.

FIG. 22 is a diagram illustrating details of a signal which is propagated in a cable 19*f* and is input to the liquid discharge head through a connector 350*f*.

FIG. 23 is a diagram illustrating details of a signal which is propagated in a cable 19*g* and is input to the liquid discharge head through a connector 350*g*.

FIG. 24 is a diagram illustrating details of a signal which is propagated in a cable 19*h* and is input to the liquid discharge head through a connector 350*h*.

FIG. 25 is a diagram illustrating details of a signal which is propagated in a cable 19*b* and is input to a liquid discharge head through a connector 350*b* according to a second embodiment.

FIG. 26 is a diagram illustrating details of a signal which is propagated in a cable 19*a* and is input to a liquid discharge head through a connector 350*a* according to a third embodiment.

FIG. 27 is a diagram illustrating details of a signal which is propagated in a cable 19*b* and is input to the liquid discharge head through a connector 350*b* in the third embodiment.

DESCRIPTION OF EXEMPLARY EMBODIMENTS

Hereinafter, preferred embodiments of the present disclosure will be described with reference to the drawings. The drawings are used for easy descriptions. The embodiments described below do not limit the scope of the present disclosure described in the claims. All components described later are not necessarily essential constituent elements of the present disclosure.

1. First Embodiment

1.1. Outline of Liquid Discharge Apparatus

Figure 1:
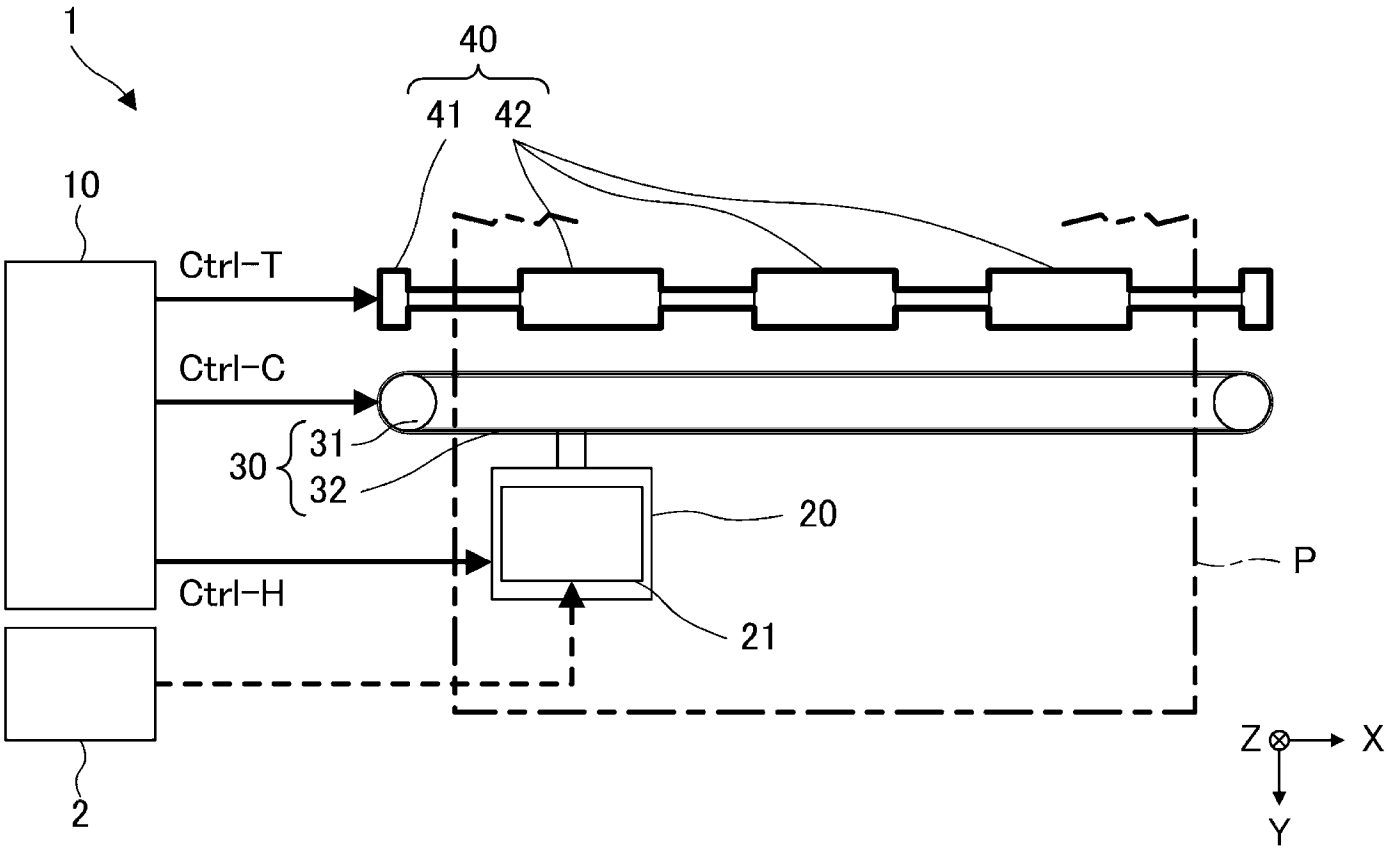
FIG. 1 is a diagram illustrating an overall configuration of a liquid discharge apparatus.

FIG. 1 is a diagram illustrating an overall configuration of a liquid discharge apparatus 1. The liquid discharge apparatus 1 is a serial printing type ink jet printer that forms an image on a medium P in a manner that a carriage 20 discharges an ink to the transported medium P with reciprocating. In the carriage 20, a liquid discharge head 21 that discharges the ink as an example of a liquid is mounted. In the following descriptions, descriptions will be made on the assumption that a direction in which the carriage 20 moves is an X-direction, a direction in which the medium P is transported is a Y-direction, and a direction in which the ink is discharged is a Z-direction. Descriptions will be made on the assumption that the X-direction, the Y-direction, and the Z-direction are perpendicular to each other. As the medium P, any printing target such as print paper, a resin film, and a cloth can be used.

The liquid discharge apparatus 1 includes a liquid container 2, a control mechanism 10, the carriage 20, a movement mechanism 30, and a transport mechanism 40.

Plural kinds of inks to be discharged onto a medium P are stored in the liquid container 2. As the color of the ink stored in the liquid container 2, black, cyan, magenta, yellow, red, and gray, and the like are exemplified. As the liquid container 2 in which such an ink is stored, an ink cartridge, a bag-like ink pack formed of a flexible film, an ink tank capable of replenishing an ink, or the like is used.

The control mechanism 10 includes, for example, a processing circuit such as a central processing unit (CPU) or a field programmable gate array (FPGA) and a storage circuit such as a semiconductor memory. The control mechanism 10 controls elements of the liquid discharge apparatus 1. Specifically, the control mechanism 10 generates control signals Ctrl-H, Ctrl-C, and Ctrl-T and outputs the control signals to various components of the liquid discharge apparatus 1.

The liquid discharge head 21 is mounted in the carriage 20. The control signal Ctrl-H including a plurality of signals is input to the liquid discharge head 21. The liquid discharge head 21 discharges an ink supplied from the liquid container 2, based on the control signal Ctrl-H. The liquid container 2 may be mounted in the carriage 20.

The movement mechanism 30 includes a carriage motor 31 and an endless belt 32. A signal based on the control signal Ctrl-C is input to the carriage motor 31. The carriage motor 31 operates based on the control signal Ctrl-C. The carriage 20 is fixed to the endless belt 32. The endless belt 32 rotates by an operation of the carriage motor 31. Thus, the carriage 20 fixed to the endless belt 32 reciprocates in the X-direction. The control signal Ctrl-C may be converted into a signal having a more suitable format in order to operate the carriage motor 31 in a carriage motor driver (not illustrated).

The transport mechanism 40 includes a transport motor 41 and a transport roller 42. A signal based on the control signal Ctrl-T is input to the transport motor 41. The transport motor 41 operates based on the control signal Ctrl-T. The transport roller 42 rotates by an operation of the transport motor 41. A medium P is transported in the Y-direction with the rotation of the transport roller 42. The control signal Ctrl-T may be converted into a signal having a more suitable format in order to operate the transport motor 41 in a transport motor driver (not illustrated).

As described above, the liquid discharge apparatus 1 discharges an ink from the liquid discharge head 21 mounted in the carriage 20 with transport of the medium P by the transport mechanism 40 and reciprocation of the carriage 20 by the movement mechanism 30. Thus, the liquid discharge apparatus 1 forms a desired image on the medium P.

1.2. Electrical Configuration of Liquid Discharge Apparatus

Figure 2:
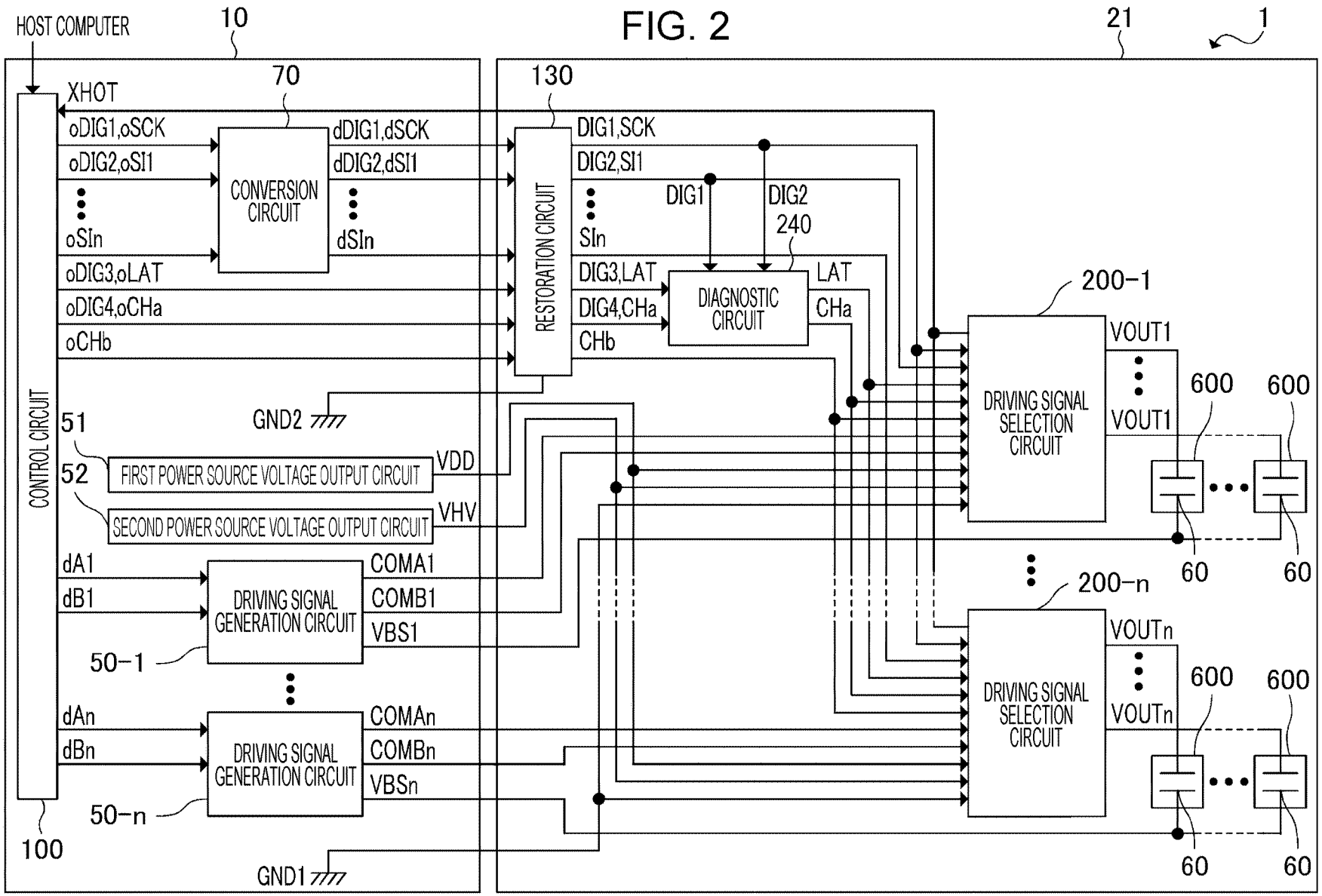
FIG. 2 is a block diagram illustrating an electrical configuration of the liquid discharge apparatus.

FIG. 2 is a block diagram illustrating an electrical configuration of the liquid discharge apparatus 1. The liquid discharge apparatus 1 includes the control mechanism 10 and the liquid discharge head 21. Descriptions will be made on the assumption that the liquid discharge head 21 in FIG. 2 includes n driving signal selection circuits 200.

The control mechanism 10 includes a conversion circuit 70, driving signal output circuits 50-1 to **50-*n*, a first power source voltage output circuit 51, a second power source voltage output circuit 52, and a control circuit 100. The control circuit 100 includes a processor such as a microcontroller, for example. The control circuit 100 generates and outputs data or various signals for controlling the liquid discharge apparatus 1**, based on various signals such as image data, which are input from a host computer.

Specifically, the control circuit 100 generates and outputs base diagnosis signals oDIG1 to oDIG4, a base clock signal oSCK, base print data signals oSI1 to oSIn, a base latch signal oLAT, base change signals oCHa and oCHb, and base driving signals dA1 to dAn and dB1 to dBn, which are used for controlling the liquid discharge apparatus 1.

The base diagnosis signals oDIG1 to oDIG4 are signals being bases of four diagnosis signals DIG1 to DIG4 used when the liquid discharge head 21 diagnoses whether or not normal discharge of a liquid is possible. Each of the base diagnosis signals oDIG1 and oDIG2 is input to the conversion circuit 70. Each of the base diagnosis signals oDIG3 and oDIG4 is input to the liquid discharge head 21. That is, the control circuit 100 functions as a base diagnosis signal output circuit that generates and outputs the base diagnosis signals oDIG1 to oDIG4 being the bases of the diagnosis signals DIG1 to DIG4 used for self-diagnosis of the liquid discharge head 21.

The base clock signal oSCK, the base print data signals oSI1 to oSIn, the base latch signal oLAT, and the base change signals oCHa and oCHb are signals being bases of a clock signal SCK, print data signals SI1 to SIn, a latch signal LAT, and change signals CHa and CHb which are for controlling an operation of the liquid discharge head 21. The base clock signal oSCK and each of the base print data signals oSI1 to oSIn are input to the conversion circuit 70. The base latch signal oLAT and each of the base change signals oCHa and oCHb are input to the liquid discharge head 21.

The conversion circuit 70 converts the input base diagnosis signals oDIG1 and oDIG2, the base clock signal oSCK, and the base print data signals oSI1 to oSIn into pairs of differential signals. Specifically, the conversion circuit 70 converts each of the base diagnosis signals oDIG1 and oDIG2 into a pair of differential diagnosis signals dDIG1 and dDIG2. The conversion circuit 70 converts the base clock signal oSCK into a pair of differential clock signals dSCK. The conversion circuit 70 converts each of the base print data signal oSI1 to oSIn into a pair of differential print data signals dSI1 to dSIn. The conversion circuit 70 outputs the differential diagnosis signals dDIG1 and dDIG2, the differential clock signal dSCK, and each of the differential print data signals dSI1 to dSIn to the liquid discharge head 21. Here, the base diagnosis signal oDIG1 is an example of a base diagnosis signal. The pair of differential diagnosis signals dDIG1 is an example of a first differential signal. The pair of differential clock signals dSCK is an example of a pair of second differential signals. The base print data signal oSI is an example of a base print data signal. The pair of differential print data signals dSI1 is an example of a third differential signal. The diagnosis signal DIG1 is an example of a first diagnosis signal. The diagnosis signal DIG2 is an example of a second diagnosis signal. The diagnosis signal DIG3 is an example of a third diagnosis signal. The diagnosis signal DIG4 is an example of a fourth diagnosis signal.

Here, the conversion circuit 70 performs conversion into a differential signal of a low voltage differential signaling (LVDS) transfer method, for example. A differential signal of the LVDS transfer method has an amplitude of substantially 350 mV, and thus can realize high-speed data transfer. The conversion circuit 70 may perform conversion into a differential signal of various high-speed transfer method such as a low voltage positive emitter coupled logic (LVPECL) transfer method or a current mode logic (CIVIL) transfer method in addition to the LVDS transfer method.

In this embodiment, in the liquid discharge apparatus 1, each of the base diagnosis signals oDIG1 to oDIG4 and each of the base clock signal oSCK, the base print data signal oSI1, the base latch signal oLAT, and the base change signal oCHa are propagated in a common wiring. Specifically, the base diagnosis signal oDIG1 and the base clock signal oSCK are propagated in a common wiring. The base diagnosis signal oDIG2 and the base print data signal oSI are propagated in a common wiring. The base diagnosis signal oDIG3 and the base latch signal oLAT are propagated in a common wiring. The base diagnosis signal oDIG4 and the base change signal oCHa are propagated in a common wiring. Each of the differential diagnosis signals dDIG1 and dDIG2 and each of the differential clock signal dSCK and the differential print data signal dSI1 are propagated in a common wiring. Specifically, the differential diagnosis signal dDIG1 and the differential clock signal dSCK are propagated in a common wiring, and the differential diagnosis signal dDIG2 and the differential print data signal dSI1 are propagated in a common wiring.

The base driving signals dA1 to dAn and dB1 to dBn are digital signals and signals being bases of driving signals COMA1 to COMAn and COMB1 to COMBn for driving a piezoelectric element 60 as an example of a driving element provided in the liquid discharge head 21. The base driving signals dA1 to dAn and dB1 to dBn are input to the corresponding driving signal output circuits 50-1 to **50-*n*. The following descriptions will be made on the assumption that the base driving signals dAi and dBi (i is any of 1 to n) are input to the corresponding driving signal output circuit 50-*i***.

The driving signal output circuit **50-*i* generates the driving signal COMAi by performing D-class amplification on an analog signal obtained by performing digital-to-analog signal conversion on the input base driving signal dAi. The driving signal output circuit 50-*i* generates the driving signal COMBi by performing D-class amplification on an analog signal obtained by performing digital-to-analog signal conversion on the input base driving signal dBi. That is, the driving signal output circuit 50-*i* includes two D-class amplifier circuits which are a D-class amplifier circuit that generates the driving signal COMAi based on the base driving signal dAi and a D-class amplifier circuit that generates the driving signal COMBi based on the base driving signal dBi. The base driving signals dAi and dBi may be signals capable of defining waveforms of the driving signals COMAi and COMBi and may be analog signals. The two D-class amplifier circuit in the driving signal output circuit 50-*i*** may be capable of amplifying the waveform defined by the base driving signals dAi and dBi, and may be configured with an A-class amplifier circuit, a B-class amplifier circuit, or an AB-class amplifier circuit.

The driving signal output circuit **50*i*** generates and outputs a voltage VBSi indicating a reference potential of the driving signals COMAi and COMBi. For example, the voltage VBS may be a signal having a ground potential in which a voltage value is 0 V, or may be a signal having a DC voltage in which a voltage value is 6 V, or the like.

The driving signal output circuit 50-*i* outputs the driving signals COMAi and COMBi and the voltage VBS which are generated, to the liquid discharge head 21. Here, all of the driving signal output circuits 50-1 to 50-*n* have the similar configuration, and thus may be referred to as a driving signal output circuit 50 in the following descriptions. Descriptions may be made on the assumption that the base driving signals dA and dB are input to the driving signal output circuit 50, and the driving signal output circuit 50 generates the driving signals COMA and COMB and the voltage VBS. Here, at least one of the driving signals COMA and COMB is an example of the driving signal.

The control circuit 100 outputs the control signal Ctrl-C for controlling reciprocation of the carriage 20 (in which the liquid discharge head 21 is mounted) to the movement mechanism 30 illustrated in FIG. 1. The control circuit 100 generates and outputs the control signal Ctrl-T for controlling transport of the medium P to the transport mechanism 40 illustrated in FIG. 1.

The first power source voltage output circuit 51 generates a voltage VDD. The voltage VDD is a power source voltage of various components of the control mechanism 10 and the liquid discharge head 21. The first power source voltage output circuit 51 may generate voltage VDD having a plurality of voltage values suitable for the various components of the control mechanism 10 and the liquid discharge head 21. The first power source voltage output circuit 51 outputs the voltage VDD to the liquid discharge head 21.

The second power source voltage output circuit 52 generates a voltage VHV. The voltage VHV is a signal having a voltage value larger than the voltage VDD and is a base of a voltage to be amplified by the two D-class amplifier circuit in each of the driving signal output circuits 50-1 to 50-*n*. The voltage VHV is also input to the driving signal selection circuits 200-1 to 200-*n* in the liquid discharge head 21. That is, the second power source voltage output circuit 52 also outputs the voltage VHV to the liquid discharge head 21.

As described above, the control mechanism 10 outputs the above-described various signals and voltages to the liquid discharge head 21 as the control signal Ctrl-H for controlling the operation of the liquid discharge head 21. The control mechanism 10 outputs ground signals GND1 and GND2 for defining a ground potential of the liquid discharge head 21 to the liquid discharge head 21.

The liquid discharge head 21 includes a restoration circuit 130, the driving signal selection circuits 200-1 to 200-*n*, the diagnostic circuit 240, and a plurality of discharge sections 600.

The differential diagnosis signals dDIG1 and dDIG2, the differential clock signal dSCK, the differential print data signals dSI1 to dSIn, the base diagnosis signals oDIG3 and oDIG4, the base latch signal oLAT, and the base change signals oCHa and oCHb are input to the restoration circuit 130. The restoration circuit 130 restores the differential signal to a single-ended signal based on the input various signals.

Specifically, the restoration circuit 130 restores the differential diagnosis signals dDIG1 and dDIG2, the differential clock signal dSCK, and the differential print data signals dSI1 to dSIn to single-ended signals based on the input base latch signal oLAT and a timing defined by the base change signals oCHa and oCHb. In other words, the restoration circuit 130 restores the pair of differential diagnosis signals dDIG1 to the diagnosis signal DIG1. Thus, the differential diagnosis signals dDIG1 and dDIG2 are restored to the diagnosis signals DIG1 and DIG2 being single-ended signals. The differential clock signal dSCK is restored to the clock signal SCK being a single-ended signal. The differential print data signals dSI1 to dSIn are restored to the print data signals SI1 to SIn being single-ended signals. The restoration circuit 130 outputs the diagnosis signals DIG1 and DIG2, the clock signal SCK, and the print data signals SI1 to SIn being the restored single-ended signals.

The base latch signal oLAT and the base change signals oCHa and oCHb input to the restoration circuit 130 are used for defining a timing for restoring the pair of differential signals to a single-ended signal, and then are output from the restoration circuit 130 as the latch signal LAT and the change signals CHa and CHb. Here, in a case where delay occurring in the restoration circuit 130 is not added, the base latch signal oLAT and the base change signals oCHa and oCHb input to the restoration circuit 130 may have the same waveforms as the waveforms of the latch signal LAT and the change signals CHa and CHb output from the restoration circuit 130. Similar to the base diagnosis signal oDIG3 propagated together with the base latch signal oLAT in the common wiring and the base diagnosis signal oDIG4 propagated together with the base change signal oCHa in the common wiring, the base diagnosis signals oDIG3 and oDIG4 input to the restoration circuit 130 and the diagnosis signals DIG3 and DIG4 output from the restoration circuit 130 may have the same waveform in a case where delay occurring in the restoration circuit 130 is not added.

As described above, in the restoration circuit 130, if the single-ended signal for controlling the liquid discharge apparatus 1 is input to the restoration circuit 130 in addition to the differential signal being a signal as a restoration target, it is possible to reduce a signal delay between a single-ended signal restored by the restoration circuit 130 and a single-ended signal which is not restored by the restoration circuit 130. Thus, a concern of an occurrence of a signal delay caused by an operation of the restoration circuit 130 between the diagnosis signals DIG1 and DIG2 input from the control mechanism 10 as the differential signals and the diagnosis signals DIG3 and DIG4 input from the control mechanism 10 as the single-ended signals is reduced. Similarly, a concern of an occurrence of a signal delay caused by an operation of the restoration circuit 130 between the clock signal SCK and the print data signals SI1 to SIn input from the control mechanism 10 as the differential signals, and the latch signal LAT and the change signals CHa and CHb input from the control mechanism 10 as the single-ended signals is reduced.

The diagnostic circuit 240 performs self-diagnosis of diagnosing whether or not normal discharge of the ink in the liquid discharge head 21 is possible, based on the diagnosis signals DIG1 to DIG4 input from the restoration circuit 130. For example, the diagnostic circuit 240 detects whether a plurality of signals or all signals among the input diagnosis signals DIG1 to DIG4 have normal voltage values, and performs diagnosis of whether or not the liquid discharge head 21 and the control mechanism 10 are normally coupled to each other. The diagnostic circuit 240 may operate any components in the liquid discharge head 21 in accordance with a combination of the logical levels of a plurality of signals or all the signals of the diagnosis signals DIG1 to DIG4 to be input. The diagnostic circuit 240 may diagnose whether or not the liquid discharge head 21 is capable of a normal operation, by detecting the voltage or the signal based on the operation. That is, the liquid discharge head 21 performs self-diagnosis of diagnosing whether or not normal discharge of the ink is possible, based on the diagnosis result of the diagnostic circuit 240. The diagnostic circuit 240 may perform self-diagnosis based on the diagnosis signal DIG1 and the diagnosis signal DIG2. As described in this embodiment, the diagnostic circuit 240 may perform self-diagnosis based on the diagnosis signal DIG3 and the diagnosis signal DIG4 in addition to the diagnosis signal DIG1 and the diagnosis signal DIG2.

In the embodiment, when the diagnostic circuit 240 diagnoses that normal discharge of an ink is possible in the liquid discharge head 21, the diagnostic circuit 240 outputs the latch signal LAT (propagated together with the diagnosis signal DIG3 in the common wiring) and the change signal CHa (propagated together with the diagnosis signal DIG4 in the common wiring). When the diagnostic circuit 240 diagnoses that normal discharge of an ink is not possible in the liquid discharge head 21, the diagnostic circuit 240 stops the output of the latch signal LAT propagated together with the diagnosis signal DIG3 in the common wiring and the change signal CHa propagated together with the diagnosis signal DIG4 in the common wiring. The self-diagnosis is performed based on the diagnosis signal DIG3 and the diagnosis signal DIG4 in addition to the diagnosis signal DIG1 and the diagnosis signal DIG2. Thus, when it is diagnosed that the normal discharge of the ink is not possible in the liquid discharge head 21, the output of the latch signal LAT and the change signal CHa which are commonly supplied to the driving signal selection circuits 200-1 to **200-*n* may be stopped. Thus, it is possible to stop an ink discharge operation in the liquid discharge head 21. That is, it is possible to reduce a concern of performing a wasteful printing operation. A plurality of diagnostic circuits 240 may be provided to corresponding to the driving signal selection circuits 200-1 to 200-*n***, respectively.

Here, as illustrated in FIG. 2, the diagnosis signal DIG1 and the diagnosis signal DIG2 are branched in the liquid discharge head 21. One branched signal is input to the diagnostic circuit 240, and the other is input to the driving signal selection circuit 200-1. The clock signal SCK propagated together with the diagnosis signal DIG1 in the common wiring and the print data signal SI1 propagated together with the diagnosis signal DIG2 in the common wiring have a transfer rate higher than that of the latch signal LAT and the change signal CH. Therefore, if the waveforms of the print data signal SD and the clock signal SCK are distorted, stability in operation of the liquid discharge apparatus 1 may be reduced. Since the print data signal SD and the clock signal SCK are input to the driving signal selection circuit 200-1 without passing through the diagnostic circuit 240, it is possible to reduce a concern that the waveforms of the clock signal SCK and the print data signal SI1 are distorted.

The voltages VHV and VDD, the clock signal SCK, the latch signal LAT, the change signals CHa and CHb, and the ground signal GND1 are commonly input to each of the driving signal selection circuits 200-1 to **200-*n*. The driving signals COMA1 to COMAn and COMB1 to COMBn and the print data signals SD to SIn are input to the driving signal selection circuits 200-1 to 200-*n*, respectively. The driving signal selection circuits 200-1 to 200-*n* select or do not select the corresponding driving signals COMA1 to COMAn and COMB1 to COMBn so as to generate driving signals VOUT1 to VOUTn and supply the driving signals VOUT1 to VOUTn to one end of the piezoelectric element 60 in the plurality of corresponding discharge sections 600. In other words, the driving signal selection circuits 200-1 to 200-*n* control the supply of the driving signals COMA1 to COMAn and COMB1 to COMBn to the piezoelectric element 60, respectively. In this case, voltages VBS1 to VBSn are supplied to the other end of the piezoelectric element 60. The piezoelectric element 60 performs displacement based on the driving signals VOUT1 to VOUTn and the voltages VBS1 to VBSn, and thus an ink having an amount depending on the displacement is discharged from the discharge section 600. That is, the piezoelectric element 60** drives based on the driving signals COMA and COMB to discharge a liquid from the nozzle.

Here, all of the driving signal selection circuits 200-1 to **200-*n* have the similar configuration, and thus may be referred to as a driving signal selection circuit 200 in the following descriptions. Descriptions may be made on the assumption that the driving signal selection circuit 200** selects or does not select the driving signals COMA and COMB to generate the driving signal VOUT.

Each of the restoration circuit 130, the diagnostic circuit 240, and the driving signal selection circuit 200 in the liquid discharge head 21 may be configured by one or a plurality of integrated circuits (ICs). The restoration circuit 130 and the diagnostic circuit 240 may be configured in one integrated circuit. The diagnostic circuit 240 and the driving signal selection circuit 200 may be configured in one integrated circuit. The restoration circuit 130, the diagnostic circuit 240, and the driving signal selection circuit 200 may be configured in one integrated circuit.

1.3. Example of Waveform of Driving Signal

Here, an example of the waveforms of the driving signals COMA and COMB generated by the driving signal output circuit 50 and an example of the waveform of the driving signal VOUT supplied to the piezoelectric element 60 will be described with reference to FIGS. 3 and 4.

Figure 3:
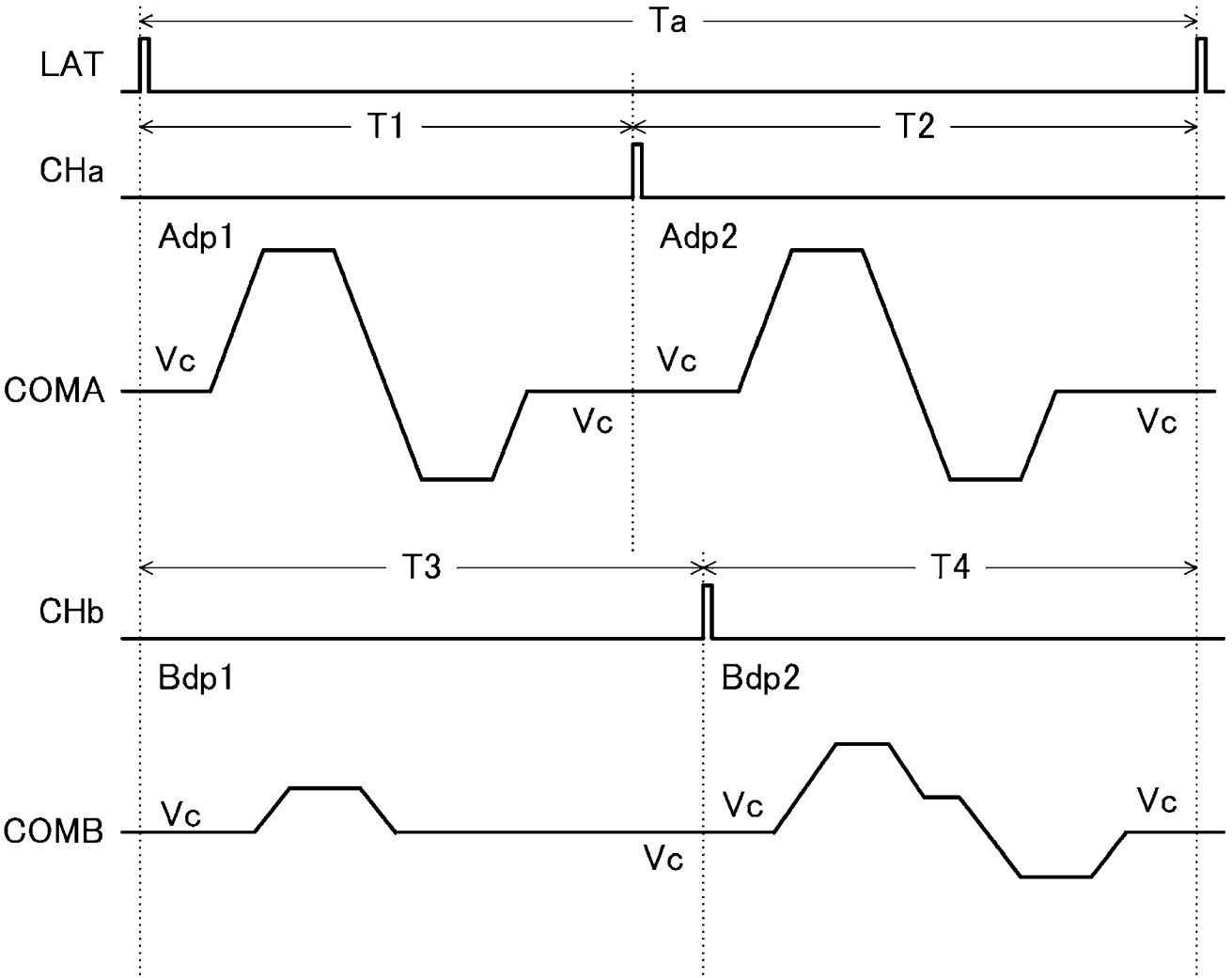
FIG. 3 is a diagram illustrating an example of driving signals COMA and COMB.

FIG. 3 is a diagram illustrating an example of the waveforms of the driving signals COMA and COMB. As illustrated in FIG. 3, the driving signal COMA has a waveform in which a trapezoid waveform Adp1 and a trapezoid waveform Adp2 are made continuous. The trapezoid waveform Adp1 is disposed in a period T1 from when the latch signal LAT rises until the change signal CHa rises. The trapezoid waveform Adp2 is disposed in a period T2 from when the change signal CHa rises until the latch signal LAT rises the next time. In the embodiment, the trapezoid waveform Adp1 and the trapezoid waveform Adp2 are substantially the same as each other. When each of the trapezoid waveforms Adp1 and Adp2 is supplied to one end of the piezoelectric element 60, the medium amount of the ink is discharged from the discharge section 600 corresponding to this piezoelectric element 60.

The driving signal COMB has a waveform in which a trapezoid waveform Bdp1 and a trapezoid waveform Bdp2 are made continuous. The trapezoid waveform Bdp1 is disposed in a period T3 from when the latch signal LAT rises until the change signal CHb rises. The trapezoid waveform Bdp2 is disposed in a period T4 from when the change signal CHb rises until the latch signal LAT rises the next time. In the embodiment, the trapezoid waveform Bdp1 and the trapezoid waveform Bdp2 are different from each other. Among the waveforms, the trapezoid waveform Bdp1 is a waveform for finely vibrating the ink in the vicinity of a nozzle opening portion of the discharge section 600 to prevent an increase of ink viscosity. When the trapezoid waveform Bdp1 is supplied to one end of the piezoelectric element 60, the ink is not discharged from the discharge section 600 corresponding to this piezoelectric element 60. The trapezoid waveform Bdp2 is different from the trapezoid waveforms Adp1 and Adp2 and the trapezoid waveform Bdp1. When the trapezoid waveform Bdp2 is supplied to one end of the piezoelectric element 60, an ink having an amount which is smaller than the medium amount is discharged from the discharge section 600 corresponding to this piezoelectric element 60.

As described above, the periods T1 to T4 and a period Ta which are timings for supplying the driving signals COMA and COMB to the piezoelectric element 60 are defined based on the latch signal LAT and the change signals CHa and CHb. Here, all voltages at a start timing and an end timing of each of the trapezoid waveforms Adp1, Adp2, Bdp1, and Bdp2 are common and a voltage Vc. That is, each of the trapezoid waveforms Adp1, Adp2, Bdp1, and Bdp2 is a waveform which starts at the voltage Vc and ends at the voltage Vc. Each of the driving signals COMA and COMB is described to be a signal having a waveform in which two trapezoid waveforms are continuous in the period Ta, but may be a signal having a waveform in which three trapezoid waveforms or more are continuous in the period Ta.

Figure 4:
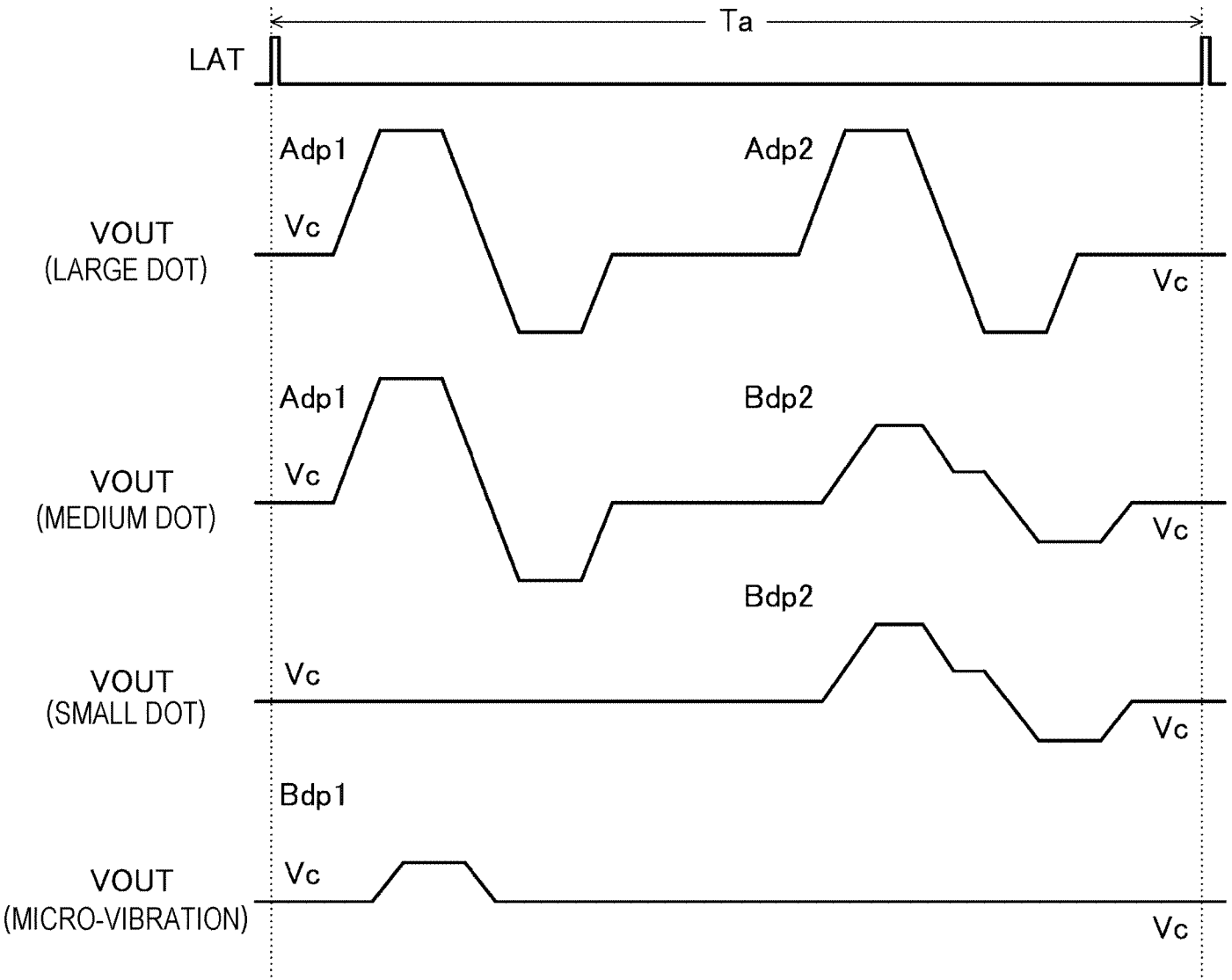
FIG. 4 is a diagram illustrating an example of a driving signal VOUT.

FIG. 4 is a diagram illustrating an example of the waveform of the driving signal VOUT corresponding to each of "a large dot", "a medium dot", "a small dot", and "non-recording". As illustrated in FIG. 4, the driving signal VOUT corresponding to "the large dot" has a waveform in which the trapezoid waveform Adp1 and the trapezoid waveform Adp2 are continuous in the period Ta. When the driving signal VOUT is supplied to the one end of the piezoelectric element 60, the medium amount of the ink is discharged two times from the discharge section 600 corresponding to this piezoelectric element 60, in the period Ta. Thus, the inks are landed on the medium P and are coalesced, and thereby a large dot is formed on the medium P.

The driving signal VOUT corresponding to "the medium dot" has a waveform in which the trapezoid waveform Adp1 and the trapezoid waveform Bdp2 are continuous in the period Ta. When the driving signal VOUT is supplied to the one end of the piezoelectric element 60, the medium amount of the ink and the small amount of the ink are discharged from the discharge section 600 corresponding to this piezoelectric element 60, in the period Ta. Thus, the inks are landed on the medium P and are coalesced, and thereby a medium dot is formed on the medium P.

The driving signal VOUT corresponding to "the small dot" has the trapezoid waveform Bdp2 in the period Ta. When the driving signal VOUT is supplied to the one end of the piezoelectric element 60, the small amount of the ink is discharged from the discharge section 600 corresponding to this piezoelectric element 60, in the period Ta. Thus, the inks are landed on the medium P, and thereby a small dot is formed on the medium P.

The driving signal VOUT corresponding to "non-recording" has the trapezoid waveform Bdp1 in the period Ta. When the driving signal VOUT is supplied to the one end of the piezoelectric element 60, in the period Ta, only the ink in the vicinity of the nozzle opening portion of the discharge section 600 corresponding to this piezoelectric element 60 finely vibrates, and the ink is not discharged. Therefore, the ink is not landed on the medium P, and a dot is not formed on the medium P.

Here, when any of the driving signals COMA and COMB is not selected as the driving signal VOUT, the voltage Vc just before is held at the one end of the piezoelectric element 60 by a capacitive component of the piezoelectric element 60. That is, when neither driving signals COMA nor COMB is selected, the voltage Vc is supplied to the piezoelectric element 60 as the driving signal VOUT.

The driving signals COMA and COMB and the driving signal VOUT illustrated in FIGS. 3 and 4 are just examples. Signals having various combinations of waveforms may be used in accordance with a moving speed of the carriage 20 in which the liquid discharge head 21 is mounted, the physical properties of the ink to be discharged, the material of the medium P, and the like. The driving signal COMA and the driving signal COMB may be signals having a waveform in which the same trapezoid waveforms are continuous. Here, the driving signals COMA and COMB are an example of the driving signal. The driving signal VOUT generated by selecting or not selecting the waveforms of the driving signals COMA and COMB is also an example of the driving signal in a broad sense.

1.4. Driving Signal Selection Circuit

Figure 5:
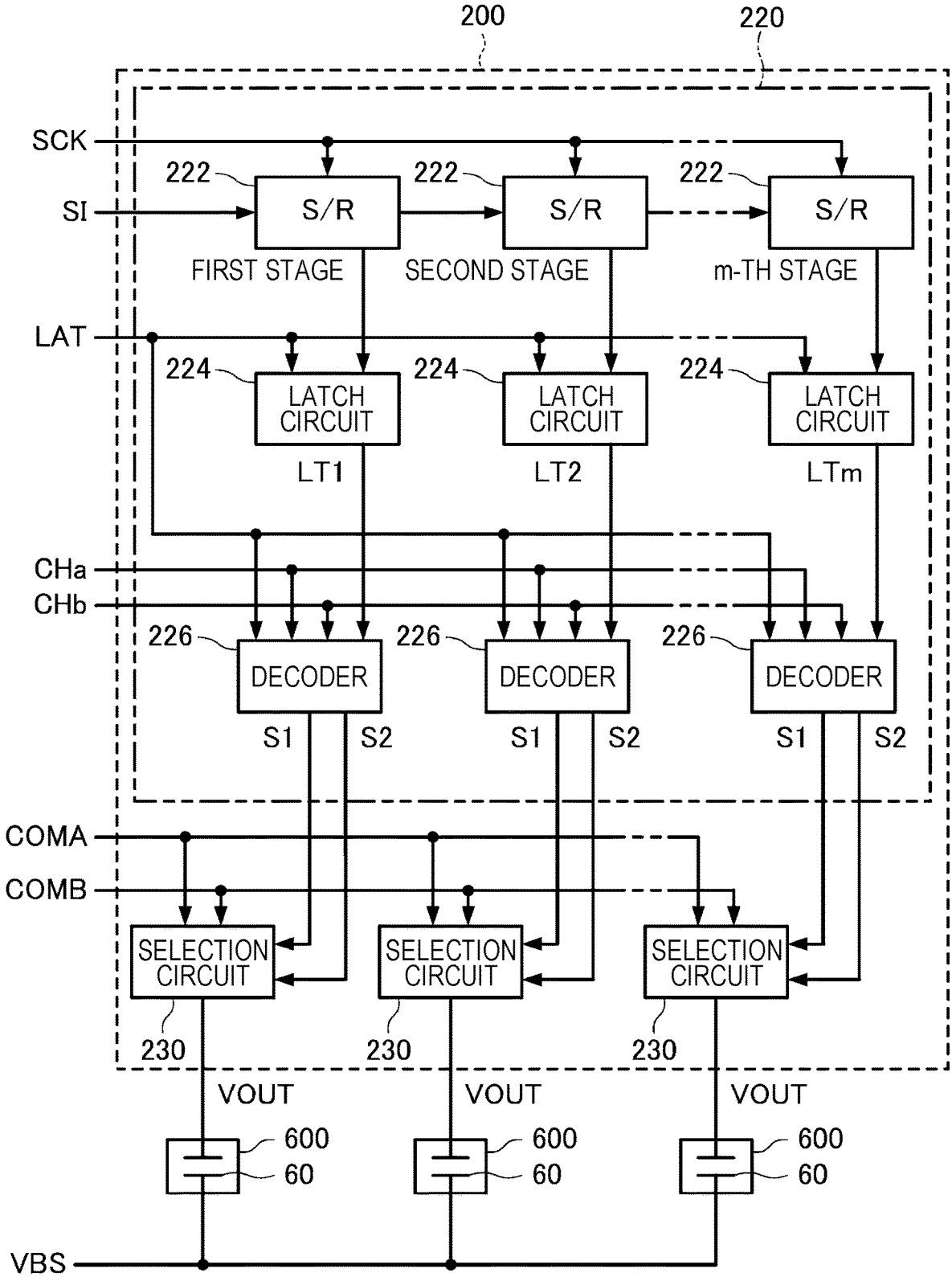
FIG. 5 is a diagram illustrating a configuration of a driving signal selection circuit.

Next, a configuration and an operation of the driving signal selection circuit 200 will be described with reference to FIGS. 5 to 8. FIG. 5 is a diagram illustrating a configuration of the driving signal selection circuit 200. As illustrated in FIG. 5, the driving signal selection circuit 200 includes a selection control circuit 220 and a plurality of selection circuits 230.

The print data signal SI, the latch signal LAT, the change signals CHa and CHb, and the clock signal SCK are input to the selection control circuit 220. A set of a shift register (S/R) 222, a latch circuit 224, and a decoder 226 is provided in the selection control circuit 220 to correspond to each of the plurality of discharge sections 600. That is, the driving signal selection circuit 200 includes sets of shift registers 222, latch circuits 224, and decoders 226. The number of sets is equal to the total number m of the corresponding discharge sections 600.

The print data signal SI is a signal for defining a waveform selection between the driving signal COMA and the driving signal COMB. Specifically, the print data signal SI is a signal synchronized with the clock signal SCK. The print data signal SI is a signal which has 2m bits in total and includes 2-bit print data [SIH, SIL] for selecting any of "the large dot", "the medium dot", "the small dot", and "non-recording" for each of m pieces of discharge sections 600. Regarding the print data signal SI, each 2-bit print data [SIR, SIL] which corresponds to the discharge section 600 and is included in the print data signal SI is held in the shift register 222. In detail, the shift registers 222 from the first stage to the m-th stage, which correspond to the discharge sections 600 are cascade-coupled to each other, and the print data signal SI supplied in a serial manner is sequentially transferred to the subsequent stages in accordance with the clock signal SCK. In FIG. 5, in order to distinguish the shift registers 222 from each other, the shift registers 222 are described as being the first stage, the second stage, . . . , and the m-th stage in order from the upstream on which the print data signal SI is supplied.

Each of the m pieces of latch circuits 224 latches the 2-bit print data [SIH, SIL] held in each of the m pieces of shift registers 222, at a rising edge of the latch signal LAT.

Each of the m pieces of decoders 226 decodes the 2-bit print data [SIH, SIL] latched by each of the m pieces of latch circuits 224. The decoder 226 outputs a selection signal S1 for each of the periods T1 and T2 defined by the latch signal LAT and the change signal CHa, and outputs a selection signal S2 for each of the periods T3 and T4 defined by the latch signal LAT and the change signal CHb.

Figures 6, 7:
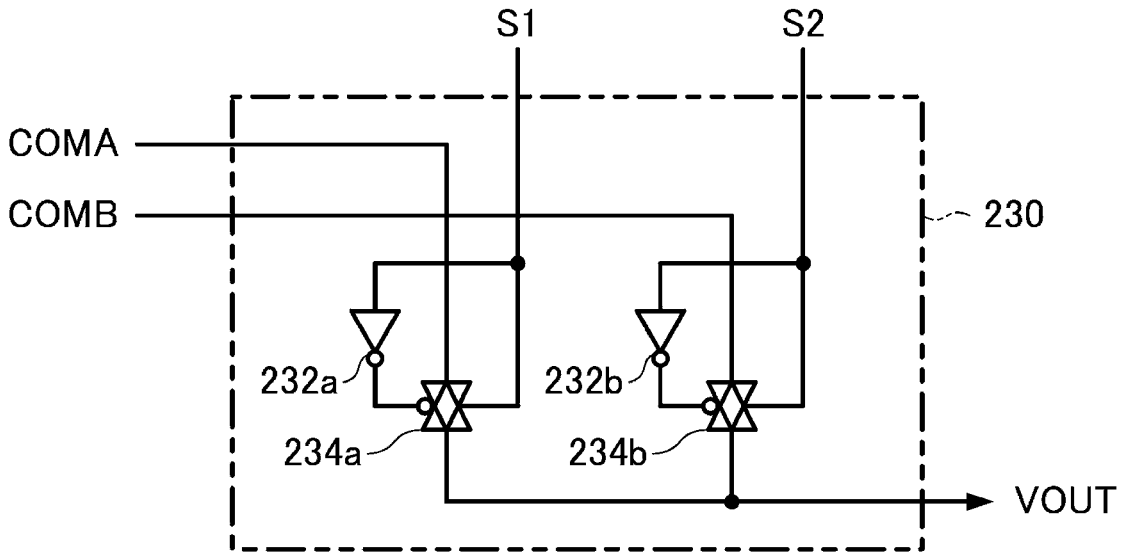
FIG. 6 is a diagram illustrating decoding contents in a decoder.
FIG. 7 is a diagram illustrating a configuration of a selection circuit corresponding to one discharge section.

FIG. 6 is a diagram illustrating decoding contents in the decoder 226. The decoder 226 outputs the selection signals S1 and S2 in accordance with the 2-bit print data [SIH, SIL] latched by the latch circuit 224. For example, when the 2-bit print data[SIH, SIL] latched by the latch circuit 224 is [1, 0], the decoder 226 sets a logical level of the selection signal S1 to respectively be an H level and an L level in the periods T1 and T2 and sets a logical level of the selection signal S2 to respectively be an L level and an H level in the periods T3 and T4. The logical levels of the selection signals S1 and S2 are subject to level shift to a high amplitude logic level based on the voltage VHV by a level shifter (not illustrated).

The selection circuits 230 are provided to correspond to the discharge sections 600, respectively. That is, the number of selection circuits 230 of the driving signal selection circuit 200 is equal to the total number m of the corresponding discharge sections 600.

FIG. 7 is a diagram illustrating a configuration of the selection circuit 230 corresponding to one discharge section 600. As illustrated in FIG. 7, the selection circuit 230 includes inverters 232*a* and 232*b* being NOT circuits, and transfer gates 234*a* and 234*b*.

The selection signal S1 is supplied to a positive control end of the transfer gate 234*a*, which is not marked with a circle, but is logically inverted by the inverter 232*a* and is supplied to a negative control end of the transfer gate 234*a*, which is marked with a circle. The selection signal S2 is supplied to a positive control end of the transfer gate 234*b*, but is logically inverted by the inverter 232*b* and is supplied to a negative control end of the transfer gate 234*b*.

The driving signal COMA is supplied to an input end of the transfer gate 234*a*. The driving signal COMB is supplied to an input end of the transfer gate 234*b*. Output ends of the transfer gates 234*a* and 234*b* are commonly coupled to each other, and the driving signal VOUT is output to the discharge section 600 through the commonly-coupled terminals.

The transfer gate 234*a* electrically connects the input end and an output end when the selection signal S1 has an H level, and does not electrically connect the input end and the output end when the selection signal S1 has an L level. The transfer gate 234*b* electrically connects the input end and an output end when the selection signal S2 has an H level, and does not electrically connect the input end and the output end when the selection signal S2 has an L level.

Figure 8:
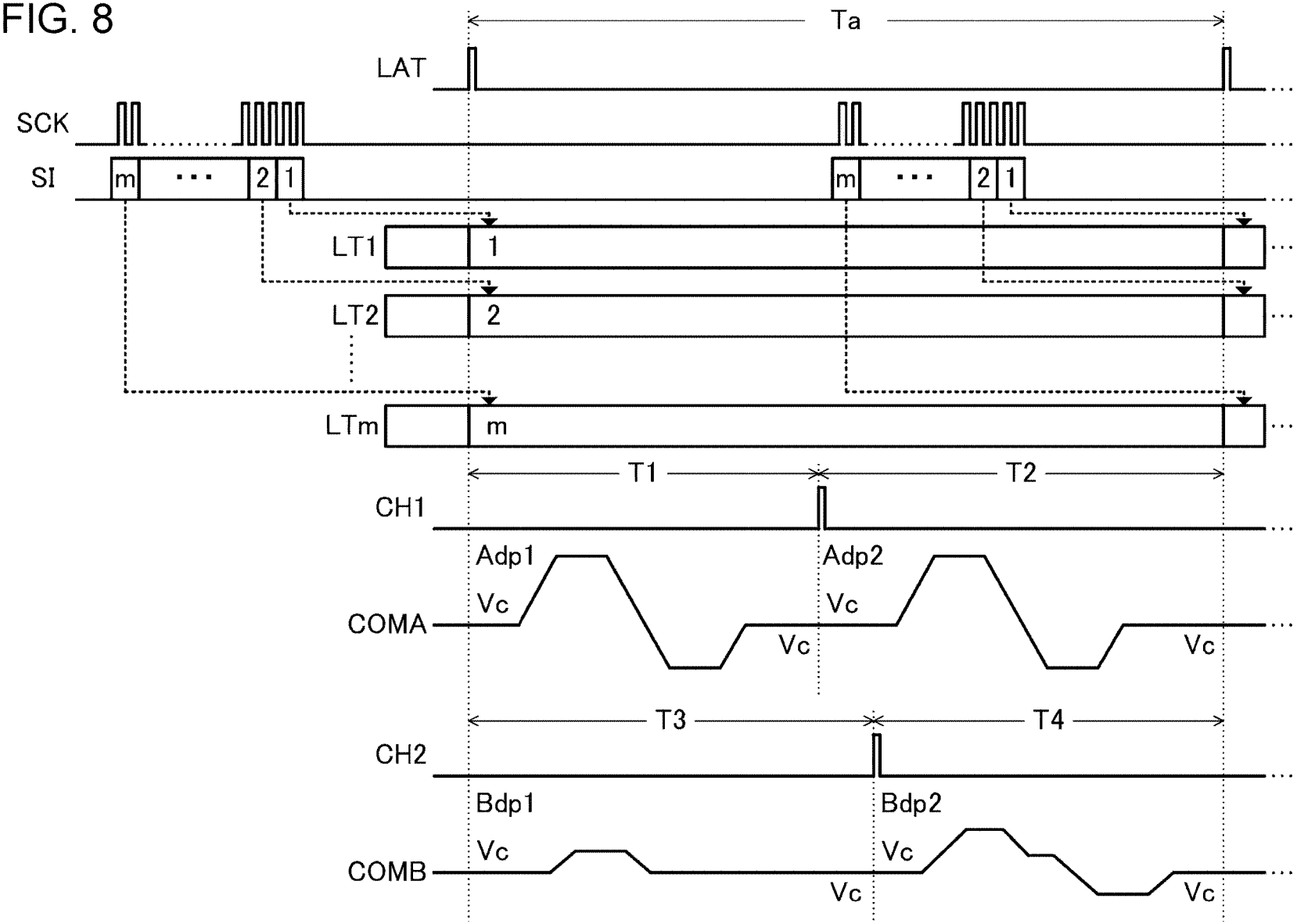
FIG. 8 is a diagram illustrating an operation of the driving signal selection circuit.

Next, an operation of the driving signal selection circuit 200 will be described with reference to FIG. 8. FIG. 8 is a diagram illustrating the operation of the driving signal selection circuit 200. The print data signal SI is serially supplied in synchronization with the clock signal SCK and is sequentially transferred into the shift registers 222 corresponding to the discharge sections 600. If the supply of the clock signal SCK stops, the 2-bit print data [SIH, SIL] corresponding to each of the discharge sections 600 is held in each of the shift registers 222. The print data signal S1 is supplied in order of the discharge sections 600 corresponding to the m-th stage, . . . , the second stage, and the first stage of the shift registers 222.

If the latch signal LAT rises, the latch circuits 224 simultaneously latch the 2-bit print data [SIH, SIL] held by the shift registers 222. In FIG. 8, LT1, LT2, . . . , and LTm indicate the 2-bit print data [SIH, SIL] latched by the latch circuits 224 respectively corresponding to the first stage, the second stage, . . . , and the m-th stage of the shift registers 222.

The decoder 226 outputs the logical levels of the selection signals S1 and S2 in each of the periods T1, T2, T3, and T4 with the contents as illustrated in FIG. 6, in accordance with the size of a dot defined by the latched 2-bit print data [SIH, SIL].

Specifically, when the print data [SIH, SIL] is [1, 1], the decoder 226 sets the selection signal S1 to have an H level and an H level in the periods T1 and T2, and sets the selection signal S2 to have an L level and an L level in the periods T3 and T4. In this case, the selection circuit 230 selects the trapezoid waveform Adp1 included in the driving signal COMA in the period T1, selects the trapezoid waveform Adp2 included in the driving signal COMA in the period T2, does not select the trapezoid waveform Bdp1 included in the driving signal COMB in the period T3, and does not select the trapezoid waveform Bdp2 included in the driving signal COMB in the period T4. As a result, the driving signal VOUT corresponding to "the large dot" illustrated in FIG. 4 is generated.

When the print data [SIH, SIL] is [1, 0], the decoder 226 sets the selection signal S1 to have an H level and an L level in the periods T1 and T2, and sets the selection signal S2 to have an L level and an H level in the periods T3 and T4. In this case, the selection circuit 230 selects the trapezoid waveform Adp1 included in the driving signal COMA in the period T1, does not select the trapezoid waveform Adp2 included in the driving signal COMA in the period T2, does not select the trapezoid waveform Bdp1 included in the driving signal COMB in the period T3, and selects the trapezoid waveform Bdp2 included in the driving signal COMB in the period T4. As a result, the driving signal VOUT corresponding to "the medium dot" illustrated in FIG. 4 is generated.

When the print data [SIH, SIL] is [0, 1], the decoder 226 sets the selection signal S1 to have an L level and an L level in the periods T1 and T2, and sets the selection signal S2 to have an L level and an H level in the periods T3 and T4. In this case, the selection circuit 230 does not select the trapezoid waveform Adp1 included in the driving signal COMA in the period T1, does not select the trapezoid waveform Adp2 included in the driving signal COMA in the period T2, does not select the trapezoid waveform Bdp1 included in the driving signal COMB in the period T3, and selects the trapezoid waveform Bdp2 included in the driving signal COMB in the period T4. As a result, the driving signal VOUT corresponding to "the small dot" illustrated in FIG. 4 is generated.

When the print data [SIH, SIL] is [0, 0], the decoder 226 sets the selection signal S1 to have an L level and an L level in the periods T1 and T2, and sets the selection signal S2 to have an H level and an L level in the periods T3 and T4. In this case, the selection circuit 230 does not select the trapezoid waveform Adp1 included in the driving signal COMA in the period T1, does not select the trapezoid waveform Adp2 included in the driving signal COMA in the period T2, selects the trapezoid waveform Bdp1 included in the driving signal COMB in the period T3, and does not select the trapezoid waveform Bdp2 included in the driving signal COMB in the period T4. As a result, the driving signal VOUT corresponding to "non-recording" illustrated in FIG. 4 is generated.

1.5. Coupling Between Liquid Discharge Head and Liquid Discharge Head Control Circuit Next, details of an electrical coupling between the control mechanism 10 and the liquid discharge head 21 will be described. The following descriptions will be made on the assumption that the liquid discharge head 21 includes twelve driving signal selection circuits 200-1 to 200-12. That is, twelve print data signals SD to SI12, twelve driving signals COMA1 to COMA12 and COMB1 to COMB12, and twelve voltages VBS1 to VBS12, which respectively correspond to the twelve driving signal selection circuits 200-1 to 200-12, are input to the liquid discharge head 21. The control mechanism 10 includes twelve driving signal output circuits 50-1 to 50-12 which respectively correspond to the twelve driving signal selection circuits 200-1 to 200-12.

Figure 9:
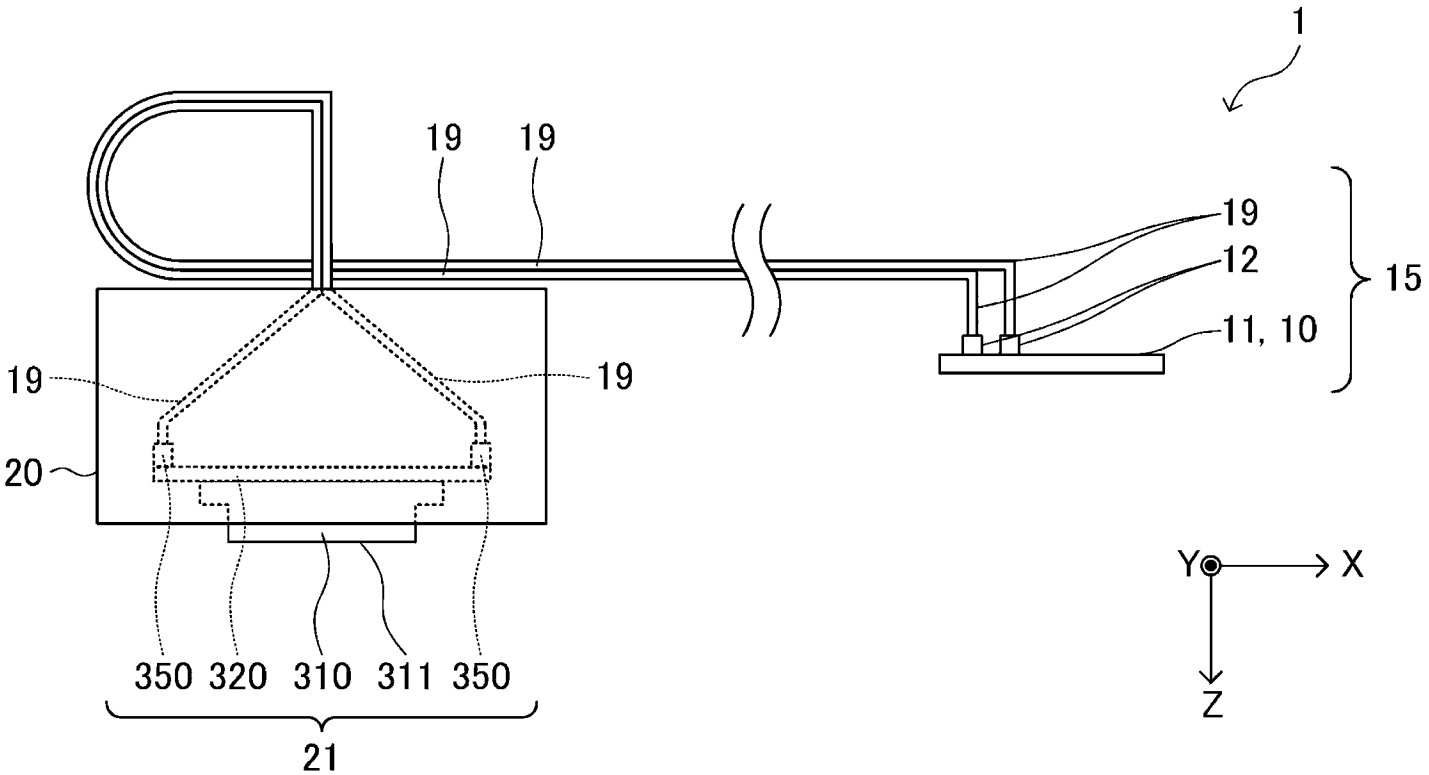
FIG. 9 is a schematic diagram illustrating an internal configuration of the liquid discharge apparatus.

FIG. 9 is a schematic diagram illustrating an internal configuration of the liquid discharge apparatus 1 when viewed from the Y-direction. As illustrated in FIG. 9, the liquid discharge apparatus 1 includes a main substrate 11, the liquid discharge head 21, and a plurality of cables 19 for electrically coupling the main substrate 11 and the liquid discharge head 21 to each other.

Various circuits including the conversion circuit 70, the driving signal output circuits 50-1 to 50-12, the first power source voltage output circuit 51, the second power source voltage output circuit 52, and the control circuit 100 provided in the control mechanism 10 illustrated in FIGS. 1 and 2 are mounted on the main substrate 11. A plurality of connectors 12 to which one ends of the plurality of cables 19 are respectively attached are mounted on the main substrate 11. FIG. 9 illustrates one circuit substrate as the main substrate 11. However, the main substrate 11 may be configured by two circuit substrates or more.

The liquid discharge head 21 includes a head 310, a head substrate 320, and a plurality of connectors 350. The other ends of the plurality of cables 19 are attached to the plurality of connectors 350, respectively. Thus, various signals generated by the control mechanism 10 provided on the main substrate 11 are input to the liquid discharge head 21 through the plurality of cables 19. Details of the configuration of the liquid discharge head 21 and details of signals propagated in the plurality of cables 19 will be described later.

The liquid discharge apparatus 1 configured in a manner as described above controls the operation of the liquid discharge head 21 based on various signals including the driving signals COMA1 to COMA12 and COMB1 to COMB12, the voltages VBS1 to VBS12, the differential clock signal dSCK, the differential print data signals dSI1 to dSI12, the base latch signal oLAT, the base change signals oCHa and oCHb, and the diagnosis signals DIG1 to DIG4, which are output from the control mechanism 10 mounted on the main substrate 11. That is, in the liquid discharge apparatus 1 illustrated in FIG. 9, a configuration including the control mechanism 10 that outputs various signals for controlling the operation of the liquid discharge head 21 and the plurality of cables 19 for propagating the various signals for controlling the operation of the liquid discharge head 21 is an example of the liquid discharge head control circuit 15 that has a function to perform self-diagnosis and controls the operation of the liquid discharge head 21 that discharges the ink from nozzles 651.

Figure 10:
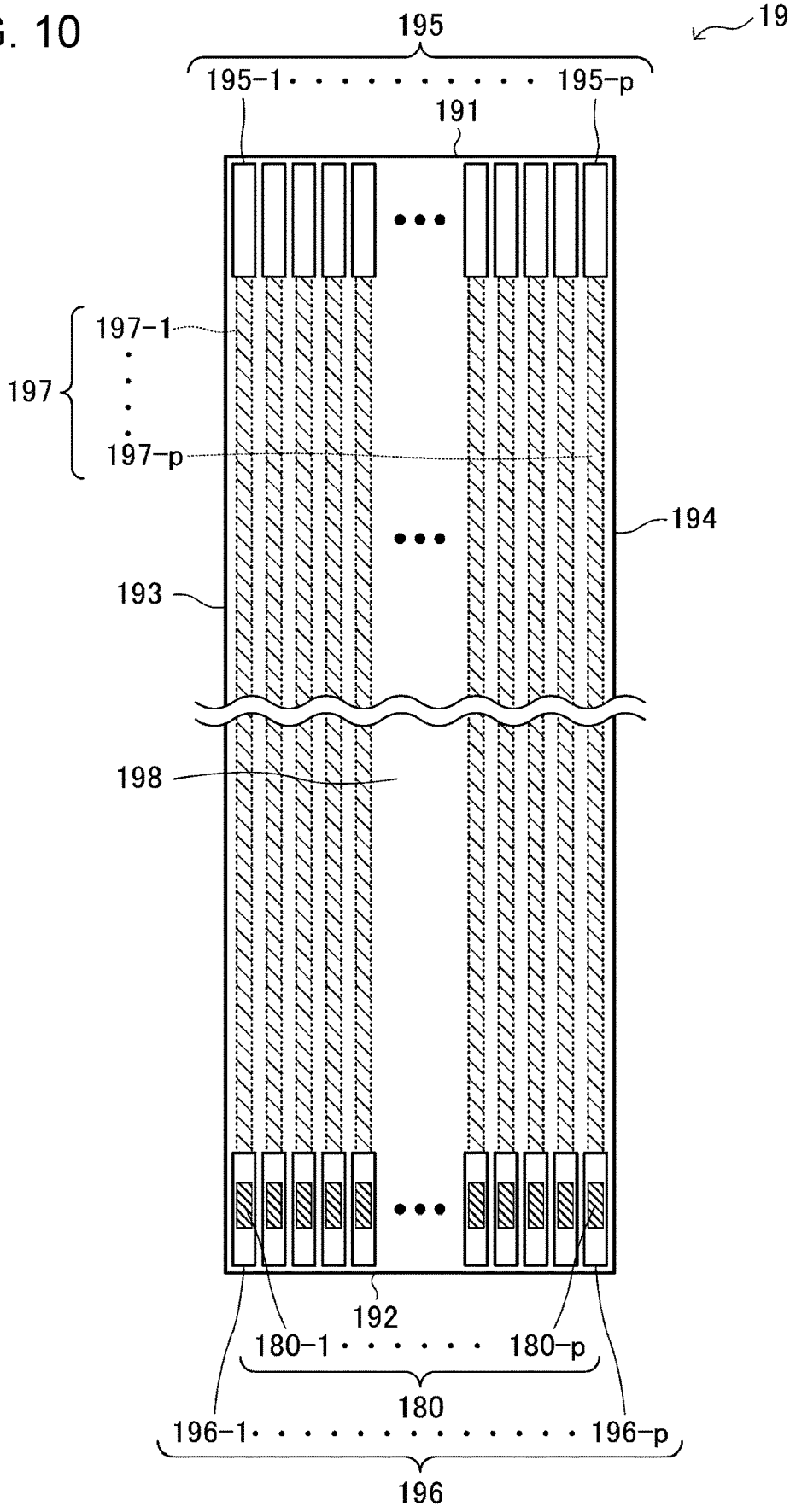
FIG. 10 is a diagram illustrating a configuration of a cable.

FIG. 10 is a diagram illustrating a configuration of the cable 19. The cable 19 has a substantially rectangular shape having short sides 191 and 192 facing each other and long sides 193 and 194 facing each other. For example, the cable 19 is a flexible flat cable (FFC). The cable 19 includes a plurality of terminals 195 arranged in parallel along the short side 191, a plurality of terminals 196 arranged in parallel along the short side 192, and a plurality of wirings 197 that electrically couple the plurality of terminals 195 and the plurality of terminals 196 to each other.

Specifically, p pieces of terminals 195 are arranged in parallel from the long side 193 toward the long side 194, on the short side 191 side of the cable 19 in order of the terminals 195-1 to **195-*p*. p pieces of terminals 196 are arranged in parallel from the long side 193 toward the long side 194, on the short side 192 side of the cable 19 in order of the terminals 196-1 to 196-*p*. In the cable 19, p pieces of wirings 197 that electrically and respectively couple the terminals 195 and the terminals 196 to each other are arranged in parallel from the long side 193 toward the long side 194 in order of the wirings 197-1 to 197-*p*. The wiring 197-1 electrically couples the terminal 195-1 and the terminal 196-1 to each other. Similarly, the wiring 197-*j* (j is any of 1 to p) electrically couples the terminal 195-*j* and the terminal 196-*j* to each other. The cable 19 configured as described above is used for propagating a signal input from the terminal 195-*j* in the wiring 197-*j* and outputting the signal from the terminal 196-*j*. The plurality of wirings 197 in the cable 19 are coated with an insulator 198. Thus, the plurality of wirings 197 are insulated from each other. The configuration of the cable 19 illustrated in FIG. 10 is an example and is not limited thereto. For example, the plurality of terminals 195 and the plurality of terminals 196 may be provided on different surfaces of the cable 19**.

Figure 11:
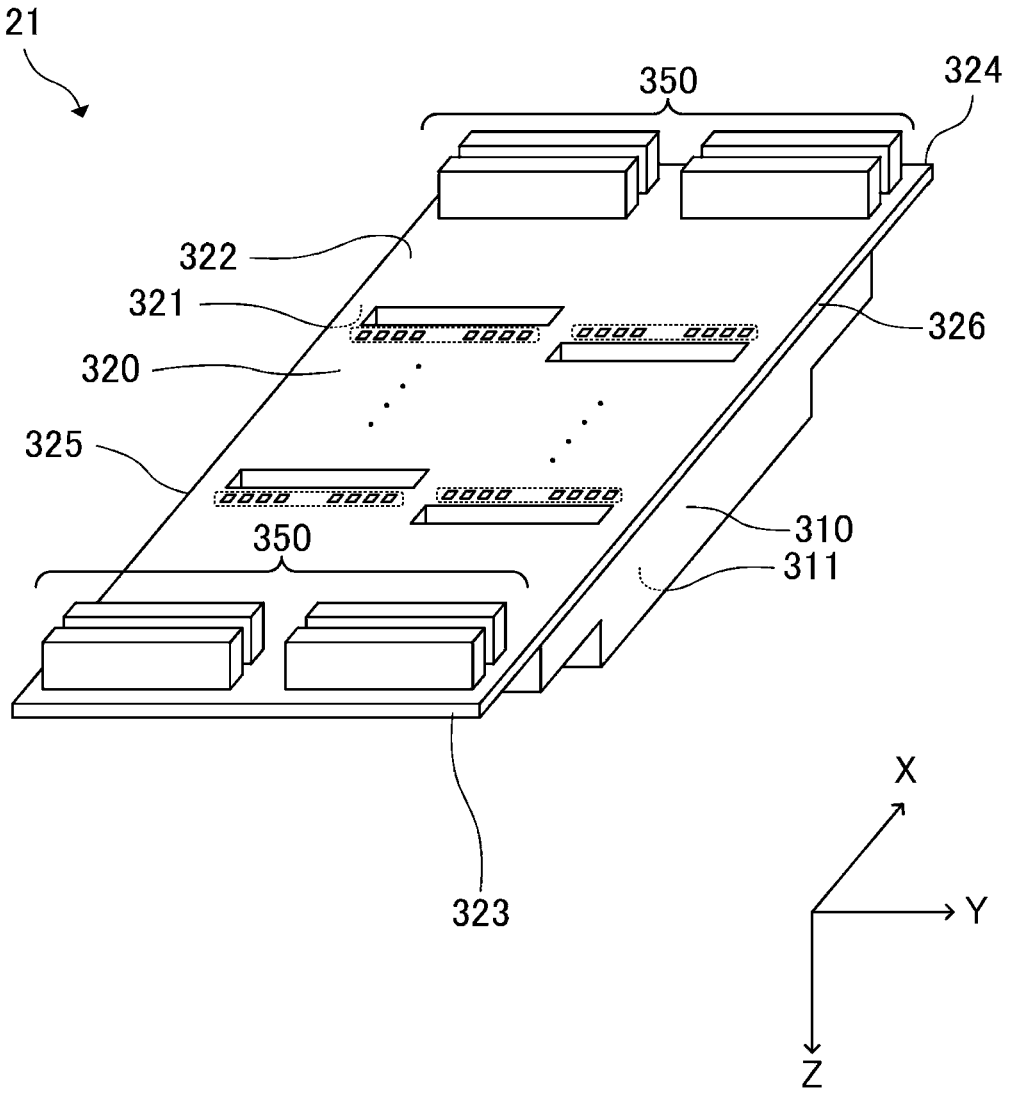
FIG. 11 is a perspective view illustrating a configuration of a liquid discharge head.

Next, a configuration of the liquid discharge head 21 to which a signal propagated in each of the plurality of cables 19 is input will be described. FIG. 11 is a perspective view illustrating the configuration of the liquid discharge head 21. As illustrated in FIG. 11, the liquid discharge head 21 includes the head 310 and the head substrate 320.

The head substrate 320 has a surface 321 and a surface 322 different from the surface 321. The plurality of connectors 350 are provided on the surface 322 of the head substrate 320. The head 310 is provided on the surface 321 side of the head substrate 320. An ink discharge surface 311 on which the plurality of discharge sections 600 are formed is located on a lower surface of the head 310 in the Z-direction.

Figure 12:
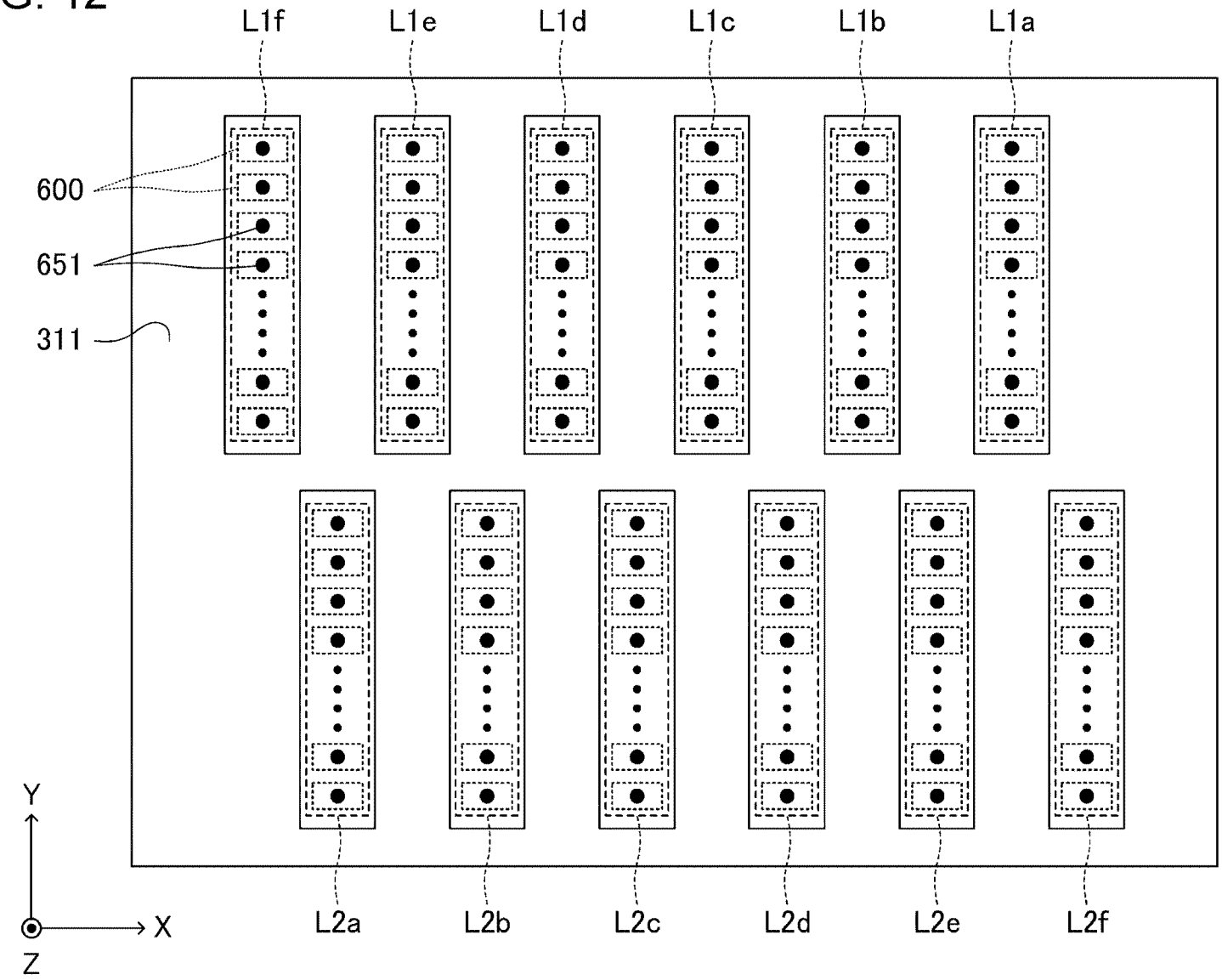
FIG. 12 is a plan view illustrating a configuration of an ink discharge surface.

FIG. 12 is a plan view illustrating a configuration of the ink discharge surface 311. As illustrated in FIG. 12, twelve nozzle plates 632 are provided on the ink discharge surface 311. The nozzle plate 632 has nozzles 651 provided in the plurality of discharge sections 600. Nozzle lines L1*a* to L1*f* and L2*a* to L2*f* are formed in each of the nozzle plates 632. In each of the nozzle lines, the nozzles 651 are arranged side by side in the Y-direction.

The nozzle lines L1*a* to L1*f* are provided to be arranged from the right to the left in FIG. 12 in the X-direction in order of the nozzle lines L1*a*, L1*b*, L1*c*, L1*d*, L1*e*, and L1*f*. The nozzle lines L2*a* to L2*f* are provided to be arranged from the left to the right in FIG. 12 in the X-direction in order of the nozzle lines L2*a*, L2*b*, L2*c*, L2*d*, L2*e*, and L2*f*. Further, the nozzle lines L1*a* to L1*f* and the nozzle lines L2*a* to L2*f* provided to be arranged in the X-direction are provided such that two lines are arranged side by side in the Y-direction. That is, the nozzle lines L1*a* to L1*f* and the nozzle lines L2*a* to L2*f* in which the plurality of nozzles 651 are formed in the Y-direction are formed in the ink discharge surface 311 in two lines in the X-direction. In FIG. 12, the nozzles 651 are provided to be arranged in one line in the Y-direction in each of the nozzle lines L1*a* to L1*f* and L2*a* to L2*f*. However, the nozzles 651 may be provided to be arranged in two lines or more in the Y-direction.

The nozzle lines L1*a* to L1*f* and L2*a* to L2*f* correspond to the driving signal selection circuits 200, respectively. Specifically, the driving signal selection circuit 200-1 corresponds to the nozzle line L1*a*. The driving signal VOUT1 output by the driving signal selection circuit 200-1 is supplied to the one end of the piezoelectric element 60 in a plurality of discharge sections 600 provided in the nozzle line L1*a*. The voltage VBS1 is supplied to the other end of this piezoelectric element 60. Similarly, nozzle lines L1*b* to L1*f* correspond to the driving signal selection circuit 200-2 to 200-6, respectively. The driving signals VOUT2 to VOUT6 and the voltages VBS2 to VBS6 are supplied to the driving signal selection circuit 200-2 to 200-6, respectively. The nozzle lines L2*a* to L2*f* correspond to the driving signal selection circuit 200-7 to 200-12, respectively. The driving signals VOUT7 to VOUT12 and the voltages VBS7 to VBS12 are supplied to the driving signal selection circuit 200-7 to 200-12, respectively.

Figure 13:
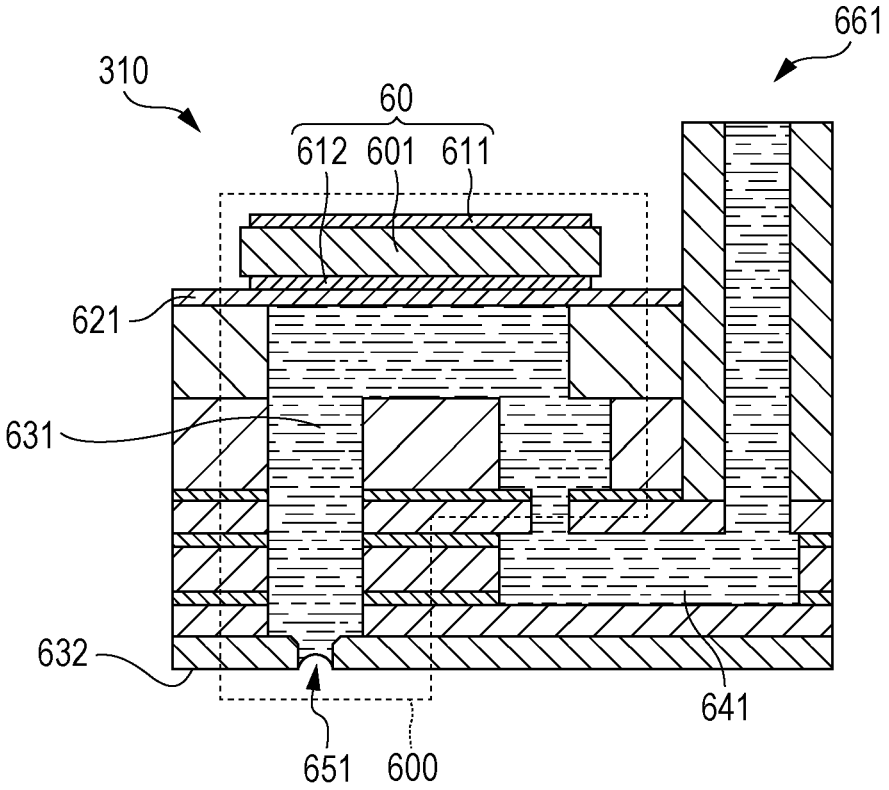
FIG. 13 is a diagram illustrating an overall configuration of one signal of a plurality of discharge sections.

Next, the configuration of the discharge section 600 in the head 310 will be described with reference to FIG. 13. FIG. 13 is a diagram illustrating an overall configuration of one of the plurality of discharge sections 600 in the head 310. As illustrated in FIG. 13, the head 310 includes the discharge section 600 and a reservoir 641.

The reservoir 641 is provided to correspond to each of the nozzle lines L1*a* to L1*f* and L2*a* to L2*f*. The ink is supplied from an ink supply port 661 into the reservoir 641.

The discharge section 600 includes the piezoelectric element 60, a vibration plate 621, a cavity 631, and the nozzle 651. The vibration plate 621 deforms by displacement of the piezoelectric element 60 provided on an upper surface in FIG. 13. The vibration plate 621 functions as a diaphragm of increasing and reducing the internal volume of the cavity 631. The cavity 631 is filled with the ink. The cavity 631 functions as a pressure chamber having an internal volume which changes by the displacement of the piezoelectric element 60. The nozzle 651 is an opening portion which is formed in the nozzle plate 632 and communicates with the cavity 631. The ink stored in the cavity 631 is discharged from the nozzle 651 by the change of the internal volume of the cavity 631.

The piezoelectric element 60 has a structure in which a piezoelectric substance 601 is interposed between a pair of electrodes 611 and 612. In the piezoelectric element 60 having such a structure, the central portions of the electrodes 611 and 612 and the vibration plate 621 bend with respect to both end portions thereof in an up-and-down direction in FIG. 13, in accordance with a voltage supplied to the electrodes 611 and 612. Specifically, the driving signal VOUT is supplied to the electrode 611 as one end, and the voltage VBS is supplied to the electrode 612 as the other end. If the voltage of the driving signal VOUT is high, the central portion of the piezoelectric element 60 bends upward. If the voltage of the driving signal VOUT is low, the central portion of the piezoelectric element 60 bends downward. That is, if the piezoelectric element 60 bends upward, the internal volume of the cavity 631 increases. Thus, the ink is drawn from the reservoir 641. If the piezoelectric element 60 bends downward, the internal volume of the cavity 631 is reduced. Accordingly, the ink of the amount depending on the reduced degree of the internal volume of the cavity 631 is discharged from the nozzle 651. As described above, the piezoelectric element 60 drives by the driving signal VOUT based on the driving signals COMA and COMB. Thus, the piezoelectric element 60 drives by the driving signal VOUT based on the driving signals COMA1 to COMAn and COMB1 to COMBn, and thereby the ink is discharged from the nozzle 651. The piezoelectric element 60 is not limited to the structure illustrated in FIG. 13. Any type may be provided so long as the piezoelectric element is capable of discharging the ink with the displacement of the piezoelectric element 60. The piezoelectric element 60 is not limited to flexural vibration, and may be configured to use longitudinal vibration.

Figure 14:
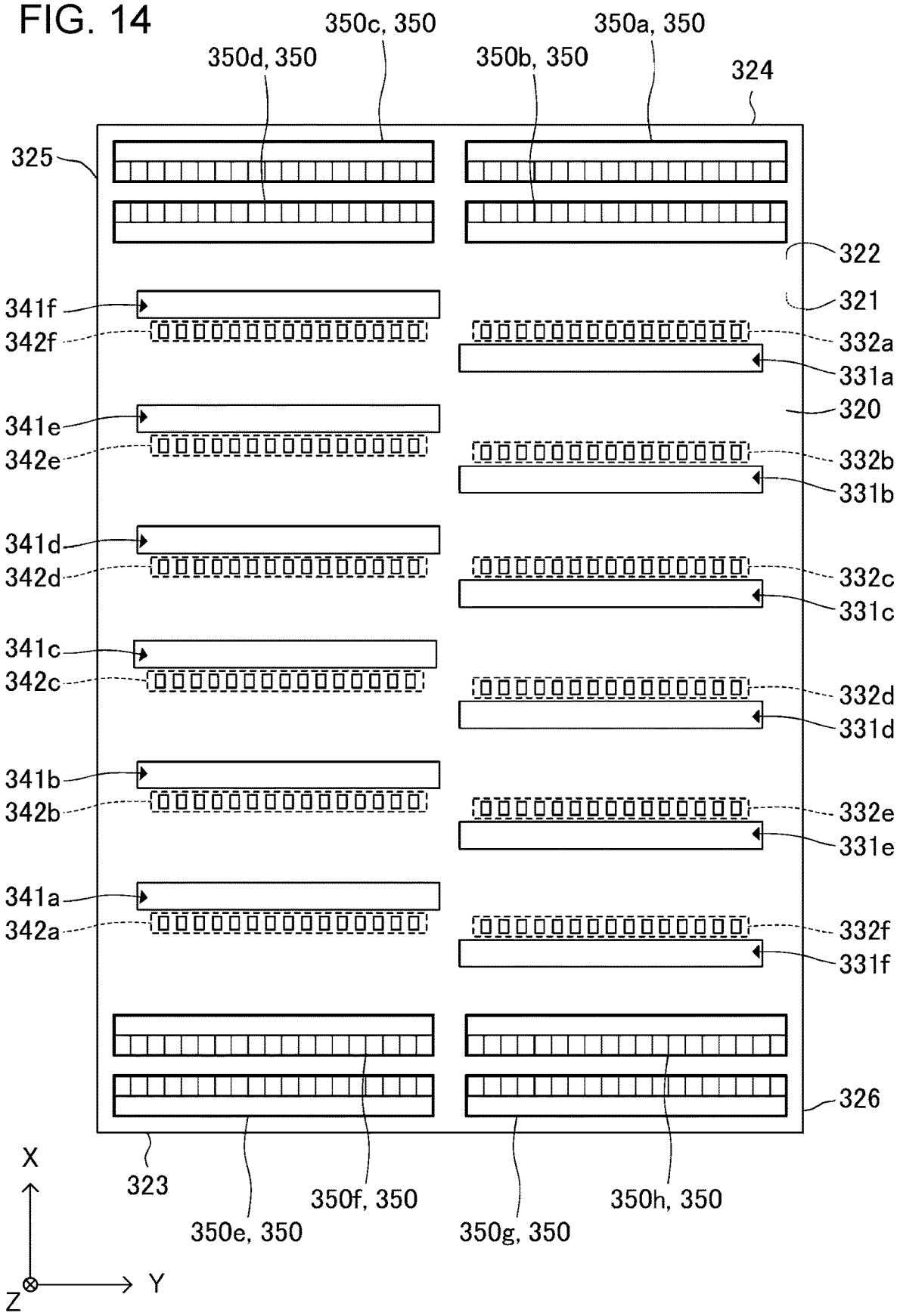
FIG. 14 is a plan view when a head substrate is viewed from a surface.

Next, a configuration of the head substrate 320 will be described with reference to FIG. 14. FIG. 14 is a plan view when the head substrate 320 is viewed from the surface 321. The head substrate 320 has a substantially rectangular shape formed by a side 323, a side 324 (facing the side 323 in the X-direction), a side 325, and a side 326 (facing the side 325 in the Y-direction). The shape of the head substrate 320 is not limited to a rectangle. For example, the shape of the head substrate 320 may be a polygon such as a hexagon or an octagon, or may have a shape in which a notch or an arc is formed. That is, the head substrate 320 has the side 323, the side 324 different from the side 323, the side 325 intersecting with the side 323 and the side 324, and the side 326 which intersects with the side 323 and the side 324 and is different from the side 325. Here, the sides 325 and 326 intersecting with the sides 323 and 324 includes a case where a virtual extension line of the side 325 intersects with a virtual extension line of the side 323 and a virtual extension line of the side 324, and a virtual extension line of the side 326 intersects with a virtual extension line of the side 323 and a virtual extension line of the side 324.

FPC insertion holes 331*a* to 331*f* and 341*a* to 341*f*, electrode groups 332*a* to 332*f* and 342*a* to 342*f*, and the plurality of connectors 350 are provided in the head substrate 320.

Each of the electrode groups 332*a* to 332*f* and 342*a* to 342*f* includes a plurality of electrodes arranged in parallel in the Y-direction. The electrode groups 332*a* to 332*f* are provided to be arranged from the side 324 toward the side 323 along the side 326 in order of the electrode groups 332*a*, 332*b*, 332*c*, 332*d*, 332*e*, and 332*f*. The electrode groups 342*a* to 342*f* are provided to be arranged from the side 323 toward the side 324 along the side 325 in order of the electrode groups 342*a*, 342*b*, 342*c*, 342*d*, 342*e*, and 342*f*. A flexible printed circuit (FPC) (not illustrated) is electrically coupled to each of the electrode groups 332*a* to 332*f* and 342*a* to 342*f* provided in a manner as described above.

The FPC coupled to the electrode group 332*a* propagates various signals supplied to the electrode group 332*a* to the driving signal selection circuit 200-1. That is, various control signals for controlling an operation of the nozzle line L1*a* are supplied to the electrode group 332*a*. Similarly, the FPC coupled to the electrode groups 332*b* to 332*f* propagates various signals supplied to the electrode groups 332*b* to 332*f* to the driving signal selection circuits 200-2 to 200-6, respectively. That is, various control signals for controlling operations of the nozzle lines L1*b* to L1*f* are supplied to the electrode groups 332*b* to 332*f*, respectively. Similarly, the FPC coupled to the electrode groups 342*a* to 342*f* propagates various signals supplied to the electrode groups 342*a* to 342*f* to the driving signal selection circuits 200-7 to 200-12, respectively. That is, various control signals for controlling operations of the nozzle lines L2*a* to L2*f* are supplied to the electrode groups 342*a* to 342*f*, respectively.

The FPC insertion holes 331*a* to 331*f* and 341*a* to 341*f* are through-holes penetrating the surface 321 and the surface 322 of the head substrate 320. FPCs which are electrically coupled to the electrode groups 332*a* to 332*f* and 342*a* to 342*f* is inserted into the FPC insertion holes 331*a* to 331*f* and 341*a* to 341*f*, respectively.

Specifically, the FPC insertion hole 331*a* is provided between the electrode group 332*a* and the electrode group 332*b*. The FPC insertion hole 331*b* is provided between the electrode group 332*b* and the electrode group 332*c*. The FPC insertion hole 331*c* is provided between the electrode group 332*c* and the electrode group 332*d*. The FPC insertion hole 331*d* is provided between the electrode group 332*d* and the electrode group 332*e*. The FPC insertion hole 331*e* is provided between the electrode group 332*e* and the electrode group 332*f*. The FPC insertion hole 331*f* is provided on the side 323 side of the electrode group 332*f*. The FPCs which are electrically coupled to the electrode groups 332*a* to 332*f* are inserted into the FPC insertion holes 331*a* to 331*f*, respectively.

The FPC insertion hole 341*a* is provided between the electrode group 342*a* and the electrode group 342*b*. The FPC insertion hole 341*b* is provided between the electrode group 342*b* and the electrode group 342*c*. The FPC insertion hole 341*c* is provided between the electrode group 342*c* and the electrode group 342*d*. The FPC insertion hole 341*d* is provided between the electrode group 342*d* and the electrode group 342*e*. The FPC insertion hole 341*e* is provided between the electrode group 342*e* and the electrode group 342*f* The FPC insertion hole 341*f* is provided on the side 324 side of the electrode group 342*f* The FPCs which are electrically coupled to the electrode groups 342*a* to 342*f* are inserted into the FPC insertion holes 341*a* to 341*f*, respectively.

The connectors 350*a* to 350*d* among the plurality of connectors 350 are provided on the side 323 side of the electrode groups 332*a* to 332*f* and 342*a* to 342*f* and the FPC insertion holes 331*a* to 331*f* and 341*a* to 341*f*, respectively. The connectors 350*e* to 350*h* among the plurality of connectors 350 are provided on the side 324 side of the electrode groups 332*a* to 332*f* and 342*a* to 342*f* and the FPC insertion holes 331*a* to 331*f* and 341*a* to 341*f*.

Figure 15:
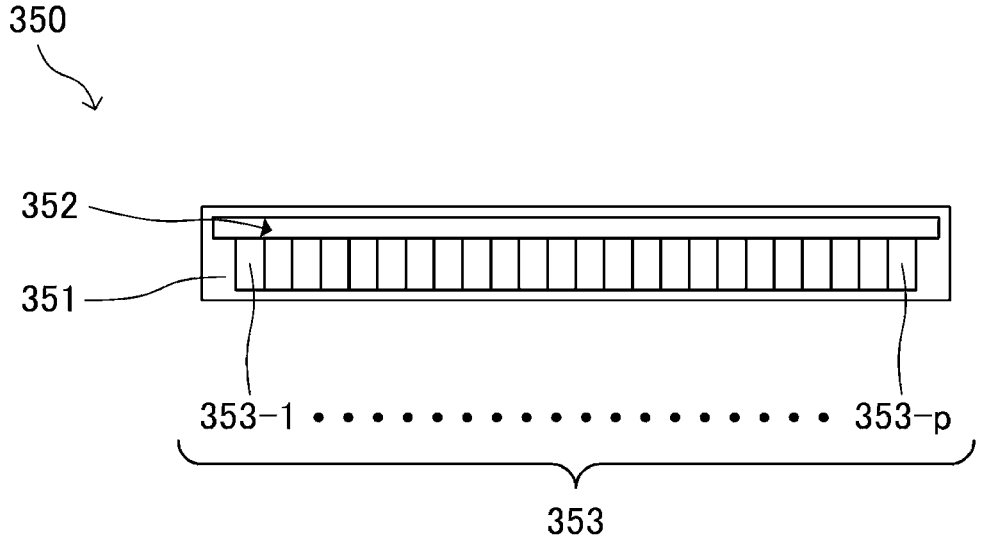
FIG. 15 is a diagram illustrating a configuration of a connector.

A configuration of the connector 350 will be described with reference to FIG. 15. FIG. 15 is a diagram illustrating the configuration of the connector 350. As illustrated in FIG. 15, the connector 350 includes a housing 351, a cable attachment portion 352 formed in the housing 351, and p pieces of terminals 353 arranged in parallel. Here, the p pieces of terminals 353 arranged in parallel in the connector 350 are referred to as terminals 353-1, 353-2, . . . , and 353-*p* in order from the left toward the right in FIG. 15.

The cable 19 is attached to the plurality of connectors 350 configured in a manner as described above. Specifically, the cable 19 is attached to the cable attachment portion 352 of the connector 350. In this case, the terminals 196-1 to 196-*p* of the cable 19 illustrated in FIG. 11 are electrically coupled to the terminal 353-1 to 353-*p* of the connector 350, respectively. Thus, various signals propagated in the wirings 197-1 to 197-*p* of the cable 19 are input to the liquid discharge head 21 through the connector 350.

Figure 16:
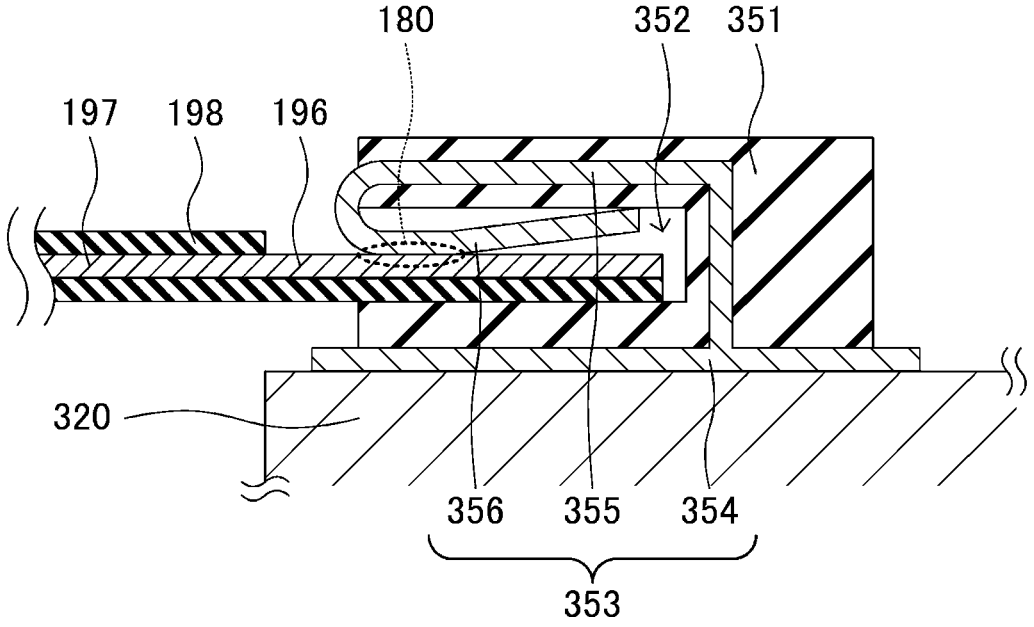
FIG. 16 is a diagram illustrating a specific example when the cable is attached to the connector.

Here, a specific example of electrical coupling between the cable 19 and the connector 350 will be described with reference to FIG. 16. FIG. 16 is a diagram illustrating a specific example when the cable 19 is attached to the connector 350. As illustrated in FIG. 16, the terminal 353 of the connector 350 has a substrate attachment portion 354, a housing insertion portion 355, and a cable holding portion 356. The substrate attachment portion 354 is located at a lower portion of the connector 350 and is provided between the housing 351 and the head substrate 320. The substrate attachment portion 354 is electrically coupled to an electrode (not illustrated) provided on the head substrate 320, by a solder, for example. The housing insertion portion 355 is inserted into the housing 351. The housing insertion portion 355 electrically couples the substrate attachment portion 354 to the cable holding portion 356. The cable holding portion 356 has a curved shape that protrudes toward the inside of the cable attachment portion 352. When the cable 19 is attached to the cable attachment portion 352, the cable holding portion 356 and the terminal 196 electrically come into contact with each other via a contact portion 180. Thus, the cable 19 is electrically coupled to the connector 350 and the head substrate 320. In this case, since the cable 19 is attached, stress is applied to the curved shape formed at the cable holding portion 356. With the stress, the cable 19 is held in the cable attachment portion 352.

As described above, the cable 19 and the connector 350 are electrically coupled to each other by the terminal 196 and the terminal 353 coming into contact with each other through the contact portion 180. FIG. 10 illustrates contact portions 180-1 to 180-*p* at which the terminals 196-1 to 196-*p* are electrically in contact with the terminal 353 of the connector 350, respectively. Thus, the terminal 195-*k* in the cable 19 is electrically coupled to the connector 12, and the terminal 196-*k* is electrically coupled to the connector 350 through the contact portion 180-*k*.

Returning to FIG. 14, details of the arrangement of the connectors 350*a* to 350*h* provided in the head substrate 320 will be described. In the following descriptions, the housing 351 in the connector 350*a* is referred to as a housing 351*a*, the cable attachment portion 352 in the connector 350*a* is referred to as a cable attachment portion 352*a*, and the p pieces of terminals 353 in the connector 350*a* is referred to as p pieces of terminals 353*a*. The p pieces of the terminals 353*a* are referred to as terminals 353*a*-1 to 353*a*-*p*. Similarly, the housing 351 in the connectors 350*b* to 350*h* is referred to as housings 351*b* to 351*h*. The cable attachment portion 352 in the connectors 350*b* to 350*h* is referred to as cable attachment portions 352*b* to 352*h*. The p pieces of terminal 353 in the connectors 350*b* to 350*h* is referred to as p pieces of terminals 353*b* to 353*h*. The p pieces of terminals 353*b* are referred as terminals 353*b*-1 to 353*b*-*p*. The p pieces of terminals 353*c* are referred as terminals 353*c*-1 to 353*c*-*p*. The p pieces of terminals 353*d* are referred as terminals 353*d*-1 to 353*d*-*p*. The p pieces of terminals 353*e* are referred as terminals 353*e*-1 to 353*e*-*p*. The p pieces of terminals 353*f* are referred as terminals 353*f*-1 to 353*f*-*p*. The p pieces of terminals 353*g* are referred as terminals 353*g*-1 to 353*g*-*p*. The p pieces of terminals 353*h* are referred as terminals 353*h*-1 to 353*h*-*p*.

In the connector 350*a*, the p pieces of terminals 353*a* are provided on the side 324 side of the electrode groups 332*a* to 332*f* and 342*a* to 342*f* and the FPC insertion holes 331*a* to 331*f* and 341*a* to 341*f*, so as to be arranged from the side 325 toward the side 326 along the side 324 in order of the terminals 353*a*-1, 353*a*-2, . . . , and 353*a*-*p*.

In the connector 350*b*, the p pieces of terminals 353*b* are provided on the side 324 side of the electrode groups 332*a* to 332*f* and 342*a* to 342*f* and the FPC insertion holes 331*a* to 331*f* and 341*a* to 341*f* and on the side 323 side of the connector 350*a*, so as to be arranged from the side 326 toward the side 325 along the side 324 in order of the terminals 353*b*-1, 353*b*-2, . . . , and 353*b*-*p*.

In the connector 350*c*, the p pieces of terminals 353*c* are provided on the side 324 side of the electrode groups 332*a* to 332*f* and 342*a* to 342*f* and the FPC insertion holes 331*a* to 331*f* and 341*a* to 341*f* and on the side 325 side of the connector 350*a*, so as to be arranged from the side 325 toward the side 326 along the side 324 in order of the terminals 353*c*-1, 353*c*-2, . . . , and 353*c*-*p*.

In the connector 350*d*, the p pieces of terminals 353*d* are provided on the side 324 side of the electrode groups 332*a* to 332*f* and 342*a* to 342*f* and the FPC insertion holes 331*a* to 331*f* and 341*a* to 341*f* and on the side 323 side of the connector 350*c*, so as to be arranged from the side 326 toward the side 325 along the side 324 in order of the terminals 353*d*-1, 353*d*-2, . . . , and 353*d*-*p*.

In the connector 350*e*, the p pieces of terminals 353*e* are provided on the side 323 side of the electrode groups 332*a* to 332*f* and 342*a* to 342*f* and the FPC insertion holes 331*a* to 331*f* and 341*a* to 341*f*, so as to be arranged from the side 326 toward the side 325 along the side 323 in order of the terminals 353*e*-1, 353*e*-2, . . . , and 353*e-p*.

In the connector 350*f*, the p pieces of terminals 353*f* are provided on the side 323 side of the electrode groups 332*a* to 332*f* and 342*a* to 342*f* and the FPC insertion holes 331*a* to 331*f* and 341*a* to 341*f* and on the side 324 side of the connector 350*e*, so as to be arranged from the side 325 toward the side 326 along the side 323 in order of the terminals 353*f*-1, 353*f*-2, . . . , and 353*f-p*.

In the connector 350*g*, the p pieces of terminals 353*g* are provided on the side 323 side of the electrode groups 332*a* to 332*f* and 342*a* to 342*f* and the FPC insertion holes 331*a* to 331*f* and 341*a* to 341*f* and on the side 325 side of the connector 350*a*, so as to be arranged from the side 326 toward the side 325 along the side 323 in order of the terminals 353*g*-1, 353*g*-2, . . . , and 353*g-p*.

In the connector 350*h*, the p pieces of terminals 353*h* are provided on the side 323 side of the electrode groups 332*a* to 332*f* and 342*a* to 342*f* and the FPC insertion holes 331*a* to 331*f* and 341*a* to 341*f* and on the side 324 side of the connector 350*g*, so as to be arranged from the side 325 toward the side 326 along the side 323 in order of the terminals 353*h*-1, 353*h*-2, . . . , and 353*h-p*.

Various signals for controlling the liquid discharge head 21 are supplied to the head substrate 320 configured in a manner as described above, through the plurality of cables 19 which are electrically and respectively coupled to the connectors 350*a* to 350*h*. The various signals supplied to the liquid discharge head 21 are propagated in a wiring pattern (not illustrated) provided in the head substrate 320, and then are input to the electrode groups 332*a* to 332*f* and 342*a* to 342*f*. The various signals are supplied to the driving signal selection circuits 200-1 to 200-12 through the FPCs coupled to the electrode groups 332*a* to 332*f* and 342*a* to 342*f*, respectively. Thus, the piezoelectric element 60 in each of the nozzle lines L1*a* to L1*f* and L2*a* to L2*f* drives at a desired timing, and thus an ink having an amount depending on the driving of the piezoelectric element 60 is discharged from the nozzle 651.

Here, the integrated circuit which is illustrated in FIG. 2 and constitutes the restoration circuit 130 and the diagnostic circuit 240 is mounted on any of the surfaces 322 and 321 of the head substrate 320, in the head 310, or on an FPC in a manner of chip-on-film (COF). The integrated circuit constituting each of the driving signal selection circuits 200-1 to 200-6 may be provided in the head 310 or on an FPC in a manner of COF.

1.6. Signal Propagated Between Liquid Discharge Head and Liquid Discharge Head Control Circuit Here, details of a signal propagated between the control mechanism 10 and the liquid discharge head 21 will be described. In the following descriptions, the cable 19 coupled to the connector 350*a* is referred to as a cable 19*a*. A terminal 196*a-j* (j is any of 1 to p) of the cable 19*a* is electrically coupled to the terminal 353*a-j* of the connector 350*a* through a contact portion 180*a-j*. Similarly, the cable 19 coupled to the connectors 350*b* to 350*h* is referred to as cables 19*b* to 19*h*. A terminal 196*b-j* of the cable 19*b* is electrically coupled to the terminal 353*b-j* of the connector 350*b* through a contact portion 180*b-j*. A terminal 196*c-j* of the cable 19*c* is electrically coupled to the terminal 353*c-j* of the connector 350*c* through a contact portion 180*c-j*. A terminal 196*d-j* of the cable 19*d* is electrically coupled to the terminal 353*d-j* of the connector 350*d* through a contact portion 180*d-j*. A terminal 196*e-j* of the cable 19*e* is electrically coupled to the terminal 353*e-j* of the connector 350*e* through a contact portion 180*e-j*. A terminal 196*f-j* of the cable 19*f* is electrically coupled to the terminal 353*f-j* of the connector 350*f* through a contact portion 180*f-j*. A terminal 196*g-j* of the cable 19*g* is electrically coupled to the terminal 353*g-j* of the connector 350*g* through a contact portion 180*g-j*. A terminal 196*h-j* of the cable 19*h* is electrically coupled to the terminal 353*h-j* of the connector 350*h* through a contact portion 180*h-j*.

Details of signals which are propagated in cables 19*a* to 19*h* and are input to the liquid discharge head 21 through the connectors 350*a* to 350*h* will be described with reference to FIGS. 17 to 24. In the descriptions of FIGS. 17 to 24, descriptions will be made on the assumption that each of the cables 19*a* to 19*h* includes 24 wirings, and each of the connectors 350*a* to 350*h* includes 24 terminals 353.

In this embodiment, in the liquid discharge apparatus 1, the liquid discharge head 21 includes a terminal 353*b*-19 electrically coupled to the driving signal selection circuit 200 and terminals 353*b*-3, 353*b*-6, 353*b*-4, and 353*b*-5 which are electrically coupled to the restoration circuit 130.

The liquid discharge head control circuit 15 includes a wiring 197*b*-19 for propagating the ground signal GND1 to be supplied to the driving signal selection circuit 200, wirings 197*b*-3 and 197*b*-6 for propagating the ground signal GND2 to be supplied to the restoration circuit 130, a wiring 197*b*-4 for propagating one signal dDIG1+ of the pair of differential diagnosis signals dDIG1, and a wiring 197*b*-5 for propagating the other signal dDIG1− of the pair of differential diagnosis signals dDIG1.

In the liquid discharge apparatus 1, the wiring 197*b*-19 and the terminal 353*b*-19 are electrically in contact with each other at a contact portion 180*b*-19. The wiring 197*b*-3 and the terminal 353*b*-3 are electrically in contact with each other at a contact portion 180*b*-3. The wiring 197*b*-6 and the terminal 353*b*-6 are electrically in contact with each other at a contact portion 180*b*-6. The wiring 197*b*-4 and the terminal 353*b*-4 are electrically in contact with each other at a contact portion 180*b*-4. The wiring 197*b*-5 and the terminal 353*b*-5 are electrically in contact with each other at a contact portion 180*b*-5.

As described above, in the liquid discharge head control circuit 15, the wiring 197*b*-4 and the wiring 197*b*-5 are disposed to be arranged side by side. In the Y-direction being the direction in which the wiring 197*b*-4 and the wiring 197*b*-5 are arranged, the wiring 197*b*-4 and the wiring 197*b*-3 are located to be adjacent to each other, the wiring 197*b*-5 and the wiring 197*b*-6 are located to be adjacent to each other, and the wiring 197*b*-4 and the wiring 197*b*-5 are located between the wiring 197*b*-3 and the wiring 197*b*-6. That is, in the liquid discharge head control circuit 15, the wirings 197*b*-3, 197*b*-4, 197*b*-5, and 197*b*-6 are provided in the same cable 19*b*. The wiring 197*b*-4 and the wiring 197*b*-3 are located to be adjacent to each other. The wiring 197*b*-5 and the wiring 197*b*-6 are located to be adjacent to each other. The wiring 197*b*-4 and the wiring 197*b*-5 are located between the wiring 197*b*-3 and the wiring 197*b*-6. Here, the phrase of being located to be adjacent includes a case where the wiring and the wiring are located to be adjacent to each other through the insulator 198, a space, or the like. In other words, the wirings 197*b*-3, 197*b*-4, 197*b*-5, and 197*b*-6 are provided in the same cable 19*b* in order of the wirings 197*b*-3, 197*b*-4, 197*b*-5, and 197*b*-6.

In the liquid discharge head 21, the terminal 353*b*-4 to which the signal dSCK+ is input and the terminal 353*b*-5 to which the signal dSCK− is input are disposed to be arranged side by side. In the Y-direction being the direction in which the terminal 353*b*-4 and the terminal 353*b*-5 are arranged, the terminal 353*b*-4 and the terminal 353*b*-3 are located to be adjacent to each other, the terminal 353*b*-5 and the terminal 353*b*-6 are located to be adjacent to each other, and the terminal 353*b*-4 and the terminal 353*b*-5 are located between the terminal 353*b*-3 and the terminal 353*b*-6. That is, in the liquid discharge head 21, the terminals 353*b*-3, 353*b*-4, 353*b*-5, and 353*b*-6 are provided in the same connector 350*b*. The terminal 353*b*-4 and the terminal 353*b*-3 are located to be adjacent to each other. The terminal 353*b*-5 and the terminal 353*b*-6 are located to be adjacent to each other. The terminal 353*b*-4 and the terminal 353*b*-5 are located between the terminal 353*b*-3 and the terminal 353*b*-6. Here, the phrase of being located to be adjacent includes a case where the terminal 353*b*-4 and the terminal 353*b*-3, and the terminal 353*b*-5 and the terminal 353*b*-6 in the connector 350 are located to be adjacent to each other through, for example, an insulator such as the housing 351 or an internal space of the cable attachment portion 352. In other words, the terminals 353*b*-3, 353*b*-4, 353*b*-5, and 353*b*-6 are provided in the same connector 350*b* in order of the terminals 353*b*-3, 353*b*-4, 353*b*-5, and 353*b*-6.

In the liquid discharge apparatus 1, the contact portion 180*b*-4 and the contact portion 180*b*-5 are disposed to be arranged side by side. In the Y-direction being a direction in which the contact portion 180*b*-4 and the contact portion 180*b*-5 are arranged, the contact portion 180*b*-4 and the contact portion 180*b*-3 are located to be adjacent to each other, the contact portion 180*b*-5 and the contact portion 180*b*-6 are located to be adjacent to each other, and the contact portion 180*b*-4 and the contact portion 180*b*-5 are located between the contact portion 180*b*-3 and the contact portion 180*b*-6. That is, in the liquid discharge apparatus 1, the contact portions 180*b*-3, 180*b*-4, 180*b*-5, and 180*b*-6 are included in a plurality of contact portions 180*b* at which the cable 19*b* and the connector 350*b* are electrically in contact with each other. The contact portion 180*b*-4 and the contact portion 180*b*-3 are located to be adjacent to each other. The contact portion 180*b*-5 and the contact portion 180*b*-6 are located to be adjacent to each other. The contact portion 180*b*-4 and the contact portion 180*b*-5 are located between the contact portion 180*b*-3 and the contact portion 180*b*-6. Here, the phrase of being located to be adjacent includes a case where, at the plurality of contact portions 180*b* at which the cable 19*b* and the connector 350*b* are electrically in contact with each other, the contact portion 180*b*-4 and the contact portion 180*b*-3, and the contact portion 180*b*-5 and the contact portion 180*b*-6 are located to be adjacent to each other through a space and the like. In other words, the contact portions 180*b*-3, 180*b*-4, 180*b*-5, and 180*b*-6 are provided in the plurality of contact portions 180*b* at which the cable 19*b* and the connector 350*b* are electrically in contact with each other, in order of the contact portions 180*b*-3, 180*b*-4, 180*b*-5, and 180*b*-6.

Here, the terminal 353*b*-19 is an example of a first terminal. The terminal 353*b*-3 is an example of a second terminal. The terminal 353*b*-6 is an example of a third terminal. The terminal 353*b*-4 is an example of a fourth terminal. The terminal 353*b*-5 is an example of a fifth terminal. The wiring 197*b*-19 is an example of a first wiring. The wiring 197*b*-3 is an example of a second wiring. The wiring 197*b*-6 is an example of a third wiring. The wiring 197*b*-4 is an example of a fourth wiring. The wiring 197*b*-5 is an example of a fifth wiring. The contact portion 180*b*-19 is an example of a first contact portion. The contact portion 180*b*-3 is an example of a second contact portion. The contact portion 180*b*-6 is an example of a third contact portion. The contact portion 180*b*-4 is an example of a fourth contact portion. The contact portion 180*b*-5 is an example of a fifth contact portion.

FIG. 17 is a diagram illustrating details of a signal which is propagated in the cable 19*a* and is input to the liquid discharge head 21 through the connector 350*a*. As illustrated in FIG. 17, the cable 19*a* is used for propagating a plurality of control signals including the ground signal GND1 and the voltage VHV to be supplied to the plurality of driving signal selection circuits 200. Thus, the plurality of control signals propagated in the cable 19*a* are supplied to the liquid discharge head 21 through the connector 350*a*.

Specifically, the ground signal GND1 is propagated in each of the wirings 197*a*-2 and 197*a*-4 to 197*a*-19 and is input to the liquid discharge head 21 through each of the contact portions 180*a*-2 and 180*a*-4 to 180*a*-19 and each of the connectors 350*a*-3 and 350*a*-4 to 350*a*-19. The voltage VHV is propagated in the wiring 197*a*-1 and is input to the liquid discharge head 21 through the contact portion 180*a*-1 and the connector 350*a*-1. The voltage VDD is propagated in each of the wirings 197*a*-20 to 197*a*-23 and is input to the liquid discharge head 21 through each of the contact portions 180*a*-20 to 180*a*-23 and each of the connectors 350*a*-20 to 350*a*-23. Here, the ground signal GND1 is an example of a first reference voltage signal.

The cable 19*a* is used for propagating a plurality of control signals such as a signal XHOT indicating temperature abnormality of the liquid discharge head 21 and a signal TH indicating temperature information of the liquid discharge head 21, between the liquid discharge head 21 and the control mechanism 10.

FIG. 18 is a diagram illustrating details of a signal which is propagated in the cable 19*b* and is input to the liquid discharge head 21 through the connector 350*b*. As illustrated in FIG. 18, the cable 19*b* is used for propagating the differential signal including the differential diagnosis signals dDIG1 and dDIG2, the differential clock signal dSCK and the differential print data signals dSI1 to dSI6, and the single-ended signal including the base diagnosis signals oDIG3 and oDIG4, the base latch signal oLAT, the base change signals oCHa and oCHb, and the ground signals GND1 and GND2.

The one signal dDIG1+ in the differential diagnosis signal dDIG1 is propagated in the wiring 197*b*-4 of the cable 19*b* and is input to the liquid discharge head 21 through the contact portion 180*b*-4 and the terminal 353*b*-4 in the connector 350*b*. The other signal dDIG1− in the differential diagnosis signal dDIG1 is propagated in the wiring 197*b*-5 of the cable 19*b* and is input to the liquid discharge head 21 through the contact portion 180*b*-5 and the terminal 353*b*-5 in the connector 350*b*.

The one signal dDIG2+ in the differential diagnosis signal dDIG2 is propagated in the wiring 197*b*-7 of the cable 19*b* and is input to the liquid discharge head 21 through the contact portion 180*b*-7 and the terminal 353*b*-7 in the connector 350*b*. The other signal dDIG2− in the differential diagnosis signal dDIG2 is propagated in the wiring 197*b*-8 of the cable 19*b* and is input to the liquid discharge head 21 through the contact portion 180*b*-8 and the terminal 353*b*-8 in the connector 350*b*.

The base diagnosis signal oDIG3 is propagated in the wiring 197*b*-20 of the cable 19*b* and is input to the liquid discharge head 21 through the contact portion 180*b*-20 and the terminal 353*b*-20 in the connector 350*b*. The base diagnosis signal oDIG4 is propagated in the wiring 197*b*-22 of the cable 19*b* and is input to the liquid discharge head 21 through the contact portion 180*b*-22 and the terminal 353*b*-22 in the connector 350*b*. Here, the wiring 197*b*-20 is an example of a seventh wiring. The terminal 353*b*-20 is an example of a seventh terminal. The contact portion 180*b*-20 at which the wiring 197*b*-20 and the terminal 353*b*-20 are electrically in contact with each other is an example of a seventh contact portion.

The one signal dSCK+ in the differential clock signal dSCK is propagated in the wiring 197*b*-4 of the cable 19*b* and is input to the liquid discharge head 21 through the contact portion 180*b*-4 and the terminal 353*b*-4 in the connector 350*b*. The other signal dSCK− in the differential clock signal dSCK is propagated in the wiring 197*b*-5 of the cable 19*b* and is input to the liquid discharge head 21 through the contact portion 180*b*-5 and the terminal 353*b*-5 of the connector 350*b*.

That is, the wiring 197*b*-4 is used as the wiring for propagating the one signal dDIG1+ of the pair of differential diagnosis signals dDIG1 and as the wiring for propagating the one signal dSCK+ of the pair of differential clock signals dSCK. The wiring 197*b*-5 is used as the wiring for propagating the other signal dDIG1− of the pair of differential diagnosis signals dDIG1 and as the wiring for propagating the other signal dSCK− of the pair of differential clock signals dSCK. The terminal 353*b*-4 is used as the terminal to which the one signal dDIG1+ of the pair of differential diagnosis signals dDIG1 is supplied and as the terminal to which the one signal dSCK+ of the pair of differential clock signals dSCK is supplied. The terminal 353*b*-5 is used as the terminal to which the other signal dSCK− of the pair of differential clock signals dSCK is supplied, and as the terminal to which the other signal dSCK− of the pair of differential clock signals dSCK is supplied. Thus, it is possible to reduce the number of wirings for coupling the liquid discharge head control circuit 15 and the liquid discharge head 21 to each other.

The one signal dSI1+ in the differential print data signal dSI1 is propagated in the wiring 197*b*-7 of the cable 19*b* and is input to the liquid discharge head 21 through the contact portion 180*b*-7 and the terminal 353*b*-7 in the connector 350*b*. The other signal dSI1− in the differential print data signal dSI1 is propagated in the wiring 197*b*-8 of the cable 19*b* and is input to the liquid discharge head 21 through the contact portion 180*b*-8 and the terminal 353*b*-8 in the connector 350*b*.

That is, the wiring 197*b*-7 is used as the wiring for propagating the one signal dDIG2+ of the pair of differential diagnosis signals dDIG2 and as the wiring for propagating the one signal dSI1+ of the pair of differential print data signals dSI1. The wiring 197*b*-8 is used as the wiring for propagating the other signal dDIG2− of the pair of differential diagnosis signals dDIG2 and as the wiring for propagating the other signal dSI1− of the pair of differential print data signals dSI1. The terminal 353*b*-7 is used as the terminal to which the one signal dDIG2+ of the pair of differential diagnosis signals dDIG2 is supplied and as the terminal to which the one signal dSI1+ of the pair of differential print data signals dSIS1 is supplied. The terminal 353*b*-8 is used as the terminal to which the other signal dDIG2− of the pair of differential diagnosis signals dDIG2 is supplied, and as the terminal to which the other signal dSI1− of the pair of differential print data signals dSI1 is supplied. Thus, it is possible to reduce the number of wirings for coupling the liquid discharge head control circuit 15 and the liquid discharge head 21 to each other.

The differential print data signals dSI2 to dSI6 are propagated in the wirings 197*b*-9 to 197*b*-18 of the cable 19*b* and are input to the liquid discharge head 21 through the contact portions 180*b*-9 to 180*b*-18 and the terminals 353*b*-9 to 353*b*-18 in the connector 350*b*, respectively.

Specifically, the one signals dSI2+, dSI3+, dSI4+, dSI5+, and dSI6+ of the pair of differential print data signals dSI2 to dSI6 are propagated in the wirings 197*b*-9, 197*b*-11, 197*b*-13, 197*b*-15, and 197*b*-17 and are input to the liquid discharge head 21 through the contact portions 180*b*-9, 180*b*-11, 180*b*-13, 180*b*-15, and 180*b*-17 and the terminals 353*b*-9, 353*b*-11, 353*b*-13, 353*b*-15, and 353*b*-17, respectively. The other signals dSI2−, dSI3−, dSI4−, dSI5−, and dSI6− of the pair of differential print data signals dSI2 to dSI6 are propagated in the wirings 197*b*-10, 197*b*-12, 197*b*-14, 197*b*-16, and 197*b*-18 and are input to the liquid discharge head 21 through the contact portions 180*b*-10, 180*b*-12, 180*b*-14, 180*b*-16, and 180*b*-18 and the terminals 353*b*-10, 353*b*-12, 353*b*-14, 353*b*-16, and 353*b*-18.

The base latch signal oLAT is propagated in the wiring 197*b*-20 of the cable 19*b* and is input to the liquid discharge head 21 through the contact portion 180*b*-20 and the terminal 353*b*-20 in the connector 350*b*. The base change signal oCHa is propagated in the wiring 197*b*-22 of the cable 19*b* and is input to the liquid discharge head 21 through the contact portion 180*b*-22 and the terminal 353*b*-22 in the connector 350*b*. The base change signal oCHb is propagated in the wiring 197*b*-23 of the cable 19*b* and is input to the liquid discharge head 21 through the contact portion 180*b*-23 and the terminal 353*b*-23 of the connector 350*b*.

That is, the wiring 197*b*-20 is used as the wiring for propagating the base diagnosis signal oDIG3 and as the wiring for propagating the base latch signal oLAT. The wiring 197*b*-22 is used as the wiring for propagating the base diagnosis signal oDIG4 and as the wiring for propagating the base change signal oCHa. Thus, it is possible to reduce the number of wirings for coupling the liquid discharge head control circuit 15 and the liquid discharge head 21 to each other.

The ground signal GND1 is propagated in the wirings 197*b*-19 and 197*b*-21 of the cable 19*b* and is input to the liquid discharge head 21 through the contact portions 180*b*-19 and 180*b*-21 and the terminals 353*b*-19 and 3530*b*-21 in the connector 350*b*. That is, the wiring 197*b*-19 is electrically coupled to the terminal 353*b*-19 through the contact portion 180*b*-19 and is used for propagating the ground signal GND1 to be supplied to the driving signal selection circuit 200. The wiring 197*b*-21 is electrically coupled to the terminal 353*b*-21 through the contact portion 180*b*-21 and is used for propagating the ground signal GND1 to be supplied to the driving signal selection circuit 200. Thus, the wiring 197*b*-20 is located to be adjacent to the wiring 197*b*-19 and the wiring 197*b*-21 in the Y-direction being the direction in which the terminal 353*b*-4 and the terminal 353*b*-5 are arranged.

Thus, the ground signal GND1 is input to the terminal 353*b*-19 and the terminal 353*b*-21. The base diagnosis signal oDIG3 is input to the terminal 353*b*-20. The terminal 353*b*-20 is located to be adjacent to the terminal 353*b*-19 and the terminal 353*b*-21 in the Y-direction being the direction in which the terminal 353*b*-4 and the terminal 353*b*-5 are arranged. Thus, the ground signal GND1 is input to the contact portion 180*b*-19 and the contact portion 180*b*-21. The base diagnosis signal oDIG3 is input to the contact portion 180*b*-20. The contact portion 180*b*-20 is located to be adjacent to the contact portion 180*b*-19 and the contact portion 180*b*-21 in the Y-direction being the direction in which the contact portion 180*b*-4 and the contact portion 180*b*-5 are arranged. Here, the wiring 197*b*-21 is an example of a sixth wiring. The terminal 353*b*-21 is an example of a sixth terminal. The contact portion 180*b*-21 at which the wiring 197*b*-21 and the terminal 353*b*-21 are electrically in contact with each other is an example of a sixth contact portion.

The ground signal GND2 is propagated in the wirings 197*b*-3 and 197*b*-6 of the cable 19*b* and is input to the liquid discharge head 21 through the contact portions 180*b*-3 and 180*b*-6 and the terminals 353*b*-3 and 353*b*-6 in the connector 350*b*. That is, the wiring 197*b*-3 is electrically coupled to the terminal 353*b*-3 through the contact portion 180*b*-3 and is used for propagating the ground signal GND2 to be supplied to the driving signal selection circuit 200. The wiring 197*b*-6 is electrically coupled to the terminal 353*b*-6 through the contact portion 180*b*-6 and is used for propagating the ground signal GND2 to be supplied to the driving signal selection circuit 200. In the Y-direction being the direction in which the terminal 353*b*-4 and the terminal 353*b*-5 are arranged, the wiring 197*b*-3 is located to be adjacent to the wiring 197*b*-4, and the wiring 197*b*-6 is located to be adjacent to the wiring 197*b*-5. Here, the ground signal GND2 is an example of a second reference voltage signal.

The cable 19*b* is used for propagating a plurality of control signals such as a signal NVTS, a signal TSIG, and a signal NCHG, between the liquid discharge head 21 and the control mechanism 10. The signal NVTS is used for detecting a discharge state of an ink from the liquid discharge head 21. The signal TSIG is used for defining a detection timing of the discharge state of the ink by the signal NVTS. The signal NCHG is used for forcibly driving the plurality of piezoelectric elements 60 in the liquid discharge head 21.

FIG. 19 is a diagram illustrating details of a signal which is propagated in the cable 19*c* and is input to the liquid discharge head 21 through the connector 350*c*. FIG. 20 is a diagram illustrating details of a signal which is propagated in the cable 19*d* and is input to the liquid discharge head 21 through the connector 350*d*. As illustrated in FIGS. 19 and 20, the cable 19*c* and the cable 19*d* are used for propagating the driving signals COMA7 to COMA12 and COMB7 to COMB12 (being bases of the driving signals VOUT7 to VOUT12 to be supplied to one ends of the piezoelectric elements 60 included in the nozzle lines L2*a* to L2*f*) and the voltage VBS7 to VBS12 (to be supplied to the other ends of the piezoelectric elements 60).

Specifically, the driving signal COMA7 being the base of the driving signal VOUT7 to be supplied to one end of the piezoelectric element 60 included in the nozzle line L2*a* is propagated in wirings 197*d*-22 and 197*d*-24. The driving signal COMB7 is propagated in wirings 197*c*-2 and 197*c*-4. The voltage VBS7 to be supplied to the other end of the piezoelectric element 60 is propagated in wirings 197*c*-1, 197*c*-3, 197*d*-21, and 197*d*-23.

The driving signal COMA8 being the base of the driving signal VOUT8 to be supplied to one end of the piezoelectric element 60 included in the nozzle line L2*b* is propagated in wirings 197*c*-6 and 197*c*-8. The driving signal COMB8 is propagated in wirings 197*d*-18 and 197*d*-20. The voltage VBS8 to be supplied to the other end of the piezoelectric element 60 is propagated in wirings 197*c*-5, 197*c*-7, 197*d*-17, and 197*d*-19.

The driving signal COMA8 being the base of the driving signal VOUT9 to be supplied to one end of the piezoelectric element 60 included in the nozzle line L2*c* is propagated in wirings 197*d*-14 and 197*d*-16. The driving signal COMB9 is propagated in wirings 197*c*-10 and 197*c*-12. The voltage VBS9 to be supplied to the other end of the piezoelectric element 60 is propagated in wirings 197*c*-9, 197*c*-11, 197*d*-13, and 197*d*-15.

The driving signal COMA10 being the base of the driving signal VOUT10 to be supplied to one end of the piezoelectric element 60 included in the nozzle line L2*d* is propagated in wirings 197*c*-14 and 197*c*-16. The driving signal COMB10 is propagated in wirings 197*d*-10 and 197*d*-12. The voltage VBS10 to be supplied to the other end of the piezoelectric element 60 is propagated in wirings 197*c*-13, 197*c*-15, 197*d*-9, and 197*d*-11.

The driving signal COMA11 being the base of the driving signal VOUT11 to be supplied to one end of the piezoelectric element 60 included in the nozzle line L2*e* is propagated in wirings 197*d*-6 and 197*d*-8. The driving signal COMB11 is propagated in wirings 197*c*-18 and 197*c*-20. The voltage VBS11 to be supplied to the other end of the piezoelectric element 60 is propagated in wirings 197*c*-17, 197*c*-19, 197*d*-5, and 197*d*-7.

The driving signal COMA12 being the base of the driving signal VOUT12 to be supplied to one end of the piezoelectric element 60 included in the nozzle line L2*f* is propagated in wirings 197*c*-22 and 197*c*-24. The driving signal COMB12 is propagated in wirings 197*d*-2 and 197*d*-4. The voltage VBS12 to be supplied to the other end of the piezoelectric element 60 is propagated in wirings 197*c*-21, 197*c*-23, 197*d*-1, and 197*d*-3.

FIG. 21 is a diagram illustrating details of a signal which is propagated in the cable 19*e* and is input to the liquid discharge head 21 through the connector 350*e*. As illustrated in FIG. 21, the cable 19*e* is used for propagating a plurality of control signals including the ground signal GND1 and the voltage VHV to be supplied to the plurality of driving signal selection circuits 200. The plurality of control signals propagated in the cable 19*e* are supplied to the liquid discharge head 21 through the connector 350*e*.

Specifically, the ground signal GND1 is propagated in each of the wirings 197*e*-2 and 197*e*-4 to 197*e*-19 and is input to the liquid discharge head 21 through each of the contact portions 180*e*-2 and 180*e*-4 to 180*e*-19 and each of the connectors 350*e*-3 and 350*e*-4 to 350*e*-19. The voltage VHV is propagated in the wiring 197*e*-1 and is input to the liquid discharge head 21 through the contact portion 180*e*-1 and the connector 350*e*-1. The voltage VDD is propagated in each of the wirings 197*e*-20 to 197*e*-23 and is input to the liquid discharge head 21 through each of the contact portions 180*e*-20 to 180*e*-23 and each of the connectors 350*e*-20 to 350*e*-23.

The cable 19*e* is used for propagating a plurality of control signals such as a signal XHOT indicating temperature abnormality of the liquid discharge head 21 and a signal TH indicating temperature information of the liquid discharge head 21, between the liquid discharge head 21 and the control mechanism 10.

FIG. 22 is a diagram illustrating details of a signal which is propagated in the cable 19*f* and is input to the liquid discharge head 21 through the connector 350*f*. As illustrated in FIG. 22, the cable 19*b* is used for propagating the differential signal including the differential clock signal dSCK and the differential print data signals dSI7 to dSI12, and the single-ended signal including the base latch signal oLAT, the base change signals oCHa and oCHb, and the ground signals GND1 and GND2.

The one signal dSCK+ in the differential clock signal dSCK is propagated in a wiring 197f-4 of the cable 19f and is input to the liquid discharge head 21 through the contact portion 180f-4 and the terminal 353f-4 in the connector 350f. The other signal dSCK− in the differential clock signal dSCK is propagated in a wiring 197f-5 of the cable 19f and is input to the liquid discharge head 21 through the contact portion 180f-5 and the terminal 353f-5 of the connector 350f.

The differential print data signals dSI7 to dSI12 are propagated in wirings 197f-7 to 197f-18 of the cable 19f and are input to the liquid discharge head 21 through the contact portions 180f-7 to 180f-18 and the terminals 353b-7 to 353b-18 in the connector 350f.

Specifically, the one signals dSI7+, dSI8+, dSI9+, dSI10+, dSI11+, and dSI12+ in the pair of differential print data signals sdSI7 to dSI12 are propagated in wirings 197f-7, 197f-9, 197f-11, 197f-13, 197f-15, and 197f-17 and are input to the liquid discharge head 21 through the contact portions 180f-7, 180f-9, 180f-11, 180f-13, 180f-15, and 180f-17 and the terminal 353f-7, 353f-9, 353f-11, 353f-13, 353f-15, and 353f-17, respectively. The other signals dSI7−, dSI8−, dSI9−, dSI10−, dSI11−, and dSI12− in the differential print data signals dSI7 to dSI12 are propagated in wirings 197f-8, 197f-10, 197f-12, 197f-14, 197f-16, and 197f-18 and are input to the liquid discharge head 21 through the contact portions 180f-8, 180f-10, 180f-12, 180f-14, 180f-16, and 180f-18 and the terminals 353f-8, 353f-10, 353f-12, 353f-14, 353f-16, and 353f-18.

The base latch signal oLAT is propagated in a wiring 197f-20 of the cable 19f and is input to the liquid discharge head 21 through the contact portion 180f-20 and the terminal 353f-20 in the connector 350f The base change signal oCHa is propagated in a wiring 197f-22 of the cable 19f and is input to the liquid discharge head 21 through the contact portion 180f-22 and the terminal 353f-22 in the connector 350f. The base change signal oCHb is propagated in a wiring 197f-23 of the cable 19f and is input to the liquid discharge head 21 through the contact portion 180f-23 and the terminal 353b-23 in the connector 350f.

The ground signal GND1 is propagated in wirings 197f-19 and 197f-21 of the cable 19f and is input to the liquid discharge head 21 through the contact portions 180f-19 and 180f-21 and the terminals 353f-19 and 353f-21 of the connector 350f.

The ground signal GND2 is propagated in wirings 197f-3 and 197f-6 of the cable 19f and is input to the liquid discharge head 21 through the contact portions 180f-3 and 180f-6 and the terminals 353f-3 and 353f-6 of the connector 350f The wiring 197f-3 is electrically coupled to the terminal 353f-3 through the contact portion 180f-3 and is used for propagating the ground signal GND2 to be supplied to the driving signal selection circuit 200. The wiring 197f-6 is electrically coupled to the terminal 353f-6 through the contact portion 180f-6, and is used for propagating the ground signal GND2 to be supplied to the driving signal selection circuit 200.

The cable 19f is used for propagating a plurality of control signals such as a signal NVTS for detecting a discharge state of an ink from the liquid discharge head 21, a signal TSIG for defining a detection timing of the discharge state of the ink by the signal NVTS, and a signal NCHG for forcibly driving the plurality of piezoelectric elements 60 in the liquid discharge head 21, between the liquid discharge head 21 and the control mechanism 10.

FIG. 23 is a diagram illustrating details of a signal which is propagated in the cable 19g and is input to the liquid discharge head 21 through the connector 350g. FIG. 24 is a diagram illustrating details of a signal which is propagated in the cable 19h and is input to the liquid discharge head 21 through the connector 350h. As illustrated in FIGS. 23 and 24, the cable 19g and the cable 19h are used for propagating the driving signals VOUT1 to VOUT6 to be supplied to one ends of the piezoelectric elements 60 included in the nozzle lines L1*a* to L1*f* and the voltage VBS1 to VBS6 (to be supplied to the other ends of the piezoelectric elements 60.

Specifically, the driving signal COMA1 being the base of the driving signal VOUT1 to be supplied to the one end of the piezoelectric element 60 included in the nozzle line L1*a* is propagated in wirings 197h-22 and 197h-24. The driving signal COMB1 is propagated in wirings 197g-2 and 197c-4. The voltage VBS1 to be supplied to the other end of the piezoelectric element 60 is propagated in wirings 197g-1, 197g-3, 197h-21, and 197h-23.

The driving signal COMA2 being the base of the driving signal VOUT2 to be supplied to one end of the piezoelectric element 60 included in the nozzle line L1*b* is propagated in wirings 197g-6 and 197g-8. The driving signal COMB2 is propagated in wirings 197h-18 and 197h-20. The voltage VBS2 to be supplied to the other end of the piezoelectric element 60 is propagated in wirings 197g-5, 197g-7, 197h-17, and 197h-19.

The driving signal COMA3 being the base of the driving signal VOUT3 to be supplied to one end of the piezoelectric element 60 included in the nozzle line L1*c* is propagated in wirings 197h-14 and 197h-16. The driving signal COMB3 is propagated in wirings 197g-10 and 197g-12. The voltage VBS3 to be supplied to the other end of the piezoelectric element 60 is propagated in wirings 197g-9, 197g-11, 197h-13, and 197h-15.

The driving signal COMA4 being the base of the driving signal VOUT4 to be supplied to one end of the piezoelectric element 60 included in the nozzle line L1*d* is propagated in wirings 197g-14 and 197g-16. The driving signal COMB4 is propagated in wirings 197h-10 and 197h-12. The voltage VBS4 to be supplied to the other end of the piezoelectric element 60 is propagated in wirings 197g-13, 197g-15, 197h-9, and 197h-11.

The driving signal COMA5 being the base of the driving signal VOUT5 to be supplied to one end of the piezoelectric element 60 included in the nozzle line L1*e* is propagated in wirings 197h-6 and 197h-8. The driving signal COMB5 is propagated in wirings 197g-18 and 197g-20. The voltage VBS5 to be supplied to the other end of the piezoelectric element 60 is propagated in wirings 197g-17, 197g-19, 197h-5, and 197h-7.

The driving signal COMA5 being the base of the driving signal VOUT6 to be supplied to one end of the piezoelectric element 60 included in the nozzle line L1*f* is propagated in wirings 197g-22 and 197g-24. The driving signal COMB6 is propagated in wirings 197h-2 and 197h-4. The voltage VBS6 to be supplied to the other end of the piezoelectric element 60 is propagated in wirings 197g-21, 197g-23, 197h-1, and 197h-3.

1.7. Advantageous Effects

In the liquid discharge apparatus 1, the liquid discharge head control circuit 15, and the liquid discharge head 21 configured in a manner as described above, the diagnosis signal DIG1 used for self-diagnosis of the liquid discharge head 21 is propagated as the pair of the differential diagnosis signals dDIG1, from the liquid discharge head control circuit 15 to the liquid discharge head 21. In this case, the wiring 197*b*-4, the terminal 353*b*-4, and the contact portion 180*b*-4 for propagating the signal dDIG1+ being the one signal of the pair of differential diagnosis signals dDIG1 are located to be adjacent to the wiring 197*b*-3, the terminal 353*b*-3, and the contact portion 180*b*-3 for propagating the ground signal GND2 of the restoration circuit 130 that restores the pair of differential diagnosis signals dDIG1 to the diagnosis signal DIG1. In addition, the wiring 197*b*-5, the terminal 353*b*-5, and the contact portion 180*b*-5 for propagating the signal dDIG1− being the other signal of the pair of differential diagnosis signals dDIG1 are located to be adjacent to the wiring 197*b*-6, the terminal 353*b*-6, and the contact portion 180*b*-6 for propagating the ground signal GND2 of the restoration circuit 130. Thus, it is possible to reduce a propagation path in which the pair of differential diagnosis signals dDIG1 are propagated to the restoration circuit 130. In addition, it is possible to reduce a concern that the pair of differential diagnosis signals dDIG1 are distorted, and to reduce a concern that external noise is superimposed on the pair of differential diagnosis signals dDIG1.

Accordingly, it is possible to reduce a concern that the signal waveform of the diagnosis signal DIG1 for performing self-diagnosis in the diagnostic circuit 240 is distorted and to reduce a concern that the self-diagnosis function in the diagnostic circuit 240 is not normally performed.

2. Second Embodiment

A liquid discharge apparatus 1, a liquid discharge head control circuit 15, and a liquid discharge head 21 according to a second embodiment will be described.

The liquid discharge head control circuit 15 in the second embodiment is different from the liquid discharge head control circuit 15 in the first embodiment in that the wiring 197*b*-4 adjacent to the wiring 197*b*-3 in which the ground signal GND2 to be supplied to the restoration circuit 130 is propagated is also used as a wiring in which one signal dDIG1+ of the pair of differential diagnosis signals dDIG1 and one signal dSI1+ of the pair of differential print data signals dSI1 are propagated, and the wiring 197*b*-5 adjacent to the wiring 197*b*-6 in which the ground signal GND2 is propagated is also used as a wiring in which the other signal dDIG1− of the pair of differential diagnosis signals dDIG1 and the other signal dSI1− of the pair of differential print data signals dSI1 are propagated.

The liquid discharge head 21 in the second embodiment is different from the liquid discharge head 21 in the first embodiment in that the terminal 353*b*-4 adjacent to the terminal 353*b*-3 to which the ground signal GND2 to be supplied to the restoration circuit 130 is input is also used as a terminal to which the one signal dDIG1+ of the pair of differential diagnosis signals dDIG1 and one signal dSI1+ of the pair of differential print data signals dSI1 are input, and the terminal 353*b*-5 adjacent to the terminal 353*b*-6 to which the ground signal GND2 is input is also used as a terminal to which the other signal dDIG1− of the pair of differential diagnosis signals dDIG1 and the other signal dSI1− of the pair of differential print data signals dSI1 are input.

The liquid discharge apparatus 1 in the second embodiment is different from the liquid discharge apparatus 1 in the first embodiment in that the contact portion 180*b*-4 adjacent to the contact portion 180*b*-3 to which the ground signal GND2 to be supplied to the restoration circuit 130 is input is also used as a contact portion to which the one signal dDIG1+ of the pair of differential diagnosis signals dDIG1 and one signal dSI1+ of the pair of differential print data signals dSI1 are input, and the contact portion 180*b*-5 adjacent to the contact portion 180*b*-6 to which the ground signal GND2 is input is also used as a contact portion to which the other signal dDIG1− of the pair of differential diagnosis signals dDIG1 and the other signal dSI1− of the pair of differential print data signals dSI1 are input.

When the liquid discharge apparatus 1, the liquid discharge head control circuit 15, and the liquid discharge head 21 according to the second embodiment will be described, the same components as those in the first embodiment are denoted by the same reference signs, and descriptions of the same components as those in the first embodiment will not be repeated.

FIG. 25 is a diagram illustrating details of a signal which is propagated in the cable 19*b* and is input to the liquid discharge head 21 through the connector 350*b* according to the second embodiment. As illustrated in FIG. 25, the wiring 197*a*-4 used as the wiring for propagating the one signal dDIG1+ of the pair of differential diagnosis signals dDIG1 and the wiring for propagating the one signal dSI1+ of the pair of differential print data signals dSI1 is located to be adjacent to the wiring 197-3 in which the ground signal GND2 to be supplied to the restoration circuit 130 is propagated. The wiring 197*a*-5 used as the wiring for propagating the other signal dDIG1− of the pair of differential diagnosis signals dDIG1 and the wiring for propagating the other signal dSI1− of the pair of differential print data signals dSI1 is located to be adjacent to the wiring 197*a*-6 in which the ground signal GND2 to be supplied to the restoration circuit 130 is propagated.

The terminal 353*b*-4 used as the terminal to which the one signal dDIG1+ of the pair of differential diagnosis signals dDIG1 is input and the terminal to which the one signal dSI1+ of the pair of differential print data signals dSI1 is input is located to be adjacent to the terminal 353*b*-3 to which the ground signal GND2 to be supplied to the restoration circuit 130 is input. The terminal 353*b*-5 used as the terminal to which the other signal dDIG1− of the pair of differential diagnosis signals dDIG1 is input and the terminal to which the other signal dSI1− of the pair of differential print data signals dSI1 is input is located to be adjacent to the terminal 353*b*-6 to which the ground signal GND2 to be supplied to the restoration circuit 130 is input.

The contact portion 180*b*-4 used as the contact portion to which the one signal dDIG1+ of the pair of differential diagnosis signals dDIG1 is input and the contact portion to which the one signal dSI1+ of the pair of differential print data signals dSI1 is input is located to be adjacent to the contact portion 180*b*-3 to which the ground signal GND2 to be supplied to the restoration circuit 130. The contact portion 180*b*-5 used as the contact portion to which the other signal dDIG1− of the pair of differential diagnosis signals dDIG1 is input and the contact portion to which the other signal dSI1− of the pair of differential print data signals dSI1 is input is located to be adjacent to the contact portion 180*b*-6 to which the ground signal GND2 to be supplied to the restoration circuit 130 is input.

The liquid discharge apparatus 1, the liquid discharge head control circuit 15, and the liquid discharge head 21 configured as described above in the second embodiment exhibit advantageous effects similar to those in the liquid discharge apparatus 1, the liquid discharge head control circuit 15, and the liquid discharge head 21 described in the first embodiment.

3. Third Embodiment

A liquid discharge apparatus 1, a liquid discharge head control circuit 15, and a liquid discharge head 21 according to a third embodiment will be described. The liquid discharge apparatus 1, the liquid discharge head control circuit 15, and the liquid discharge head 21 in the third embodiment are different from the liquid discharge apparatus 1, the liquid discharge head control circuit 15, and the liquid discharge head 21 in the first embodiment in that a wiring, a terminal, and a contact portion for propagating the ground signal GND to be supplied to the restoration circuit 130 are provided to face the wirings 197*b*-4 and 197*b*-5, the terminals 353*b*-4 and 353*b*-5, and the contact portions 180*b*-4 and 180*b*-5 for propagating the pair of differential diagnosis signals dDIG1. When the liquid discharge apparatus 1, the liquid discharge head control circuit 15, and the liquid discharge head 21 according to the third embodiment will be described, the same components as those in the first embodiment are denoted by the same reference signs, and descriptions of the same components as those in the first embodiment will not be repeated.

FIG. 26 is a diagram illustrating details of a signal which is propagated in the cable 19*a* and is input to the liquid discharge head 21 through the connector 350*a* according to the third embodiment. FIG. 27 is a diagram illustrating details of a signal which is propagated in the cable 19*b* and is input to the liquid discharge head 21 through the connector 350*b* according to the third embodiment.

Here, in the liquid discharge apparatus 1, the liquid discharge head control circuit 15, and the liquid discharge head 21 in the third embodiment, descriptions will be made on the assumption as follows. That is, the connector 350*a* and the connector 350*b* are provided such that each of the terminals 353*a*-1 to 353*a*-*p* in the connector 350*a* at least overlaps each of the terminals 353*b*-1 to 353*b*-*p* in the connector 350*b* when the head substrate 320 is viewed from the side 324 toward the side 323 in the X-direction, that is, when the head substrate 320 is viewed in a direction intersecting with a direction in which the terminals 353*a*-1 to 353*a*-*p* in the connector 350*a* are arranged in parallel. Specifically, the descriptions will be made on the assumption that the terminal 353*a*-1 in the connector 350*a* and the terminal 353*b*-*p* in the connector 350*b* are provided to at least overlap each other, and the terminal 353*a*-*j* (j is any of 1 to P) in the connector 350*a* and the terminal 353*b*−((p+1)−j) in the connector 350*b* are provided to at least overlap each other.

As illustrated in FIG. 26, the cable 19*a* is used for propagating a plurality of control signals including the ground signals GND1 and GND2 and the voltage VHV to be supplied to the plurality of driving signal selection circuits 200. Thus, the plurality of control signals propagated in the cable 19*a* are supplied to the liquid discharge head 21 through the connector 350*a*.

Specifically, the ground signal GND1 is propagated in each of the wirings 197*a*-2 and 197*a*-4 to 197*a*-19 and is input to the liquid discharge head 21 through each of the contact portions 180*a*-2 and 180*a*-4 to 180*a*-19 and each of the connectors 350*a*-3 and 350*a*-4 to 350*a*-19. The ground signal GND2 is propagated in each of the wirings 197*a*-20 and 197*a*-21 and is input to the liquid discharge head 21 through each of the contact portions 180*a*-20 and 180*a*-21 and each of the connectors 350*a*-20 and 350*a*-21. The voltage VHV is propagated in the wiring 197*a*-1 and is input to the liquid discharge head 21 through the contact portion 180*a*-1 and the connector 350*a*-1. The voltage VDD is propagated in each of the wirings 197*a*-22 and 197*a*-23 and is input to the liquid discharge head 21 through each of the contact portions 180*a*-22 and 180*a*-23 and each of the connectors 350*a*-20 and 350*a*-23.

As illustrated in FIG. 27, when the head substrate 320 is viewed from the side 324 toward the side 323 in the X-direction, the one signal dDIG1+ in the differential diagnosis signal dDIG1 is input to the terminal 353*b*-4 of the connector 350*b*, which is provided to at least overlap the terminal 353*a*-21 of the connector 350*a*, to which the ground signal GND2 is input. The other signal dDIG1− in the differential diagnosis signal dDIG1 is input to the terminal 353*b*-5 of the connector 350*b*, which is provided to at least overlap the terminal 353*a*-20 of the connector 350*a*, to which the ground signal GND2 is input.

That is, in the liquid discharge head 21 in the third embodiment, in the direction intersecting with the direction in which the terminal 353*b*-4 and the terminal 353*b*-5 are arranged, the terminal 353*a*-21 to which the ground signal GND2 is input is located to overlap the terminal 353*b*-4 to which the one signal dDIG1+ in the differential diagnosis signal dDIG1 is input, and the terminal 353*a*-20 to which the ground signal GND2 is input is located to overlap the terminal 353*b*-5 to which the other signal dDIG1− in the differential diagnosis signal dDIG1 is input. In other words, the ground signal GND2 and the differential diagnosis signal dDIG1 are input to the different connectors 350. In the direction intersecting with the direction in which the terminal 353*b*-4 and the terminal 353*b*-5 are arranged, the terminal 353*a*-21 to which the ground signal GND2 is input is located to face the terminal 353*b*-4 to which the one signal dDIG1+ in the differential diagnosis signal dDIG1 is input, and the terminal 353*a*-20 to which the ground signal GND2 is input is located to face the terminal 353*b*-5 to which the other signal dDIG1− in the differential diagnosis signal dDIG1 is input.

Here, the phrase of being located to face is not limited to that a space is provided between the terminal 353*a*-*k* and the terminal 353*b*-*k*. For example, the head substrate 320, the housing 351 of the connector 350, and the insulator 198 of the cable 19 may be interposed between the terminal 353*a*-*k* and the terminal 353*b*-*k*. In other words, the phrase of being located to face means that another terminal 353 is not located between the terminal 353*a*-*k* and the terminal 353*b*-*k* when viewed from a specific direction. That is, the shortest distance between the terminal 353*a*-21 to which the ground signal GND2 is input and the terminal 353*b*-4 to which the one signal dDIG1+ in the differential diagnosis signal dDIG1 is input is shorter than the shortest distance between the terminal 353*a*-21 and the terminal of the connector 350*a*, to which the ground signal GND1 is input. The shortest distance between the terminal 353*a*-20 to which the ground signal GND2 is input and the terminal 353*b*-5 to which the other signal dDIG1− in the differential diagnosis signal dDIG1 is input is shorter than the shortest distance between the terminal 353*a*-20 and the terminal of the connector 350*a*, to which the ground signal GND1 is input. Here, the shortest distance means a spatial distance when the terminals 353 are joined to each other by a straight line.

In the liquid discharge head control circuit 15 in the third embodiment, in the direction intersecting with the direction in which the wiring 197*b*-4 and the wiring 197*b*-5 are arranged, the wiring 197*a*-21 in which the ground signal GND2 is propagated is located to overlap the wiring 197*b*-4 in which the one signal dDIG1+ in the differential diagnosis signal dDIG1 is propagated. The wiring 197*a*-20 in which the ground signal GND2 is propagated is located to overlap the wiring 197*b*-5 in which the other signal dDIG1− in the differential diagnosis signal dDIG1 is propagated. In other words, the ground signal GND2 and the differential diagnosis signal dDIG1 are propagated in the different cables 19.

In the direction intersecting with the direction in which the wiring 197*b*-4 and the wiring 197*b*-5 are arranged, the wiring 197*a*-21 in which the ground signal GND2 is propagated is located to face the wiring 197*b*-4 in which the one signal dDIG1+ in the differential diagnosis signal dDIG1 is propagated. The wiring 197*a*-20 in which the ground signal GND2 is propagated is located to face the wiring 197*b*-5 in which the other signal dDIG1− in the differential diagnosis signal dDIG1 is propagated.

Here, the phrase of being located to face is not limited to that a space is provided between the wiring 197*a*-*k* and the wiring 197*b*-*k*. For example, the head substrate 320, the housing 351 of the connector 350, and the insulator 198 of the cable 19 may be interposed between the wiring 197*a*-*k* and the wiring 197*b*-*k*.

That is, in the liquid discharge apparatus 1 in the third embodiment, in the direction intersecting with the direction in which the contact portion 180*b*-4 and the contact portion 180*b*-5 are arranged, the contact portion 180*a*-21 to which the ground signal GND2 is input is located to overlap the contact portion 180*b*-4 to which the one signal dDIG1+ in the differential diagnosis signal dDIG1 is input. The contact portion 180*a*-20 to which the ground signal GND2 is input is located to overlap the contact portion 180*b*-5 to which the other signal dDIG1− in the differential diagnosis signal dDIG1 is input. In other words, the ground signal GND2 and the differential diagnosis signal dDIG1 are input to the liquid discharge head 21 from the liquid discharge head control circuit 15 through the different contact portions 180. In the direction intersecting with the direction in which the contact portion 180*b*-4 and the contact portion 180*b*-5 are arranged, the contact portion 180*a*-21 to which the ground signal GND2 is input is located to face the contact portion 180*b*-4 to which the one signal dDIG1+ in the differential diagnosis signal dDIG1 is input, and the contact portion 180*a*-20 to which the ground signal GND2 is input is located to face the contact portion 180*b*-5 to which the other signal dDIG1− in the differential diagnosis signal dDIG1 is input.

Here, the phrase of being located to face is not limited to that a space is provided between the contact portion 180*a*-*k* and the contact portion 180*b*-*k*. For example, the head substrate 320, the housing 351 of the connector 350, and the insulator 198 of the cable 19 may be interposed between the contact portion 180*a*-*k* and the contact portion 180*b*-*k*. In other words, the phrase of being located to face means that another contact portion 180 is not located between the contact portion 180*a*-*k* and the contact portion 180*b*-*k* when viewed from a specific direction. That is, the shortest distance between the contact portion 180*a*-21 to which the ground signal GND2 is input and the contact portion 180*b*-4 to which the one signal dDIG1+ in the differential diagnosis signal dDIG1 is input is shorter than the shortest distance between the contact portion 180*a*-21 and the contact portion 180 to which the ground signal GND1 is input. The shortest distance between the contact portion 180*a*-20 to which the ground signal GND2 is input and the contact portion 180*b*-5 to which the other signal dDIG1− in the differential diagnosis signal dDIG1 is input is shorter than the shortest distance between the contact portion 180*a*-20 and the contact portion 180 to which the ground signal GND1 is input. Here, the shortest distance means a spatial distance when the contact portions 180 are joined to each other by a straight line.

The liquid discharge apparatus 1, the liquid discharge head control circuit 15, and the liquid discharge head 21 configured as described above in the third embodiment exhibit advantageous effects similar to those in the liquid discharge apparatus 1, the liquid discharge head control circuit 15, and the liquid discharge head 21 described in the first embodiment.

Hitherto, the embodiments and the modification examples are described. However, the present disclosure is not limited to the above embodiments, and various forms can be made in a range without departing from the gist. For example, the embodiments may be appropriately combined.

The present disclosure includes the substantially same configurations (for example, configurations having the same functions, methods, and results, or configurations having the same objects and effects) as the configurations described in the embodiments. The present disclosure includes configurations in which non-essential components of the configurations described in the embodiments are replaced. The present disclosure includes configurations having the same advantageous effects as those of the configurations described in the embodiments or includes configurations capable of achieving the same object. The present disclosure includes configurations in which a known technique is added to the configurations described in the embodiments.

What is claimed is:

1. A liquid discharge head control circuit that controls an operation of a liquid discharge head that discharges a liquid from a nozzle, the liquid discharge head including a driving element that drives based on a driving signal to discharge the liquid from the nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit, the liquid discharge head control circuit comprising:

a conversion circuit that converts a base diagnosis signal being a base of the first diagnosis signal into the pair of first differential signals;

a first wiring which is electrically coupled to the first terminal and is used for propagating a first reference voltage signal to be supplied to the driving signal selection circuit;

a second wiring which is electrically coupled to the second terminal and is used for propagating a second reference voltage signal to be supplied to the restoration circuit;

a third wiring which is electrically coupled to the third terminal and is used for propagating the second reference voltage signal to be supplied to the restoration circuit;

a fourth wiring which is electrically coupled to the fourth terminal and is used for propagating one signal of the pair of first differential signals;

a fifth wiring which is electrically coupled to the fifth terminal and is used for propagating the other signal of the pair of first differential signals; and a driving signal output circuit that outputs the driving signal, wherein the fourth wiring and the fifth wiring are arranged side by side, in a direction in which the fourth wiring and the fifth wiring are arranged, the fourth wiring and the second wiring are located to be adjacent to each other, the fifth wiring and the third wiring are located to be adjacent to each other, and the fourth wiring and the fifth wiring are located between the second wiring and the third wiring.

2. A liquid discharge head control circuit that controls an operation of a liquid discharge head that discharges a liquid from a nozzle, the liquid discharge head including a driving element that drives based on a driving signal to discharge the liquid from the nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit, the liquid discharge head control circuit comprising:

a conversion circuit that converts a base diagnosis signal being a base of the first diagnosis signal into the pair of first differential signals;

a first wiring which is electrically coupled to the first terminal and is used for propagating a first reference voltage signal to be supplied to the driving signal selection circuit;

a second wiring which is electrically coupled to the second terminal and is used for propagating a second reference voltage signal to be supplied to the restoration circuit;

a third wiring which is electrically coupled to the third terminal and is used for propagating the second reference voltage signal to be supplied to the restoration circuit;

a fourth wiring which is electrically coupled to the fourth terminal and is used for propagating one signal of the pair of first differential signals;

a fifth wiring which is electrically coupled to the fifth terminal and is used for propagating the other signal of the pair of first differential signals; and a driving signal output circuit that outputs the driving signal, wherein the fourth wiring and the fifth wiring are arranged side by side, in a direction intersecting with a direction in which the fourth wiring and the fifth wiring are arranged, the second wiring is located to overlap the fourth wiring, and the third wiring is located to overlap the fifth wiring.

3. The liquid discharge head control circuit according to claim 1, wherein the conversion circuit converts a base clock signal being a base of a clock signal into a pair of second differential signals, the fourth wiring is also used as a wiring for propagating one signal of the pair of second differential signals, and the fifth wiring is also used as a wiring for propagating the other signal of the pair of second differential signals.

4. The liquid discharge head control circuit according to claim 1, wherein the conversion circuit converts a base print data signal being a base of a print data signal for defining a waveform selection of the driving signal into a pair of third differential signals, the fourth wiring is also used as a wiring for propagating one signal of the pair of third differential signals, and the fifth wiring is also used as a wiring for propagating the other signal of the pair of third differential signals.

5. The liquid discharge head control circuit according to claim 1, wherein the diagnostic circuit performs the self-diagnosis based on a third diagnosis signal and a fourth diagnosis signal in addition to the first diagnosis signal and the second diagnosis signal.

6. The liquid discharge head control circuit according to claim 5, wherein the liquid discharge head further includes a sixth terminal electrically coupled to the driving signal selection circuit, and a seventh terminal electrically coupled to the restoration circuit, the liquid discharge head control circuit further includes a sixth wiring which is electrically coupled to the sixth terminal and is used for propagating the first reference voltage signal to be supplied to the driving signal selection circuit, and a seventh wiring which is electrically coupled to the seventh terminal and is used for propagating the third diagnosis signal, and in a direction in which the fourth wiring and the fifth wiring are arranged, the seventh wiring is located to be adjacent to the first wiring and the sixth wiring.

7. A liquid discharge apparatus comprising:

a liquid discharge head that discharges a liquid from a nozzle; and a liquid discharge head control circuit that controls an operation of the liquid discharge head, the liquid discharge head including a driving element that drives based on a driving signal to discharge the liquid from the nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, a second terminal, a third terminal, a fourth terminal, and a fifth terminal which are electrically coupled to the restoration circuit, and the liquid discharge head control circuit including a conversion circuit that converts a base diagnosis signal being a base of the first diagnosis signal into the pair of first differential signals, a first wiring which is electrically coupled to the first terminal and is used for propagating a first reference voltage signal to be supplied to the driving signal selection circuit, a second wiring which is electrically coupled to the second terminal and is used for propagating a second reference voltage signal to be supplied to the restoration circuit, a third wiring which is electrically coupled to the third terminal and is used for propagating the second reference voltage signal to be supplied to the restoration circuit, a fourth wiring for propagating one signal of the pair of first differential signals, a fifth wiring for propagating the other signal of the pair of first differential signals, and a driving signal output circuit that outputs the driving signal, wherein the first wiring and the first terminal are electrically in contact with each other at a first contact portion, the second wiring and the second terminal are electrically in contact with each other at a second contact portion, the third wiring and the third terminal are electrically in contact with each other at a third contact portion, the fourth wiring and the fourth terminal are electrically in contact with each other at a fourth contact portion, the fifth wiring and the fifth terminal are electrically in contact with each other at a fifth contact portion, the fourth contact portion and the fifth contact portion are disposed to be arranged, in a direction in which the fourth contact portion and the fifth contact portion are arranged, the second contact portion is located to be adjacent to the fourth contact portion, the third contact portion is located to be adjacent to the fifth contact portion, and the fourth contact portion and the fifth contact portion are located between the second contact portion and the third contact portion.

8. A liquid discharge apparatus comprising:

a liquid discharge head that discharges a liquid from a nozzle; and a liquid discharge head control circuit that controls an operation of the liquid discharge head, the liquid discharge head including a driving element that drives based on a driving signal to discharge the liquid from the nozzle, a diagnostic circuit that performs self-diagnosis based on a first diagnosis signal and a second diagnosis signal, a restoration circuit that restores a pair of first differential signals to the first diagnosis signal, a driving signal selection circuit that controls a supply of the driving signal to the driving element, a first terminal electrically coupled to the driving signal selection circuit, and a second terminal, a third terminal, a fourth terminal, and a fifth terminal which are electrically coupled to the restoration circuit, the liquid discharge head control circuit including:

a conversion circuit that converts a base diagnosis signal being a base of the first diagnosis signal into the pair of first differential signals;

a first wiring which is electrically coupled to the first terminal and is used for propagating a first reference voltage signal to be supplied to the driving signal selection circuit, a second wiring which is electrically coupled to the second terminal and is used for propagating a second reference voltage signal to be supplied to the restoration circuit, a third wiring which is electrically coupled to the third terminal and is used for propagating the second reference voltage signal to be supplied to the restoration circuit, a fourth wiring for propagating one signal of the pair of first differential signals, a fifth wiring for propagating the other signal of the pair of first differential signals, and a driving signal output circuit that outputs the driving signal, wherein the first wiring and the first terminal are electrically in contact with each other at a first contact portion, the second wiring and the second terminal are electrically in contact with each other at a second contact portion, the third wiring and the third terminal are electrically in contact with each other at a third contact portion, the fourth wiring and the fourth terminal are electrically in contact with each other at a fourth contact portion, the fifth wiring and the fifth terminal are electrically in contact with each other at a fifth contact portion, the fourth contact portion and the fifth contact portion are disposed to be arranged, in a direction intersecting with a direction in which the fourth contact portion and the fifth contact portion are arranged, the second contact portion is located to overlap the fourth contact portion, and the third contact portion is located to overlap the fifth contact portion.

9. The liquid discharge apparatus according to claim 7, wherein the conversion circuit converts a base clock signal being a base of a clock signal into a pair of second differential signals, the fourth wiring is also used as a wiring for propagating one signal of the pair of second differential signals, and the fifth wiring is also used as a wiring for propagating the other signal of the pair of second differential signals.

10. The liquid discharge apparatus according to claim 7, wherein the conversion circuit converts a base print data signal being a base of a print data signal for defining a waveform selection of the driving signal into a pair of third differential signals, the fourth wiring is also used as a wiring for propagating one signal of the pair of third differential signals, and the fifth wiring is also used as a wiring for propagating the other signal of the pair of third differential signals.

11. The liquid discharge apparatus according to claim 7, wherein the diagnostic circuit performs the self-diagnosis based on a third diagnosis signal and a fourth diagnosis signal in addition to the first diagnosis signal and the second diagnosis signal.

12. The liquid discharge apparatus according to claim 11, wherein the liquid discharge head further includes a sixth terminal electrically coupled to the driving signal selection circuit, and a seventh terminal electrically coupled to the restoration circuit, and the liquid discharge head control circuit further includes a sixth wiring which is electrically coupled to the sixth terminal and is used for propagating the first reference voltage signal to be supplied to the driving signal selection circuit, and a seventh wiring which is electrically coupled to the seventh terminal and is used for propagating the third diagnosis signal, wherein the sixth wiring and the sixth terminal may be electrically in contact with each other at a sixth contact portion, the seventh wiring and the seventh terminal may be electrically in contact with each other at a seventh contact portion, in a direction in which the fourth contact portion and the fifth contact portion are arranged, the seventh contact portion is located to be adjacent to the first contact portion and the sixth contact portion.

* * * * *